US006729831B1

(12) United States Patent
Kawamura et al.

(10) Patent No.: US 6,729,831 B1
(45) Date of Patent: May 4, 2004

(54) EXTREMELY-SMALL-SWING WORKING MACHINE

(75) Inventors: Takuzo Kawamura, Osaka (JP); Hiroyuki Ohtsuki, Osaka (JP); Kazuya Hokimoto, Osaka (JP); Mineaki Ogata, Osaka (JP); Hisaji Amanuma, Osaka (JP); Yasuyuki Oyamada, Okayama (JP)

(73) Assignee: Yanmar Co., Ltd. (JP)

( * ) Notice: Subject to any disclaimer, the term of this patent is extended or adjusted under 35 U.S.C. 154(b) by 0 days.

(21) Appl. No.: 09/763,987

(22) PCT Filed: Jun. 14, 1999

(86) PCT No.: PCT/JP99/03175

§ 371 (c)(1),
(2), (4) Date: May 15, 2001

(87) PCT Pub. No.: WO00/12826

PCT Pub. Date: Mar. 9, 2000

(30) Foreign Application Priority Data

Aug. 31, 1998 (JP) ..... 10-246007
Aug. 31, 1998 (JP) ..... 10-246008
Aug. 31, 1998 (JP) ..... 10-246011

(51) Int. Cl.[7] ..... E02F 9/14
(52) U.S. Cl. ..... 414/694
(58) Field of Search ..... 414/694; 180/309, 180/89.2

(56) References Cited

U.S. PATENT DOCUMENTS 3,149,737 A * 9/1964 Guinot ..... 414/694
3,881,612 A * 5/1975 Wells ..... 414/694 X
4,343,374 A * 8/1982 Hollandsworth ..... 180/89.2
4,797,060 A * 1/1989 Kishi et al. ..... 414/694 X
5,525,028 A * 6/1996 Ogasawara et al. ..... 414/694
5,661,917 A * 9/1997 Marchetta et al. ..... 414/694 X

FOREIGN PATENT DOCUMENTS

| | | |
|---|---|---|
| JP | 57-22014 | 5/1982 |
| JP | 4-55530 | 2/1992 |
| JP | 5-7748 | 2/1993 |
| JP | 7-4558 | 1/1995 |
| JP | 7-38259 | 2/1995 |
| JP | 8-291531 | 11/1996 |
| JP | 8-302725 | 11/1996 |
| JP | 9-3953 | 1/1997 |

* cited by examiner

*Primary Examiner*—Donald W. Underwood
(74) *Attorney, Agent, or Firm*—Sterne, Kessler, Goldstein & Fox P.L.L.C.

(57) ABSTRACT

An extremely-small-swing working machine, comprising an operator cabin mounted on a swing table and a working arm device having a first boom section installed on the swing table on either one of the right and left sides of the cabin, a second boom section connected to the first boom section through a lower rotating shaft, a third boom section connected to the second boom section through an upper rotating shaft generally in parallel with the lower rotating shaft, an arm connected to the third boom section, and a working attachment connected to the tip of the arm, wherein the working attachment and the operation cab are formed so that they are not brought into contact with each other over the entire operating range of the working attachment without limiting or controlling the operation of the working attachment.

13 Claims, 45 Drawing Sheets

EXTREMELY-SMALL-SWING WORKING MACHINE

BACKGROUND OF THE INVENTION

1. Field of the Invention

The present invention relates to the construction of an extremely-small-swing working machine, constituting a working arm device by installing a working attachment on a boom-and-arm mounted on a swing table, enabling extremely-small swing in such a way that the boom-and-arm does not get out of the maximum-diameter swing circumference of the swing table in plan view when the boom-and-arm is folded to an upright state, and also enabling to offset the working attachment to left and right by turning the boom to left and right on the way thereof.

2. Background Art

Known as extremely-small-swing working machine constituted by installing a working attachment to a boom-and-arm mounted on a swing table disposed on a travelling machine is a swing excavator constituting a backhoe device by installing a bucket as working attachment, etc., for example. Moreover, also known to the public is a machine enabling to offset the attachment by turning the boom to left and right on the way thereof.

Explanation will be given, with reference to FIG. 40 to FIG. 49, on a swing excavator comprising a backhoe as an example of conventional swinging machine. As shown in FIG. 40 and FIG. 41, at the top of a travelling device 81 is slewably mounted a swing table 84, and at the top of the swing table 84 is provided an operator's cab 89 in which the operator's seat is covered by a cabin or a canopy, etc. The description regarding orientation and position hereafter will be given with reference to the orientation and position of the operator's cab 89.

On one side of the operator's cab 89 is mounted a first boom section 90 in a way to turn freely from front bottom to rear top, at the tip of the first boom section 90 is mounted a second boom section 91 in a way to turn freely to left and right, on the second boom section 91 is mounted a third boom section 92 in a way to turn freely, on the third boom section 92 is mounted an arm 93 in a way to turn up and down in the longitudinal direction, and at the tip of the arm 93 is mounted a bucket 94, which is a working attachment, in a way to turn up and down in the longitudinal direction, to constitute a backhoe device 85, making it possible to move (offset) the arm 93 and the bucket 94 by turning the second boom section 91 to left and right, and execute excavation work of street drain, etc.

The first boom section 90 is turned from front bottom to rear top by telescopic motion of a boom cylinder 97, the arm 93 is turned up and down by telescopic motion of an arm cylinder 98 interposed between the arm 93 and the third boom section 92, and the bucket 94 is turned up and down by telescopic motion of a bucket cylinder 99 interposed between the arm 93 and the bucket 94.

Moreover, the second boom section 91 is turned to left and right by telescopic motion of an offset cylinder 100 interposed between the first boom section 90 and the second boom section 91, while, on the other hand, between the first boom section 90 and the third boom section 92 is interposed a connecting rod 101, forming a link parallel to the second boom section 91, and the third boom section 92, the arm 93 and the bucket 94 are offset to left and right in a state parallel to the first boom 90.

Furthermore, the axis of the lower rotating shaft 95, connecting between the first boom section 90 and the second boom section 91, and the axis of the upper rotating shaft 96, connecting between the second boom section 91 and the third boom section 92, are disposed to be mutually parallel and, as shown in FIG. 40, the lower rotating shaft 95 is constructed in such a way that the end part on the side closer to the arm 93 of this lower rotating shaft 95 is placed at a position lower than the end part on the opposite side (namely, sloped downward in the forward direction), when the first boom section 90 is raised to its highest position.

The backhoe device 85 indicated in FIG. 40 is in a state in which the arm 93 is folded to the fullest extent, when the first boom section 90 is raised to its highest position (placed at the limit position of rear upward turn), and the rear end of the backhoe device 85 does not protrude backward from the rear end of the swing table 84, making it possible for the rear end of the backhoe device 85 to turn in the swing circle with maximum diameter of the swing table 84 in plan view, when the swing table 84 is turned in that state, and thus enabling extremely-small swinging with no fear of hitting against any obstacle. This state of backhoe device 85 will be called a state stored for extremely-small swing.

A locus 77 in FIG. 40 is the locus in which the tip part of the bucket 94 passes, with an up-down turning operation of the first boom section 90, the arm 93 and the bucket 94. This downward locus of the bucket 94 is produced when the bucket 94 is turned downward in the forward direction from the state in which it is folded to the fullest extent in said state stored for extremely-small swing, the arm 93 is also turned in the forward direction, and the bucket 94 is folded upward in the backward direction. As shown in the illustration, the locus 77 of the bucket 94 overlaps with the operator's cab 89 in side view, at some positions. Basically, the bucket 94 turns by the side of the operator's cab 89 when no offsetting is made, and there is no mutual interference between the two. However, in the case where the breadth of the bucket 94 is increased for an excavation work with a large breadth, etc., there are cases where interference is produced between the bucket 94 and the operator's cab 89 at points where the locus 77 overlaps with the operator's cab 89, and such interference must be avoided.

And, in the case where the first boom section 90 is raised to its highest position, the end closer to the arm 93 (front end) of the lower rotating shaft 95 comes to a position lower than the end on the opposite side (rear end) and, for that reason, as the second boom section 91 turns around the lower turning shaft 95, the bucket 94 moves to left and right and, as shown in FIG. 42, moves backward by a distance equal to the dimension V, namely in the direction coming closer to the operator's cab 89. The locus of the tip of the bucket 94 comes more in the backward direction than the locus 77 at a time without offset in FIG. 40.

It is when the bucket 94 is offset to the operator's cab 89 that a problem of interference with operator's cab 89 is posed. Even if the locus of the tip of the bucket 94 at a time of offset agrees with the locus 77, the bucket 94 cannot be positioned at points where the locus 77 overlaps with the operator's cab 89, in FIG. 40. In addition, since the actual locus at a time of offset is further in the backward direction than the locus 77, there are cases where interference is produced with the operator's cab 89 if any offsetting is made.

Moreover, on the swing table 84, the operator's seat 86 is disposed astride the swing center S' of the swing table 84, with a cabin covering the operator's seat 86 disposed from about the front part to the rear part of the swing table 84, thus constituting the operator's cab 89. And, to keep an open space in the forward direction of the operator's seat 86 for better operability, the front end of the operator's cab 89 rises about vertically from the front end of the swing table 84. The layout and construction of the operator's cab 89 disposed in the front area as described above also causes interference with the bucket 94.

Conventional arrangement for avoiding such interference between the bucket 94 and the operator's cab 89 consisted in restricting the rolling motion of the bucket 94 or the turning motion of the second boom section 91, by providing a mechanical safety device such as stopper, etc. or by electrically limiting such motions by using microcomputer, so that the bucket 94 may not get into the area interfering with the operator's cab 89 when the bucket 94 is wound up. For example, such arrangements are indicated in Provisional Patent Publication No. 4-55530, Provisional Utility Model Publication No. 5-7748, Provisional Utility Model Publication No. 7-4558, and Provisional Utility Model Publication No. 7-38259.

However, electrically controlling the motions of the second boom section 91 and the bucket 94, etc. by using microcomputer led to higher cost because it is necessary to separately provide a control system, and it was also disadvantageous from the structural viewpoint because of the necessity of taking waterproofing and dustproofing measures for the control system, while mechanically avoiding interference by installing a safety device, etc. also increased the cost and led to an increased weight because of the separately installed safety device, etc.

Furthermore, in the case where a extremely-small-swing machine provided with upper and lower rotating shafts 95 and 96 is in the state of deepest excavation as described earlier, the angle θ' against verticality of the axes of the upper rotating shaft 95 and the lower rotating shaft 96 comes close to right angle (small slope angle against the ground), as shown in FIG. 43, namely the two rotating shafts 95 and 96 are in about horizontal position in this state.

As a result, in the case of an excavation of street drain executed by offsetting the bucket 94 with a left-right turn of the second boom section 91, the deepest part of excavation was liable to become shallow, because the bottom end position of the bucket 94 greatly moves upward (amount of increase Y' indicated in FIG. 43), compared with a case without offset of the bucket 94.

The conventional backhoe device 85 had some defects produced from the structure of the third boom section 92, combined with the orientation of the rotating shafts 95 and 96 described before. Namely, the conventional third boom section 92 has, as shown in FIG. 44, a hinged part 92*a* with the upper rotating shaft 96 very close to the position where the arm supporting point 93*a* is disposed, a cylinder protector 92*b* is provided in extension in the backward direction (when the boom is raised) from this hinged part 92*a*, the base end of the arm cylinder 98 is supported with a shaft around the rear end of this cylinder protector 92*b*, and the cylinder protector 92*b* is disposed in greater part in the axial direction of the arm cylinder 98.

And, the axis of the upper rotating shaft 96 and the arm cylinder 98 are mutually perpendicular and, in the case where the arm 93 and the bucket 94 are offset in left and right directions, the arm cylinder 98 is apart from the greater part of the second boom section 91, except for the tip part of the second boom section 91 supporting the upper rotating shaft 96 with a shaft, as shown in FIG. 45, in plan view. This arm cylinder 98 is therefore in a state protected almost by the third boom section 92 only, although a cylinder protector 92*b* of the third boom section 92 is provided as mentioned before, and is liable to suffer from damages when it hits against an obstacle, because of a weak supporting and protective structure.

And, because the distance between the hinged part 92*a*, connecting with the second boom section 91, and the arm supporting point 93*a* is very short, the arm 93 gets in a state of extending downward almost from the tip of the second boom section 91, when the first boom section 90 to the second boom section 91 are inclined in the forward direction and the arm 93 is further extended downward vertically into a state of deepest excavation. The second boom section 91 in a posture inclined downward in the forward direction is liable to get in touch with an inlet edge 74 of the excavated ditch, as shown in FIG. 46, and not only the second boom section 91 and the third boom section 92 but also said offset cylinder 100 and connecting rod 101, etc. are liable to be damaged.

And, as shown in FIG. 47 and FIG. 48, hardly anything other than the arm 93 and the bucket 94 can get into the excavated ditch, and the depth of excavation cannot be increased so much because it is limited to an amount equal to the total of the respective lengths L2' and L3' of the arm 93 and the bucket 94. Moreover, in the case where the excavated earth and sand, etc. are loaded on a dump truck, the machine posture becomes as shown in FIG. 49, and, also in this case, even in the state where the bucket 94 is placed in the farthest position on the third boom section 92, the portion that can be disposed on the load-carrying platform 75 is no more than an mount equal to the total of the lengths L2' and L3' of the arm 93 and the bucket 94, because of a short distance from the tip of the second boom section 91 to the base end of the arm 93. As a result, the bucket 94 does not reach the front part of the load-carrying platform 75, in the case where the earth and sand are loaded from the backward direction of the load-carrying platform 75, making it necessary to move the working machine to the front part each time when the earth and sand are loaded on that part.

Furthermore, as shown in FIG. 40, when the first boom section 90 is raised to the highest position, the second boom section 91 is displaced in a way to be inclined forward, and the arm 93 is disposed about in vertical position and, for that reason, the area surrounded by the second boom section 91, the third boom section 92, the arm 93 and the line connecting between the bottom end of the second boom section 91 and the bottom end of the arm 93, in which is stored the bucket 94 in the state where the bucket 94 is wound up, is in about a triangle shape and very narrow. Consequently, in case this bucket 94 is wound up in a state having large excavated materials such as asphalt, etc. in it, there was a fear of breaking the second boom section 91, the third boom section 92 or the arm 93 by hitting against the excavated material protruding from the bucket 94.

In addition to such problems with working arm device and operator's cab represented by the backhoe device 85, the conventional extremely-small-swing working machine, which is constructed by disposing a muffler and an exhaust pipe for discharging exhaust air from the muffler to outside in the bonnet so as to discharge the exhaust air in the backward direction from a low position such as swing table, etc. located below the bonnet, presented problems such as discomfort caused by the exhaust air to workers working near the extremely-small-swing working machine in the direction of discharge of the exhaust air, drop of working efficiency with shielding of visual field, or withering of trees and plants in the neighborhood of the extremely-small-swing working machine, etc.

BRIEF SUMMARY OF THE INVENTION

An extremely-small-swing working machine according to the present invention is constructed, basically, by providing an operator's cab on a swing table and also providing, on one side of left and right, with reference to the position and orientation of the operator's cab, a working arm device composed of a first boom section on the swing table in a way to turn freely from front bottom to rear top, a second boom section connected to the turning tip of the first boom in a way to turn freely to left and right through a lower rotating shaft, a third boom section connected to the second boom section in a way to turn freely, in opposite direction, synchronizing with left-right turning of the second boom section, an arm connected to the third boom section in a way to turn freely up and down in the longitudinal direction, and a working attachment connected to the tip of the arm, in such a way as to make the working attachment move to left and right with left-right turning of the second boom section, and has characteristics providing the effects meeting the respective purposes to be described below.

As the first point, the extremely-small-swing working machine according to the present invention is constructed in a way to avoid any contact between the working attachment and the operator's cab, over the entire working range of the working attachment, without restricting or controlling the motions of the working attachment, to reduce the cost and weight.

To achieve such objective, the present invention will be constructed in such a way that, in the case where the first boom section is positioned at the turning limit at rear top, on the working arm device, one end closer to the arm, of the two ends of its lower rotating shaft, may come in a position higher than the other end. As a result, when the working attachment is moved to left and right, the portion from the second boom section to the working attachment will move to the arm side around the lower rotating shaft, and gets away from the operator's cab on the side opposite to the arm in side view.

Moreover, also on the working arm device, construction will be made in such a way that, when the first boom section is positioned at the turning limit at rear top, the angle formed by the axis of the lower rotating shaft and the front end face of the operator's cab becomes about right angle in side view. As a result, when the working attachment is moved to left and right, the portion from the second boom section to the working attachment will turn in parallel to the front end face of the operator's cab around the lower rotating shaft.

Such construction of the working arm system enables to prevent interference between the operator's cab and the working attachment, especially in the case where the working attachment is moved to left and right toward the operator's cab.

On the other hand, as for the construction of the operator's cab, the operator's seat in the operator's cab will be disposed in the backward direction from the swing center of the swing table and, at the same time, the operator's cab will be disposed at a position closer to the rear part on the swing table. This makes it possible to secure an open space in the front part of the operator's cab, operate the working attachment freely in that open space, and thus avoid interference with the operator's cab.

By utilizing, on the swing table, the open space in the forward direction which becomes available by disposing the operator's cab in the rear part, the oil feed port and the battery are disposed at a position not interfering with the working attachment in front of the operator's cab on the swing table, and those oil feed port and battery are covered by a resin hood. By disposing those members in this position, it becomes possible to secure an open space on the left and right sides of the operator's cab. The rear end face of the hood can be utilized directly as dashboard (front panel), without putting any obstacle to the operator's sight. The hood made of resin, free from any fear of rusting or peeling of paint even with adhesion of earth and sand or water, etc., can be manufactured at low cost.

Next, the second point is that the extremely-small-swing working machine according to the present invention is constructed in such a way that, in the case where the first boom section is positioned at the turning limit at rear top, both the first boom section and the second boom section are inclined rearward in the shape of a slope, to prevent the front part of the working arm device from protruding too much in the forward direction from the swing table, at the time of raising and folding of the working arm device, and that the angle against verticality of the second boom section is smaller than the angle against verticality of the first boom section to prevent the rear end of the working arm device from protruding too much in the backward direction from the swing table, to enable extremely-small swing.

Moreover, on the working arm device having a boom construction as described above, will be provided a rod forming a link parallel to the second boom section during a left-right turning of the second boom section between the first boom section and the third boom section, and at least one end of this rod will be connected to an area near the rear end of the third boom section, when said first boom section is positioned at the turning limit at rear top. As a result, even if the rod protrudes in the forward direction, in side view, from the second boom section at the lower half of the second boom section, when the first boom section is located at the turning limit at rear top in the same way as above, it overlaps with the second boom section at least at the upper half. Therefore, even if the first boom section is inclined in the forward direction for excavation work, etc., the rod does not protrude downward from the front half part of the second boom section which gets in a state of downward slope in the forward direction, and it becomes possible to avoid contact between the rod and the ground face even when the second boom section gets in contact with the ground.

As a third point, it is desirable, in an underground excavation work, to secure a deepest possible excavation, in the case where the working arm device is used as backhoe device by using a bucket as working attachment, for example. The present invention will therefore be constructed in such a way that, in the case where the first boom section is positioned at the turning limit at front bottom, the orientation of the axis of the lower rotating shaft and the axis of the upper rotating shaft may be about vertical. This will make it possible, in the case where the first boom section is positioned at the turning limit at front bottom, in the state where the working attachment is moved to left and right by turning the second boom section to left and right, to secure the deepest excavation point almost equal to that without offset, and perform excavation of a deep street drain, in the case where the height of the working attachment is hardly higher than the state without offset and, therefore, an excavation work of street drain, etc. is executed by using a bucket as working attachment.

Furthermore, the third boom section is formed in a way to extend downward, when the first boom section is positioned at the turning limit at front bottom, and its breadth is formed smaller than the breadth of the working attachment, making it possible to perform deep excavation with a depth equal to the total lengths of the third boom section, the arm and the bucket, while the side face of the ditch is formed with the side face of the bucket and there is no fear of destroying the ditch by contact with the third boom section.

The fourth point is to incline the first boom section upward in the forward direction and, in the state in which the arm is extended downward vertically, lower the highest position of the working arm device, so as to avoid obstacle over the working position as much as possible, for ground surface treatment, etc. by the attachment. For that purpose, the present invention will be constructed in such a way that the turning fulcrum of the arm on the third boom section is positioned above the axial extension line of the upper rotating shaft. This makes it possible to moderate the angle formed by the second boom section and the third boom section, when the working arm device is put in said posture for ground surface treatment, etc., and thus lower the position of the highest part of the working arm device.

Consequently, even in the case where there is any obstacle at a fairly low position above the working position, it becomes possible to execute work such as ground surface treatment, etc. with the working attachment.

The fifth point concerns protection of the working arm device. In the first place, it will be so constructed that, when the first boom section is positioned at the turning limit at rear top and the arm is wound up to the maximum, the arm and the second boom section are disposed about parallel to each other. Therefore, even when a bucket is used as working attachment for example and that the excavated asphalt blocks, etc. scooped into the bucket protrude from the bucket, an open space in longitudinal direction is secured between the second boom section and the arm in front of it, and the asphalt blocks, etc. hardly get in touch with the second boom section even if the tip of the bucket wound up to the maximum comes closer to the second boom section, thus enabling to avoid damage to the second boom section.

Still more, the upper rotating shaft is made to move along (the actuator) about in parallel to it in the greater part in the axial direction of the aim-operating actuator provided between the arm and the third boom section, while part of the second boom section is installed along the actuator, as radial bearing of the upper rotating shaft over about the entire length of the upper rotating shaft. As a result, since there exists a radial bearing of the second boom section along the arm-operating actuator even during a left-right turning of the second arm, the arm-operating actuator is solidly supported and is not easily damaged even in case it is hit by some obstacle.

And, the sixth point concerns the exhaust muffler and the exhaust pipe. In the present invention, an exhaust muffler is installed outside the bonnet covering the engine serving as motor loaded on the swing table, to avoid that the cool air from the radiator or oil cooler, etc., incorporated in the bonnet, be warmed by the heat of the muffler and lose its cooling effects. In addition, the terminal end of the exhaust pipe extended from the exhaust muffler is made to protrude above the operator's cab, to discharge the exhaust air from the upper part of the operator's cab and thus turn the exhaust air away from people working near the working machine and trees and plants, etc. in the surrounding area.

Other objectives, characteristics and effects of the present invention will be come clear with the following explanation based on the attached drawings.

BRIEF DESCRIPTION OF THE DRAWINGS/ FIGURES

DETAILED DESCRIPTION OF THE INVENTION

Figure 1:
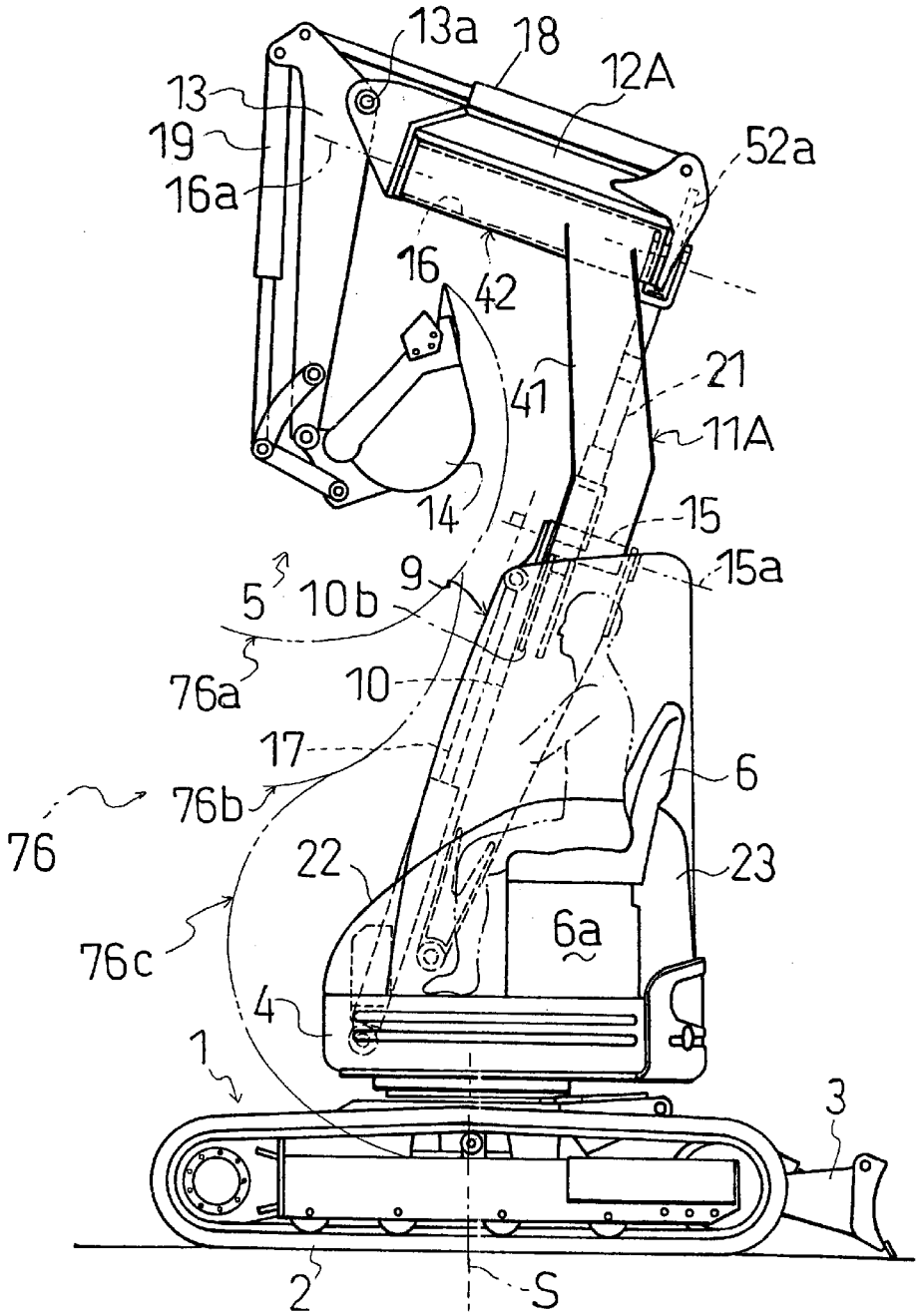
FIG. 1 is a side view showing a first type of an extremely-small-swing working machine according to the present invention.

The present invention is explained hereafter by using respective embodiments of three different types of extremely-small-swing working machine, i.e. first type in FIG. 1 to FIG. 12, second type in FIG. 13 to FIG. 21 and third type in FIG. 22 to FIG. 37. In the first place, explanation will be given on the construction of an extremely-small-swing working machine according to the present invention common to all types.

It is to be noted that the description regarding orientation and position of various portions (backhoe device 5, for example) on the swing table 4 to be described later will be given with reference to the orientation and position of an operator's seat 6 disposed on the swing table 4 (namely, orientation during a work of the worker sitting on the operator's seat 6), i.e. operator's cab 9.

Moreover, while in the following respective embodiments the working arm device composed of first to third boom sections, arm and working attachment is described as a backhoe device equipped with a bucket as working attachment, it is also all right to apply a working arm device other than a backhoe device, by either loading a rock crusher in place of the bucket or loading a working attachment intended for pinching or cutting wood.

Figure 2:
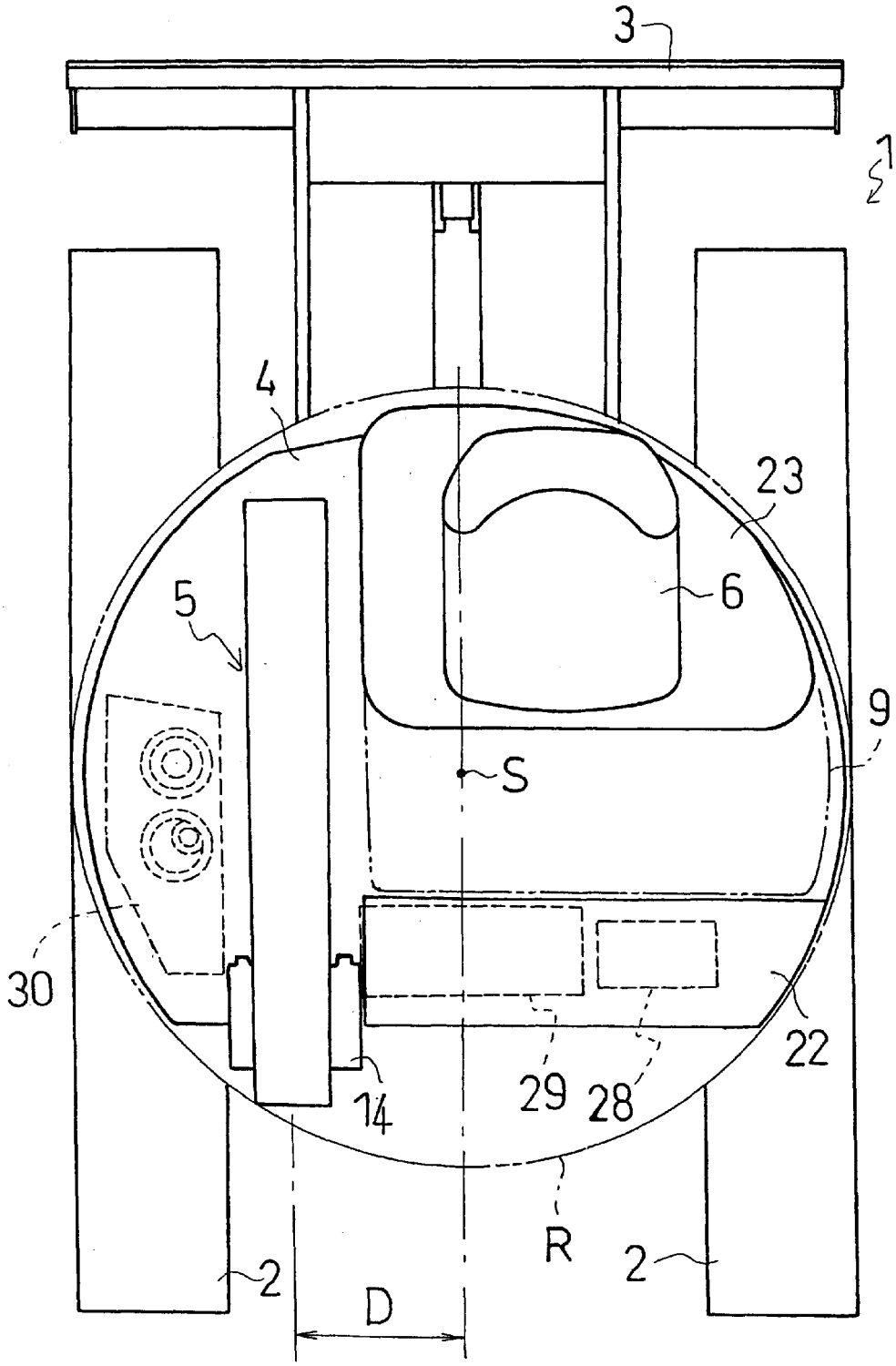
FIG. 2 is a plan view of above.
Figure 3:
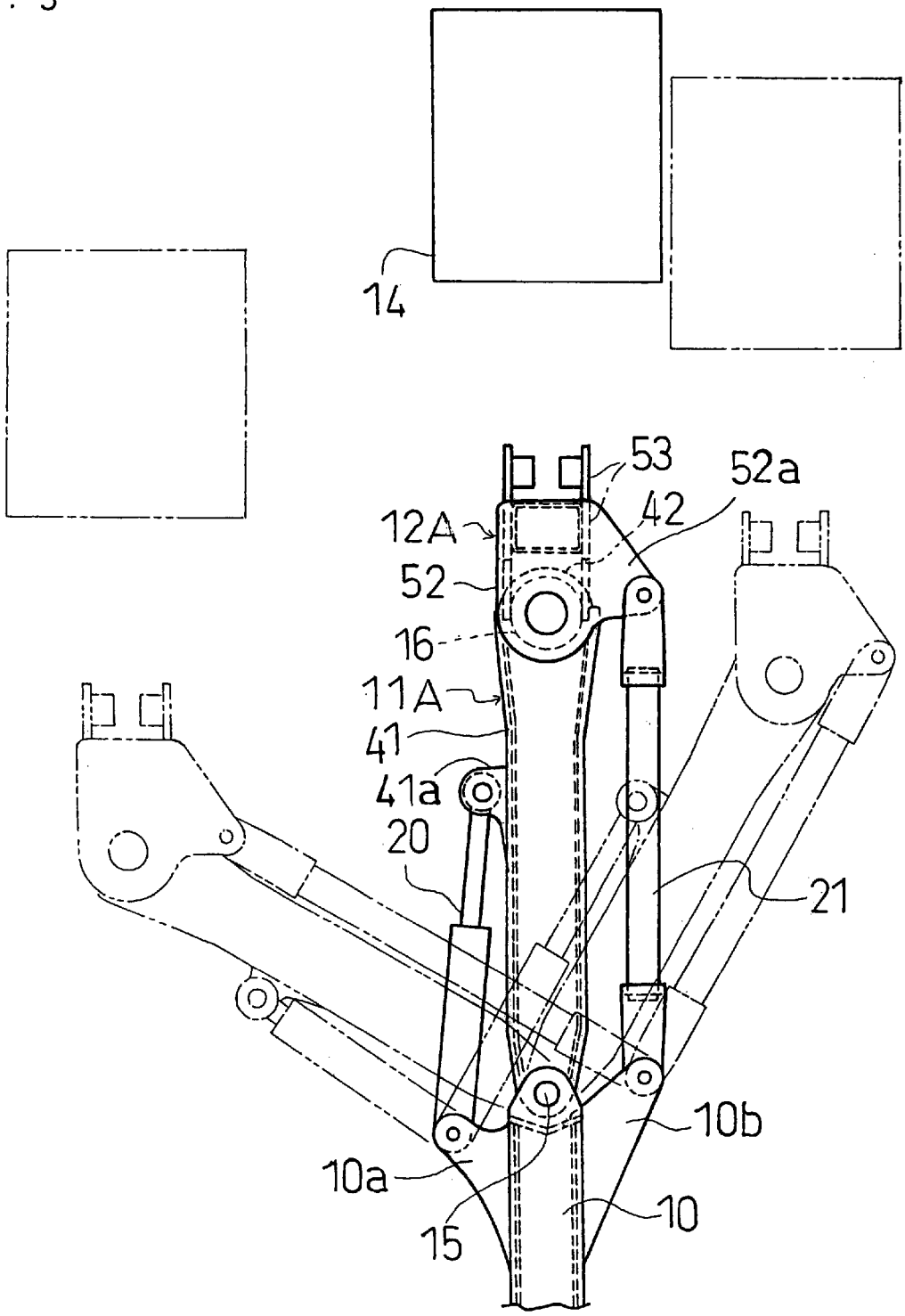
FIG. 3 is a rear view of a backhoe device of the first type.
Figure 5:
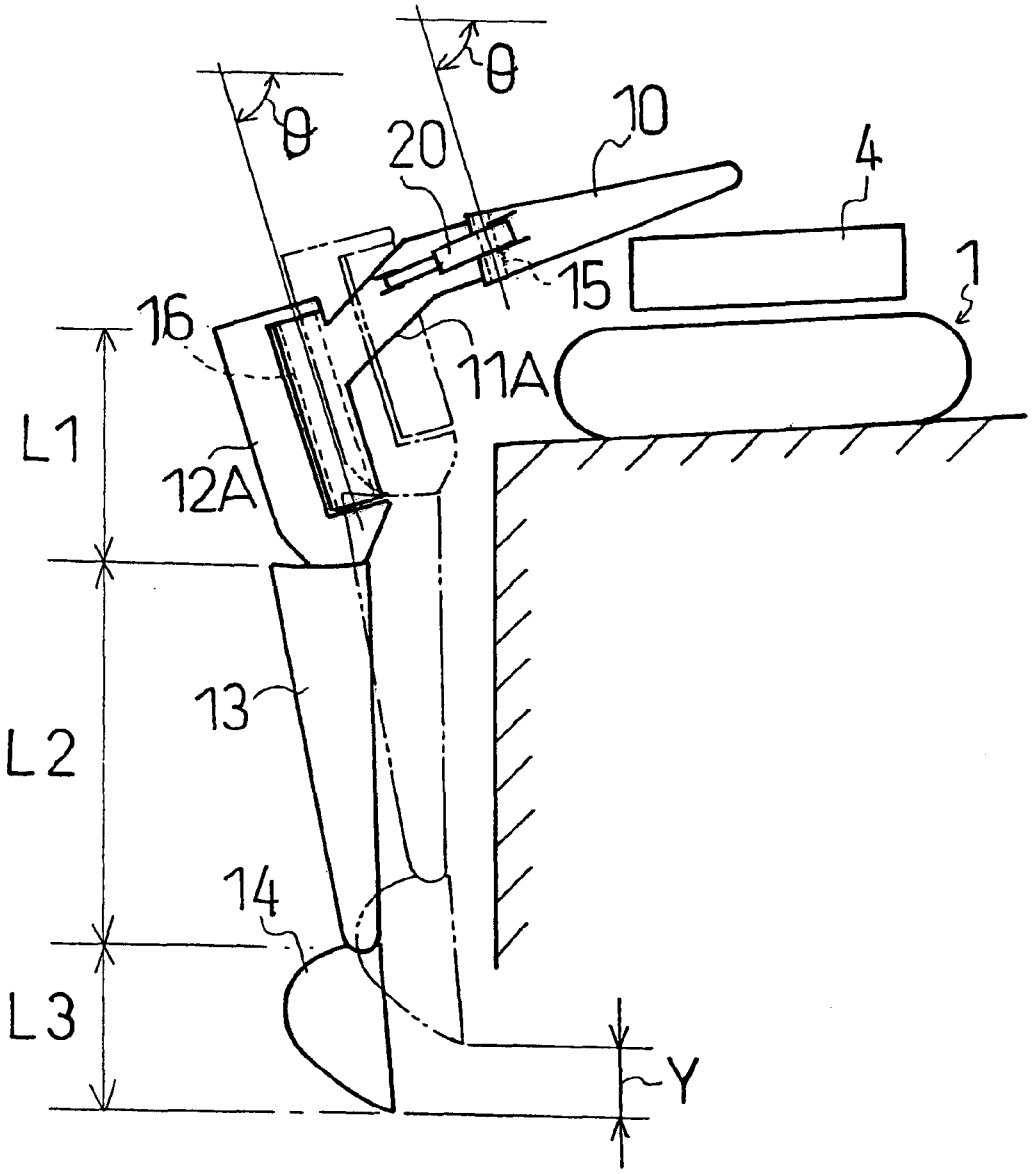
FIG. 5 is a side view showing changes in vertical position of the bucket in the case where the bucket is offset at the time of deepest excavation.
Figure 13:
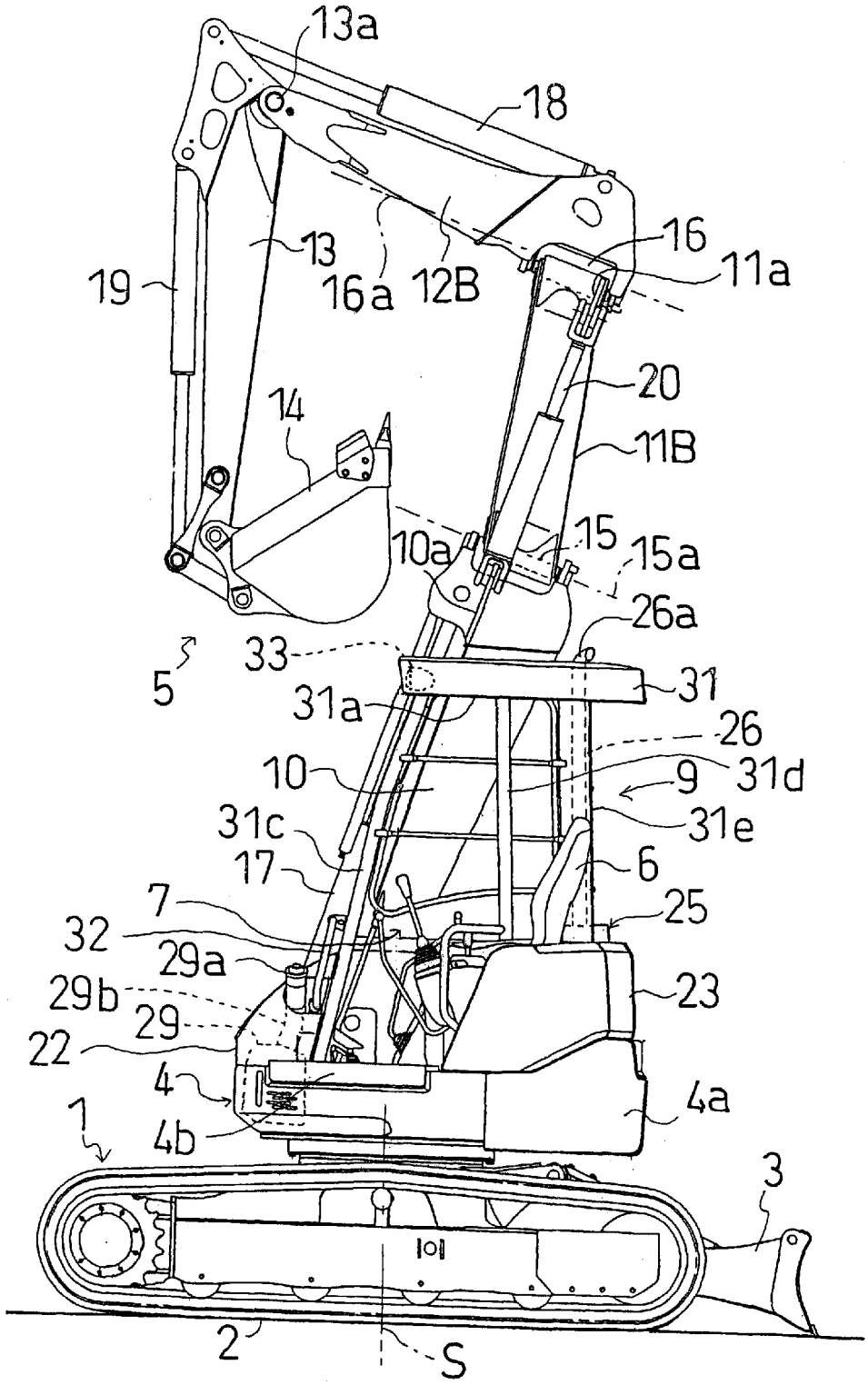
FIG. 13 is a side view showing a second type of an extremely-small-swing working machine according to the present invention.

As shown in FIG. 1 to FIG. 3, etc., at the top of a travelling frame 1 equipped with a pair of crawlers 2 (left, right) is slewably mounted a swing table 4, and on one side at the top of the swing table 4 is disposed an operator's seat 6. Also on the swing table 4 in front of the operator's seat 6 are disposed operating levers 7 for controlling or operating the travelling speed, working direction or a backhoe device 5, etc. In the first type, a front column 8 is disposed in standing position in front of the operator's seat 6 and the operating levers 7 are disposed on it, as shown in FIG. 5. In the second type, operating levers 7 are placed to rise from under the operator's seat 6 without providing the front column 8, as shown in FIG. 13. Those operator's seat 6, operating levers 7, or front column 8, etc. are covered by a box-type closed cabin or canopy, etc. as in the second and third types, to constitute an operator's cab 9, and by the side of the operator's cab 9 on the swing table 4 is disposed a backhoe device 5.

At the rear end, for example, of said travelling device 1 is disposed a soil discharging plate 3.

Next, explanation will be given on the backhoe device 5. The backhoe device 5 is composed of a first boom section 10 mounted on the swing table 4 in a way to turn freely up and down in the longitudinal direction, a second boom section 11 mounted at the turning tip of the first boom section 10, through a lower rotating shaft 15, in a way to turn freely to left and right, a third boom section 12 mounted on the second boom section 11 through an upper rotating shaft 16, in a way to turn freely to left and right, an arm 13 mounted on the third boom section 12 in a way to turn freely up and down in the longitudinal direction, and a bucket 14 which is a working attachment mounted in a way to turn freely up and down in the longitudinal direction, at the tip of the arm 13.

The second and third types are much different from the first type in the structure of the second and third boom sections. As symbols in the drawings, the second and third boom sections of the first type are given as 11A, 12A, while those of the second and third types are presented as 11B, 12B (the second and third type booms are different from each other in the connecting position of the connecting rod 21 to be described later, but will be treated as identical), the names of second boom section 11 and third boom section 12 will be generically used for all types in the explanation of common structure. Moreover, although the upper rotating shaft is also different in length and size depending on the structural differences of the second boom section 11 and the third boom section 12, the symbol given to an upper rotating shaft will be unified to 16 for all types, by considering them as substantially identical.

And, between the first boom section 10 and the swing table 4 is provided a boom cylinder 17, which is an actuator for operating the first boom section, to enable the first boom section 10 to turn from front bottom to rear top with extension and contraction of the boom cylinder 17. Between the third boom 12 and the arm 13 is provided an arm cylinder 18, which is an actuator for operating the arm, to enable the arm 13 to turn up and down in the longitudinal direction with extension and contraction of the arm cylinder 18. And between the arm 13 and the bucket 14 is provided a bucket cylinder 19, which is an actuator for operating the bucket, to enable the bucket 14 to turn up and down in the longitudinal direction with extension and contraction of the bucket cylinder 19.

With the extension and contraction of those boom cylinder 17, arm cylinder 18 and bucket cylinder 19, etc., the bucket 14 is made to move up and down and forward and backward or turn, to execute works (excavation) by using the bucket 14.

Moreover, between the bracket 10*a* provided on one side of the first boom section 10 and the bracket 11*a* (bracket 41*a* formed on the side face of the base 41 in the first type) provided on the same side of the second boom section 11 is provided an offset cylinder 20, which is an actuator for operating the second boom section 11. With the extension and contraction of this offset cylinder 20, the second boom section 11 turns to left and right against the first boom section 10 which in vertical direction in either plan view or rear view.

Furthermore, a connecting rod 21 is fit between the bracket 10*b* provided on either the opposite side (first type and second type) or on the same side (third type) of the bracket 10*a*, of the first boom section 10, and the bracket 12*a* (bracket 52*a* formed on the hinge connecting part 52 in the first type) provided on the third boom section 12 on the same side with the bracket 10*b*, to construct a parallel 4-stage link mechanism with the connecting rod 21, the first boom section 10, the second boom section 11 and the third boom section 12. Therefore, when the second boom section 11 turns to left and right against the first boom section 10 with extension and contraction of the offset cylinder 20, the third boom section 12 is held in a state parallel to the first boom section 10, and the arm 13 and the bucket 14 are moved to left and right (offset) in their initial positions in front elevation.

In the backhoe device 5 which can be offset to left and right as described above, in the state where the boom cylinder 17 is extended to raise the first boom section 10 to the highest position, i.e. position it to the turning limit at rear top and that, without offsetting the arm 13 and the bucket 14 to left and right, the arm cylinder 18 and the bucket cylinder 19 are extended to the fullest extent, and then wound up to the maximum (a state in the posture indicated in FIG. 1 and FIG. 2), at least the rear end of the backhoe device 5 can be housed in the circle R with maximum swing diameter (see FIG. 2) in plan view. If the swing table 4 is turned in this state, there is no fear that the rear end of the backhoe device 5, located behind the worker sitting on the operator's seat 6 and difficult to recognize, touch any obstacle during the swing, unless there is any obstacle existing in the circle R with maximum swing diameter of the swing table 4 in plan view.

Figure 22:
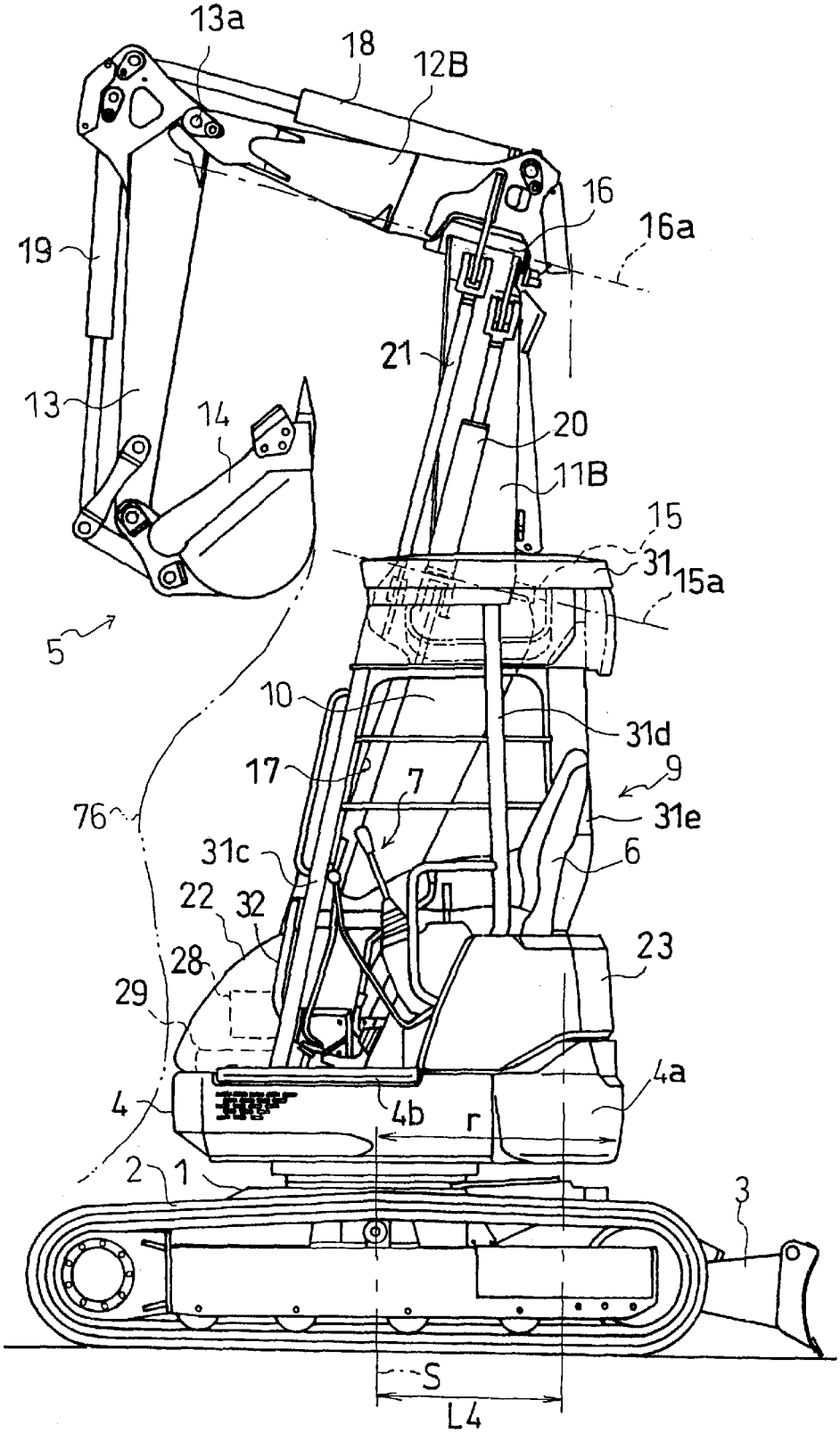
FIG. 22 is a side view showing a third type of an extremely-small-swing working machine according to the present invention.

As described above, (the extremely-small-swing working machine according to the present invention) is constructed in a way to avoid interference between the bucket 14 and the operator's cab 9, in whatever way the bucket 14 may be turned, in the state in which the rear end of the non-offset backhoe device 5 is housed in the circle R with maximum swing diameter (hereinafter referred to as "state stored for extremely-small swing") of the swing table 4 in plan view. In FIG. 1, FIG. 13 and FIG. 22 showing the respective embodiments of the first to third types, the locus of the tip of the turning bucket 14 (part closest to the operator's cab 9) at this time is expressed with two-dot chain line 76*a*.

Now, a problem produced in the case of offsetting the bucket 14 to left or right appears when the offsetting is made to the operator's cab 9 side. Supposing that the bucket 14 is offset without changing its longitudinal position, there is a fear of causing interference with a change in vertical position at the time of offset, even if there is a clearance in longitudinal direction between the bucket 14 and the operator's cab 9 when no offsetting is made in side view. In that case, in a state where offsetting is made to the operator's cab 9 side, control means for regulating the turning range of the bucket 14 must be used.

In the present invention, the lower rotating shaft 15 which is the left-right turning shaft of the second boom section 11 and the upper rotating shaft 16 which is the left-right turning shaft of the third boom section 12 are disposed in parallel to each other (an axis 15*a* of the lower rotating shaft 15 and an axis 16*a* of the upper rotating shaft 16 are parallel), as shown in FIG. 1, FIG. 13 and FIG. 22. In addition, the lower rotating shaft 15 is constructed in such a way that the arm 13 side of the lower rotating shaft 15 is positioned higher than the end on the opposite side (the front part of the lower rotating shaft 15 is higher than the rear part, in this embodiment), in the case where the first boom section 10 is raised to the highest position.

Figure 4:
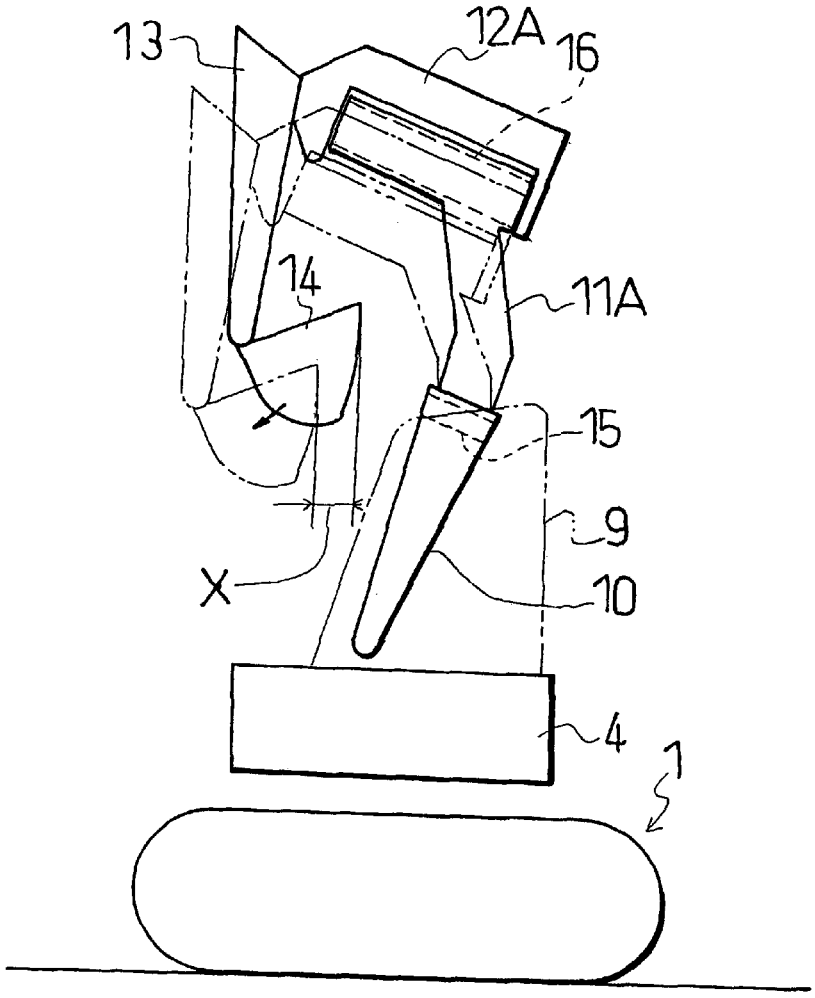
FIG. 4 is a side view showing the way of a bucket moving forward in the case where the bucket is offset in the transversal direction in the present invention.
Figure 10:
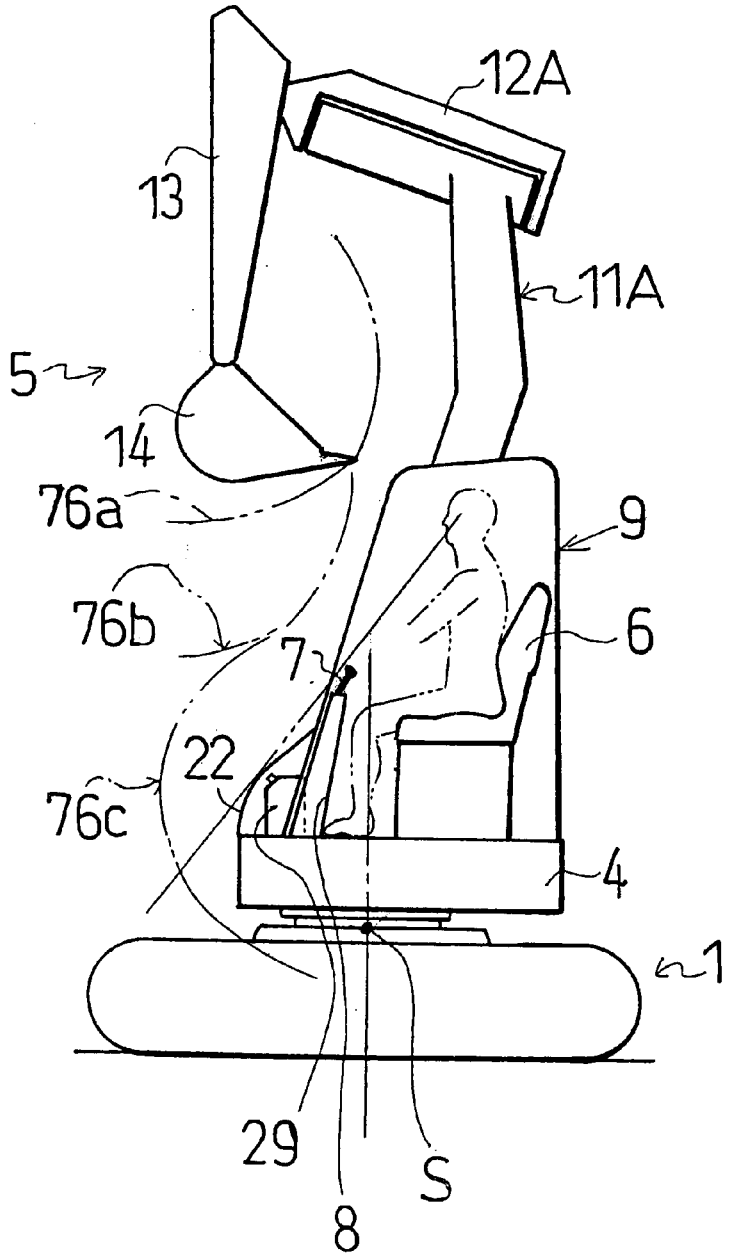
FIG. 10 is a side view showing a position where a driver's seat is disposed and a moving locus of the bucket.

Therefore, if, in the case where the first boom section 10 is raised to the highest position, the second boom section 11 turns around the lower rotating shaft 15 and the bucket 14 is offset to left or right, the bucket 14 will move, in side view, in the direction getting away from the operator's cab 9 by a distance X, as shown in FIG. 4. The two-dot chain line 76*b* just under said locus 76*a*, in FIG. 1 and FIG. 10, is the turning locus of the tip of the bucket 14 at the time when it is offset to left or right from the state stored for extremely-small swing. This locus 76*b*, though shifted lower than the locus 76 by an amount equal to the left-right offset, is found advanced in the forward direction, avoiding interference with the operator's cab 9 in side view.

The turning locus 76*c* under it at the tip of the bucket 14 is one produced when the bucket 14 is turned at a position closest to the operator's cab 9, in the state in which the arm 13 is folded toward the operator by turning the boom (first boom section 10) downward in the forward direction. Also in this case, no interference is produced with the operator's cab 9 or a hood 22 immediately before it, etc., even when the bucket 14 comes to a position closest to the operator's cab 9.

In combination with such structure of the backhoe device 5, the shape of the operator's cab 9, especially of its front part, is important, to avoid interference between the bucket 14 and the operator's cab 9 (especially when the bucket 14 is offset to the operator's cab 9 side). This point will be explained with an embodiment in which the operator's cab 9 is constructed with a canopy 31, of the second type and the third type disclosed in FIG. 13 and FIG. 22, etc.

The canopy 31 is supported by a front stay 31*c*, a middle stay 31*d* and a rear stay 31*e* in order from the front part in side view and, of those stays, the middle stay 31*d* and the rear stay 31*e* are about vertical, while the front stay 31*c* is sloped upward in the backward direction. This angle of inclination is about perpendicular in side view to the axis (axial extension line 15*a*) of the lower rotating shaft 15 at the time when the first boom section 10 is put to its highest position.

In the case where the bucket 14 is offset to left or right, this bucket 14 turns along a hypothetical plane in the radial direction (right angle) against the axial extension line 15*a* of the lower rotating shaft 15 in the shape sloped upward in the forward direction, in side view. (For that reason, the bucket 14 moves in the forward direction when it is offset.) This hypothetical plane is parallel in side view to the front stay 31*c* having a rear upward slope angle as described before. Therefore, in the case where the bucket 14 is offset to left or right, this bucket 14 moves about in parallel to the front stay 31*c*, in side view, and does not interfere with the front stay 31*c*, i.e. the operator's cab 9.

Consequently, since interference between the bucket 14 and the operators cab 9 can be avoided even when the bucket 14 is offset toward the operator's cab 9, of left and right, there is no need of using any control system, etc. controlling the motions of the bucket 14.

In addition to this canopy 31, also in the case where the operator's cab 9 is constructed with a closed box-type cabin, etc., what is required is to keep the angle formed by the front end face of the operator's cab 9 and the axis of the lower rotating shaft 15, at the time when the first boom section 10 is put to its highest position, at about right angle, in side view. Also in FIG. 1 is indicated a state in which, whatever the structure of covering of the operator's cab 9 may be, its front end face is sloped upward in the backward direction, at an angle of inclination about perpendicular to the axis of the lower rotating shaft 15, at the time when the first boom section 10 is put to its highest position, at about right angle in side view.

Figure 11:
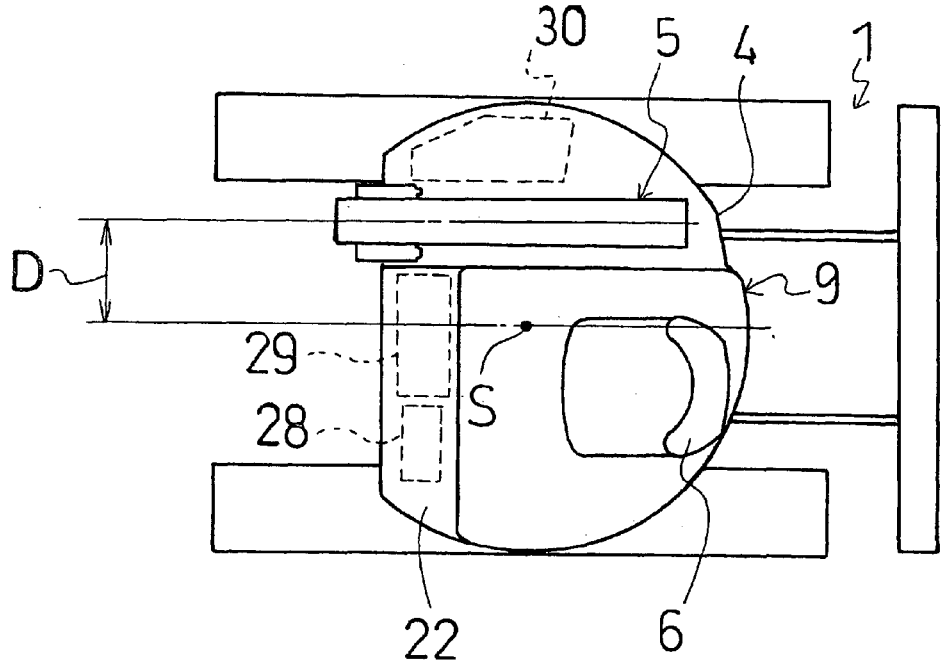
FIG. 11 is a plan view showing a position where the backhoe device is disposed and a position where the battery, fuel tank, etc. are disposed in the first type.

Moreover, as shown in FIG. 10 and FIG. 11, etc., the operator's seat 6 in the operator's cab 9 is disposed in the rear part from a swing center S of the swing table 4, in the longitudinal direction. In keeping with this arrangement, the operator's cab 9 is constructed in a way to be disposed toward the rear part of the swing table 4 as a whole, by disposing the cabin or canopy covering the operator's seat 6 in the rear part of the swing table 4. Therefore, as mentioned before, even if the front end face of the operator's cab 9 is disposed in the rear part, to avoid interference between the bucket 14 and the operator's cab 9 without particularly regulating the motions of the bucket 14, over the entire working range of the bucket 14, it is possible to secure a sufficient length in the longitudinal direction and thus keep a large inner space, because the operator's cab 9 is disposed rearward as a whole.

By disposing the operator's seat 6 in the rear part of the swing table 4, it becomes possible to reduce the actual rear weight, because the weight of the operator's seat 6 and of the worker executing the work in the operator's seat 6 play part of the role of the rear weight to be provided in the rear part of the swing table 4.

As described above, with a setting of extension-and-contraction area of the respective cylinders 17, 18, 19, structure and turning area of working arms such as boom sections 10, 11, 12 and arm 13, etc., the bucket 14 does not come close to the operator's cab 9 beyond the border indicated with the locus 76 (76*a*, 76*b*, 76*c*), in side view, as shown in FIG. 1, FIG. 10 and FIG. 22, at the time without offset and also at a time of offset. Namely, the backhoe device 5 and the operator's cab 9 according to the present invention can avoid mutual interference between the bucket 14 and the operator's cab 9, even if the bucket 14 is made to come closest to the operator's cab 9 with winding up of the arm 13, regardless if the backhoe device 5 is put in the state stored for extremely-small swing or not, and regardless if it is in the state offset to left or right or not, in short in whatever way the backhoe device 5 may be operated. Therefore, there is no need of separately providing any safety device or control system for the purpose of controlling the movement of the bucket 14, thus enabling to reduce the cost and the weight of the backhoe device 5.

Explanation will further be given on the construction of the backhoe device 5.

As shown in FIG. 5, when the first boom section 10 is turned to the turning limit at front bottom to perform deepest excavation with the backhoe device 5, the axis of the lower rotating shaft 15 and the axis of the upper rotating shaft 16 become about vertical. Namely, as illustrated, the angle θ formed by the respective axes and the horizontal line is close to a right angle.

As a result, even if the bucket 14 is offset to left or right, by turning the second boom section 11 to left and right in this state of deepest excavation, the amount of rise Y of the bucket 14 is not so large although the bucket 14 slightly goes up, and a point of deepest excavation of a depth about equal to that of the point of deepest excavation in the state without offset can be obtained, even in the case where excavation of a street drain is made with an offset of the bucket 14.

In addition, since the second boom section 11 and the third boom section 12 are connected about in an L-like shape in side view, the third boom section 12 remains vertical in the excavated ditch, while the second boom section 11 is held about in horizontal state on the ground, with no fear of contact with the inlet portion 74 of the ditch, in the state of deepest excavation, i.e. when the bucket 14 is positioned at the lowest level of all its working positions, not only at the time without offset but also in the case where an excavation work of street drain is executed by offsetting the bucket 14 to left and right.

Still more, the offset cylinder 20 and the connecting rod 21 are supported with a shaft respectively at an end on the side part of the turning tip portion of the first boom section 10 and, as for the respective other ends, the offset cylinder 20 is supported with a shaft on the side part near the rear end of the second boom section 11 and the connecting rod 21 is supported with a shaft on the side part near the rear end of the third boom section 12 respectively, when the first boom section 10 is raised. Namely, both the offset cylinder 20 and the connecting rod 21 are disposed in a way not to protrude in the forward direction from the second boom section 11, especially at its upper half part (portion closer to the third boom section 12), in side view, in the state where the first boom section 10 is raised. Therefore, when the first boom section 10 is inclined in the forward direction, for performing excavation work, neither the offset cylinder 20 nor the connecting rod 21 protrude downward from the front half portion of the second boom section 11 and, even if the second boom section 11 is put closest to the ground surface, in a state of deepest excavation, the offset cylinder 20 and the connecting rod 21 do not get in contact with the ground surface.

In the case where the backhoe device 5 constructed as above is put in a state of deepest excavation by inclining the first boom section 10 in the forward direction, as shown in FIG. 5 and FIG. 6 or FIG. 26 and FIG. 27, the third boom section 12 is extended about vertically downward from the tip of the second boom section 11 (tip of the base portion 11*a* to be described later on the first type), and from the bottom end of such third boom section 12 is extended the arm 13 about vertically downward, and at the bottom end of the arm 13 is positioned the bucket 14.

In this case, the connecting portion between the second boom section 11 (tip of the base portion 11*a* on the first type)

and the third boom section 12 (support 11*b* attached to the third boom section 12, at the same time, on the first type) is positioned near the ground surface, and the maximum depth of excavation by the backhoe device 5 becomes about equal to the sum of a length L1 of the third boom section 12, a length L2 of the arm 13 and a length L3 of the bucket 14 (L1+L2+L3).

Figure 47:
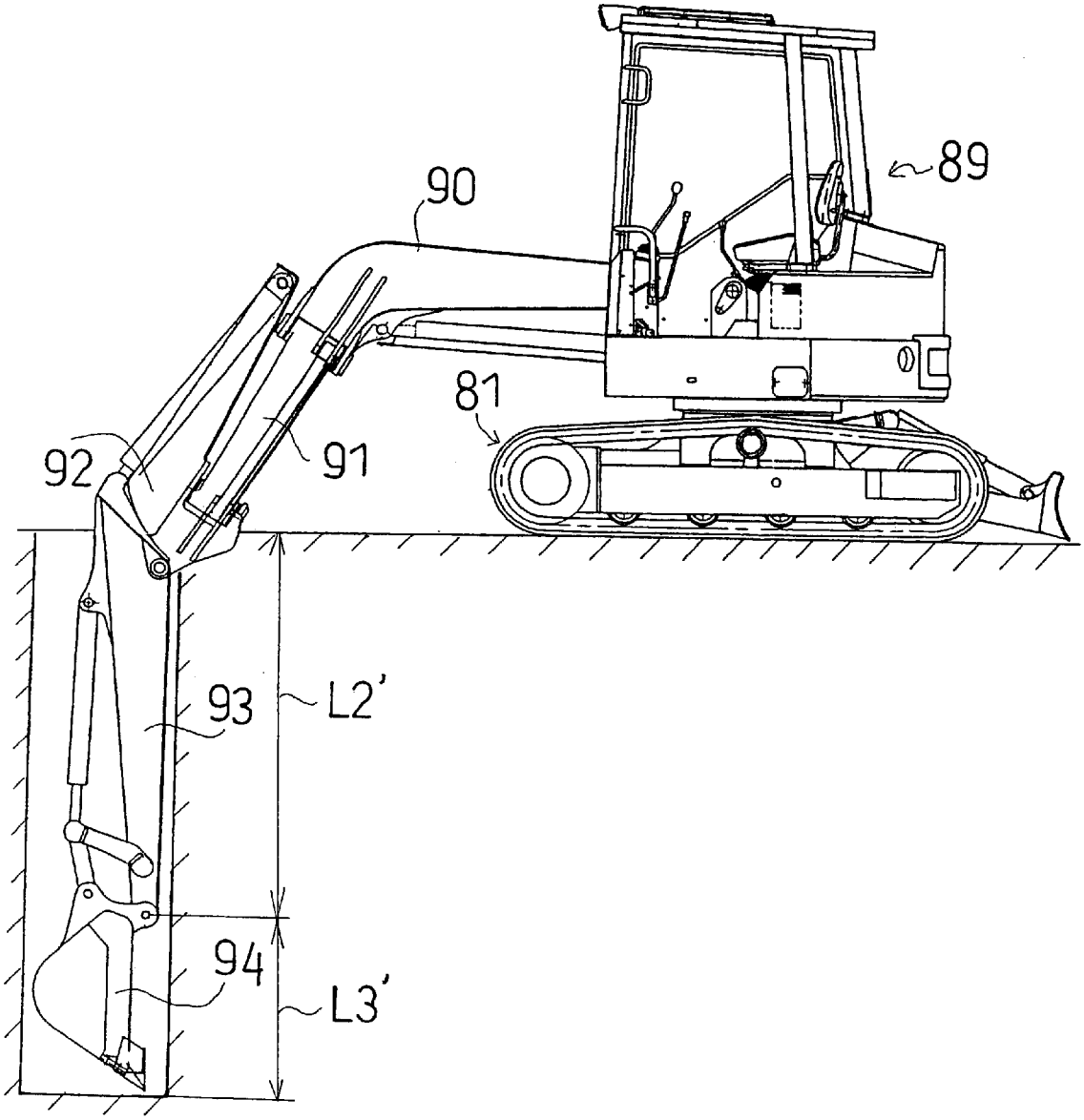
FIG. 47 is a front elevation of above.
Figure 48:
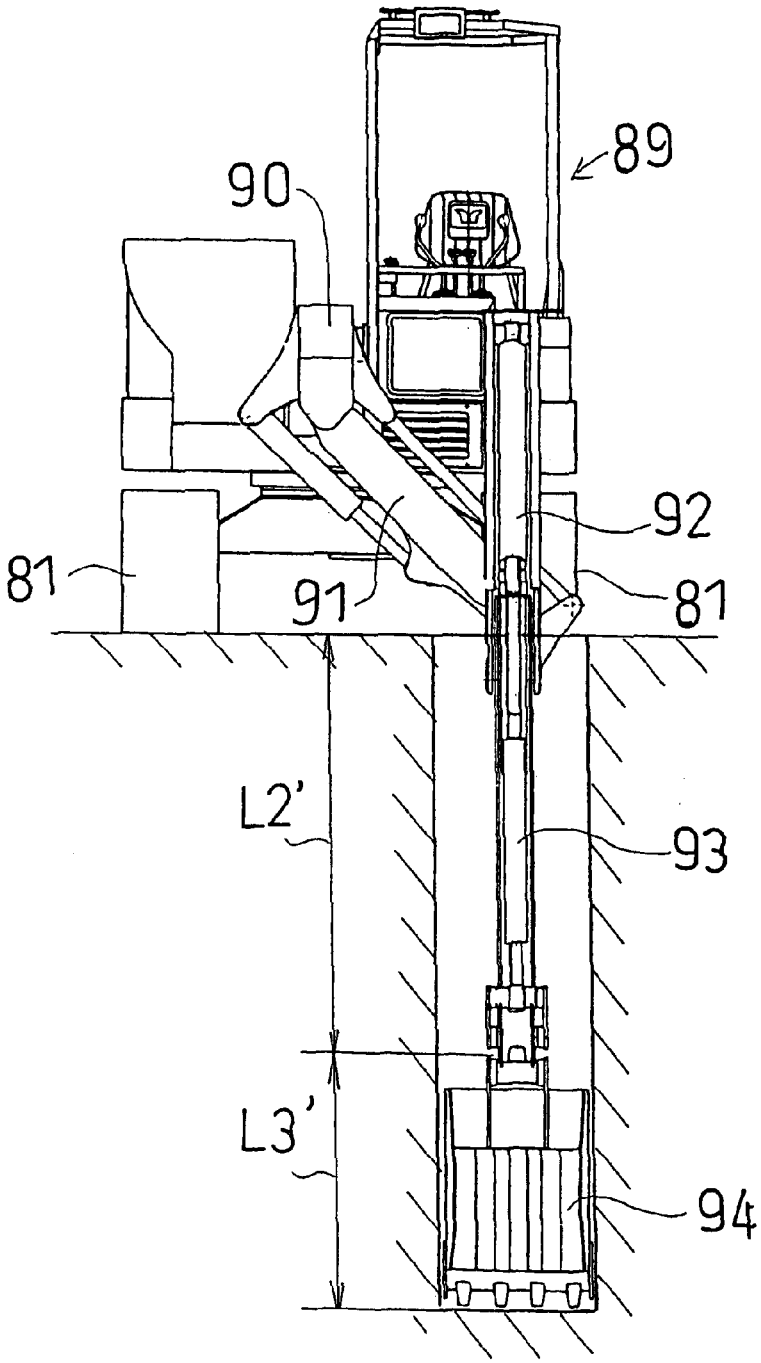
FIG. 48 is a sketch in front elevation of above.
Figure 49:
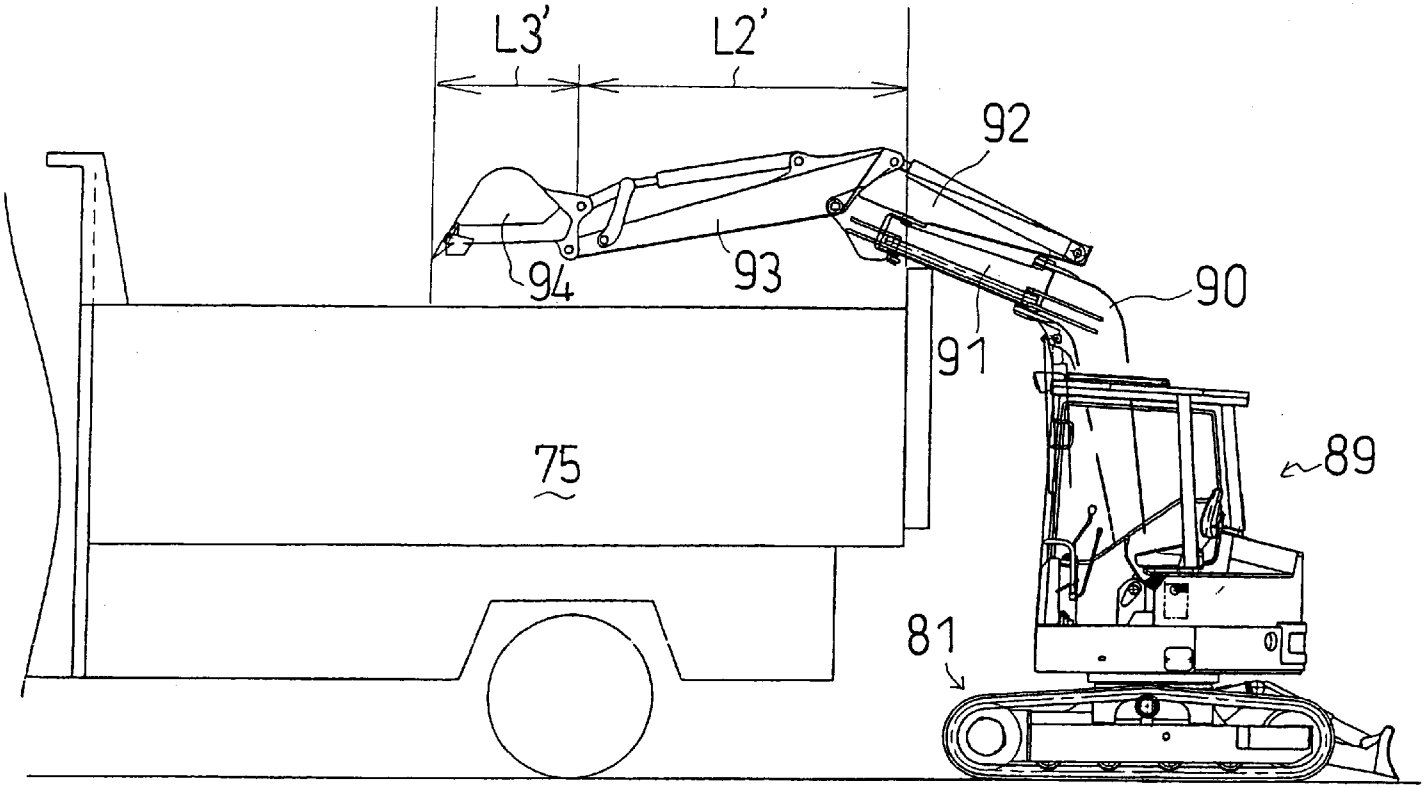
FIG. 49 is a side view showing a loading work of excavated material on a dump truck by the conventional backhoe device.

As explained based on FIG. 47 and FIG. 48, in the backhoe device 85 of the conventional extremely-small-swing working machine, the length of the third boom section 92, i.e. the distance from its connecting portion with the second boom 91 to its connecting portion with the arm 93 is very short and, when this (backhoe device 85) is put in a state of deepest excavation, the arm 94 is extended about vertically downward almost immediately from the neighborhood of the connecting portion between the second boom 91 and the third boom section 92, and the depth of excavation is about equal to the total length of a length L2' of the arm 93 and a length L3' of the bucket 94 (L2'+L3'). As compared with such conventional extremely-small-swing working machine, in the present invention, there is the third boom section 12 extending about vertically downward into the excavated ditch, enabling to increase the depth of excavation by an amount equal to its length L1.

Moreover, to increase the depth of excavation, the length L1 of the third boom section 12 and the length L2 of the arm 13 are important, and the longer the lengths L1, L2 are formed the more the depth of excavation can be increased.

Both the third boom section 12 and the arm 13 are smaller in breadth compared with the bucket 14, thus preventing the third boom section 12 and the arm 13 from hitting the side face, etc. of the excavated ditch during an excavation not to destroy the excavated ditch and also protecting the third boom section 12 and the arm 13 against damage.

Figure 28:
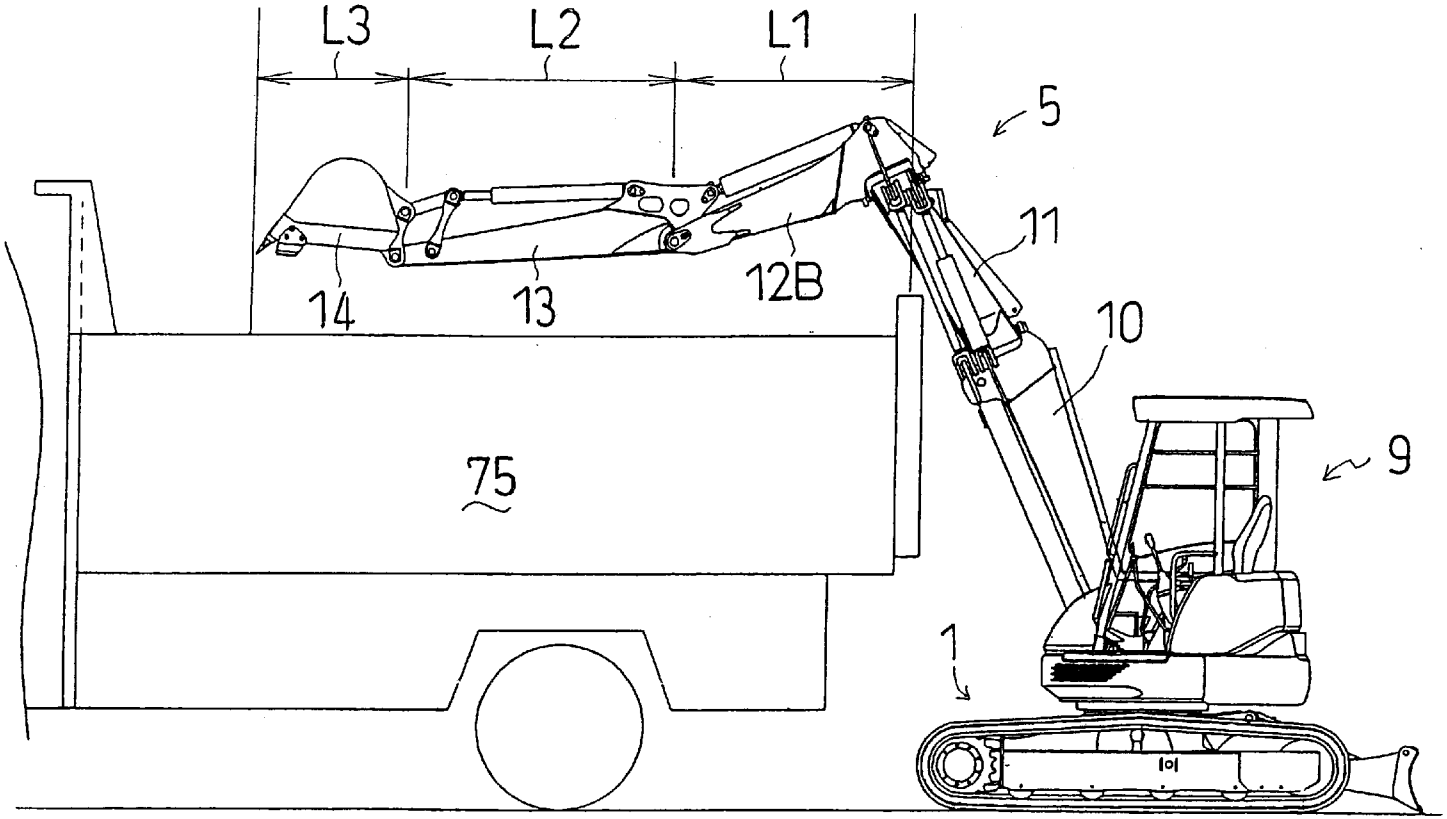
FIG. 28 is a side view showing a loading work of excavated material on a dump truck by a backhoe device of the third type.

As described above, by constructing the third boom section 12 with a large length, it becomes possible to load the excavated materials such as earth and sand, etc. excavated with the bucket 14 to the depth of a load-carrying platform of a dump truck when loading them on the dump truck, etc. Namely, the backhoe device 5 according to the present invention takes a posture as shown in FIG. 28, when it loads excavated earth and sand, etc. on a load-carrying platform 75 of a dump truck from the rear part of the truck, and the tip of the bucket 14 can reach the depth side (front side) of the load-carrying platform 75, by an amount about equal to the sum of the length L1 of the third boom section 11, the length L2 of the arm 13 and the length L3 of the bucket 14, from the rear end of the load-carrying platform 75 of a dump truck, etc., making it possible to load the excavated materials in this position and thus improve the working efficiency.

Figure 29:
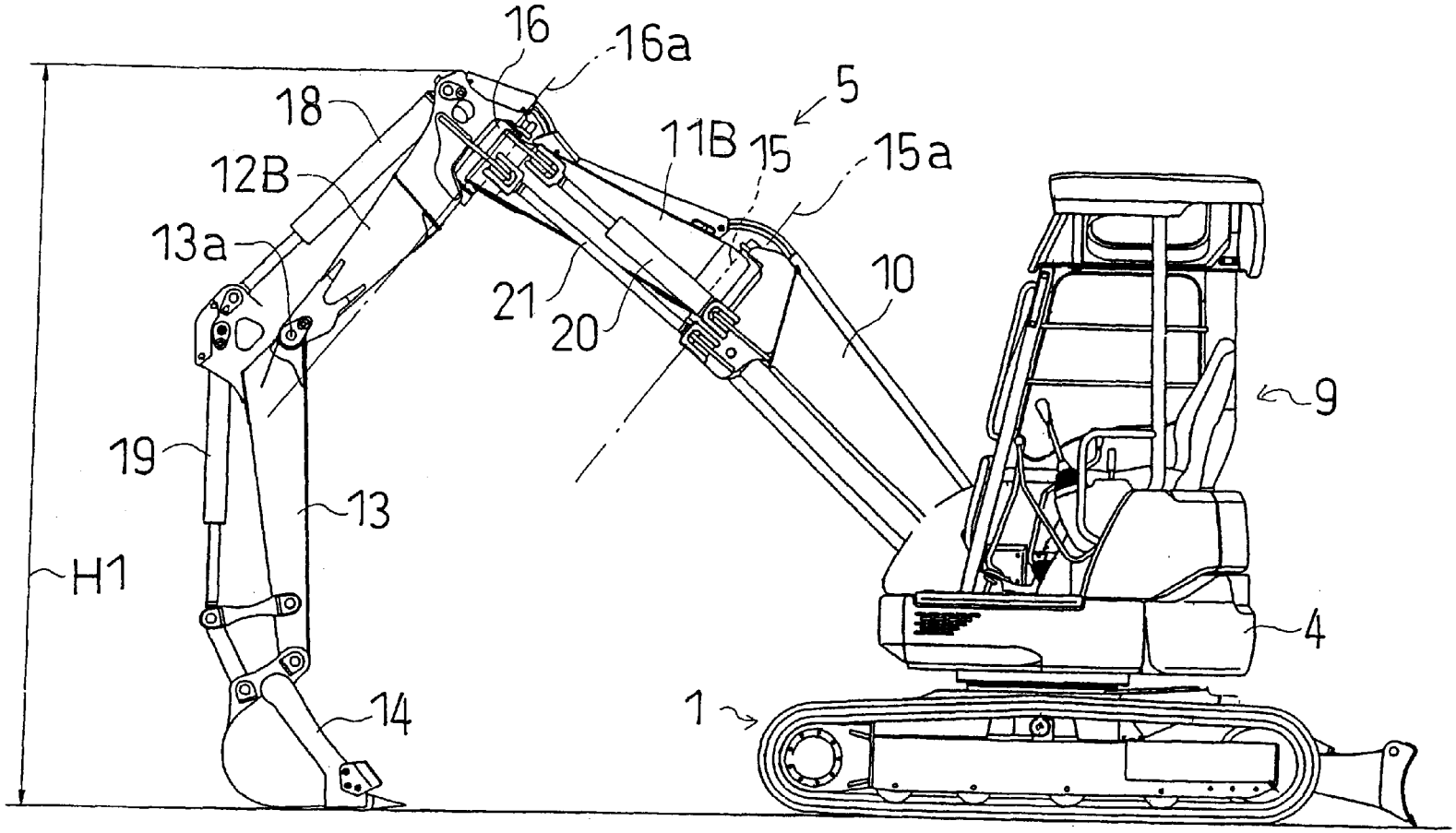
FIG. 29 is a side view showing a ground surface treating work by the backhoe device of the third type.

Yet more, as shown in FIG. 1, FIG. 13 and FIG. 22, etc., the turning fulcrum of the arm 13 at the tip of the third boom section 12, i.e. the arm supporting point 13*a*, is disposed higher than the axial extension line 16*a* of the upper rotating shaft 16. In the case where a ground surface treatment such as "levelling", etc. is made with the backhoe device 5, the first boom section 10 is inclined upward in the forward direction, and the arm 13 is extended about vertically downward, as shown in FIG. 29. In this state, the upper end at the tip of the third boom section 12 comes to be positioned at the top end of the backhoe device 5.

Figure 30:
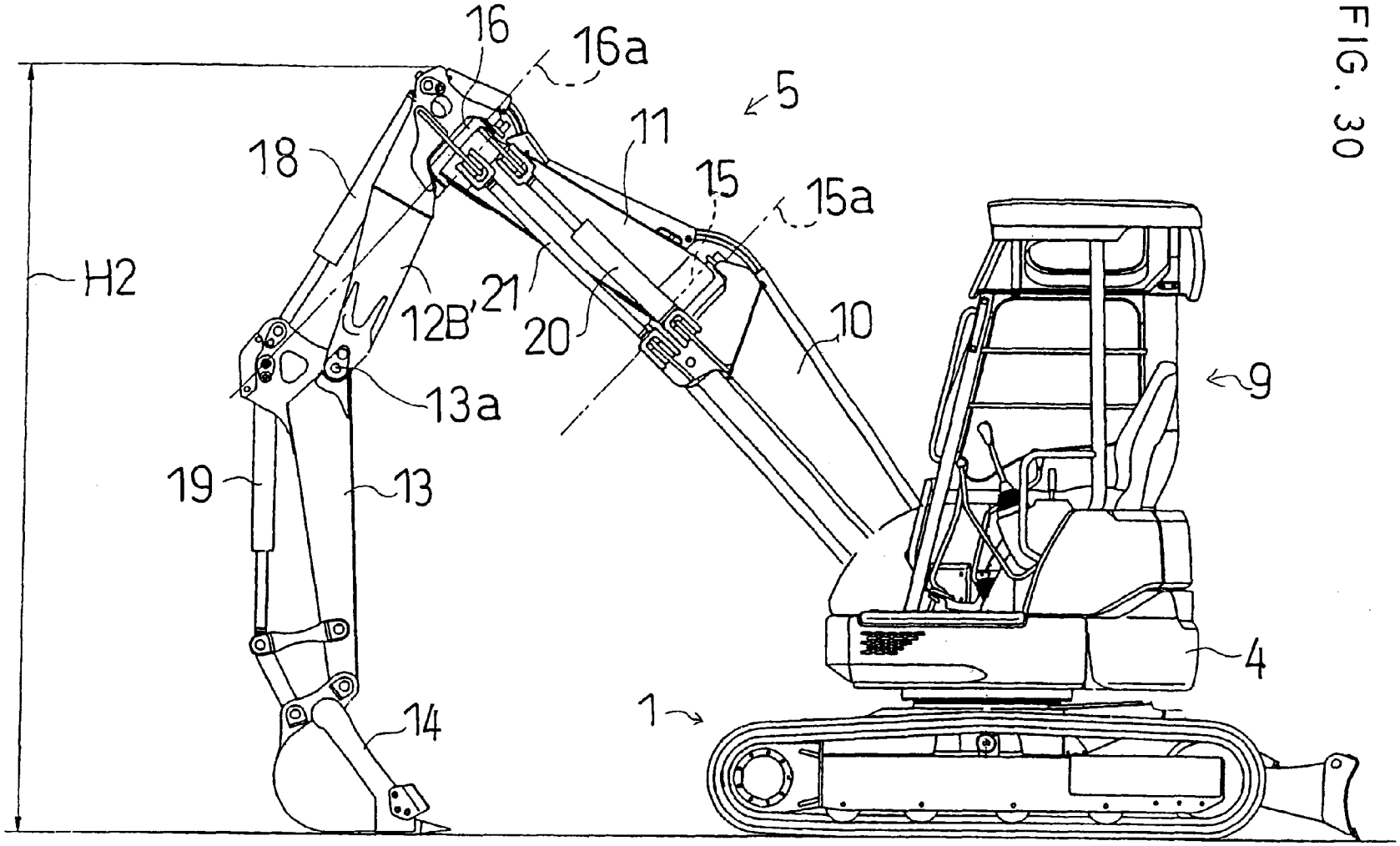
FIG. 30 is a side view of the extremely-small-swing working machine in the case of supposition that the arm supporting point is positioned lower than the axial extension line of the upper rotating shaft.

And, in the case where the arm supporting point 13*a* is found lower than the axial extension line 16*a* of the upper rotating shaft 16, the angle formed by the third boom section 12 and the arm 13 gets narrower and, instead, the inclination against ground of the third boom section 12 becomes larger by that amount and the height H2 against ground at its upper end position increases, as shown in FIG. 30. In FIG. 30, a second boom section 12B to be described later is bent toward the swing table 4, as second boom section 12B', to thereby dispose the arm supporting point 13*a* below the axial extension line 16*a*.

In the present invention, by keeping the arm supporting point 13*a* higher than the axial extension line 16*a*, the angle formed by the third boom section 12 (third boom section 12B) and the arm 13 becomes moderate, as shown in FIG. 29, and, therefore, the inclination against ground of the third boom section 12 becomes moderate, and the height H1 against ground at the upper end of the third boom section 12 forming the top end of the entire backhoe device 5 is smaller than said height H2 against ground.

As explained above, by constructing the backhoe device 5 in a way to keep the height of its upper end at a low level during a ground surface treatment, it becomes possible to prevent the backhoe device 5 from hitting an obstacle, etc. positioned above the backhoe device 5 during a work and being damaged, and execute a ground surface treatment even in a place with only a low working space.

Although FIG. 28 and FIG. 29 show embodiments regarding the second type and the third type to be described later, the third boom section 12 (12A) is constructed with a large length also with the first type, with an extension of the upper rotating shaft 16 and the support 11*b* as in FIG. 1, etc., as mentioned before, and the arm supporting point 13*a* is found above the axial extension line 16*a* of the upper rotating shaft 16. These embodiments can therefore be substituted for the first type.

Next, as for the operator's cab 9, it is constructed to be disposed toward the rear part of the swing table 4 as mentioned before and, in addition, the backhoe device 5 is disposed on the side opposite to the operator's cab 9 of the swing table 4, in the transversal direction, thus securing a large dimension D between the swing center S and the backhoe device 5, as shown in FIG. 11, etc.

This makes it possible to secure a larger space on the operator's cab 9 side than for the backhoe device 5 of the swing table 4, and therefore construct the operator's cab 9 with a larger internal space, and improve the working efficiency by disposing the operator's seat 6 toward the central part in the transversal direction.

And, by thus disposing the operator's cab 9 toward the rear part and constructing it with a large space in the transversal direction, an extra space is produced on the swing table 4 for installing at least a fuel tank 29 in front of the operator's cab 9. The fuel tank 29 is disposed in this position and covered by a front hood 22. It is also possible to dispose a battery 28 in the front hood 22. Moreover, while, in the embodiment of the first type, a reservoir tank 30 is disposed, on the side opposite to the operator's cab 9 in the transversal direction, in the swing table 4, as shown in FIG. 2 and FIG. 11, this is also applicable to the second type and the third type.

Figure 12:
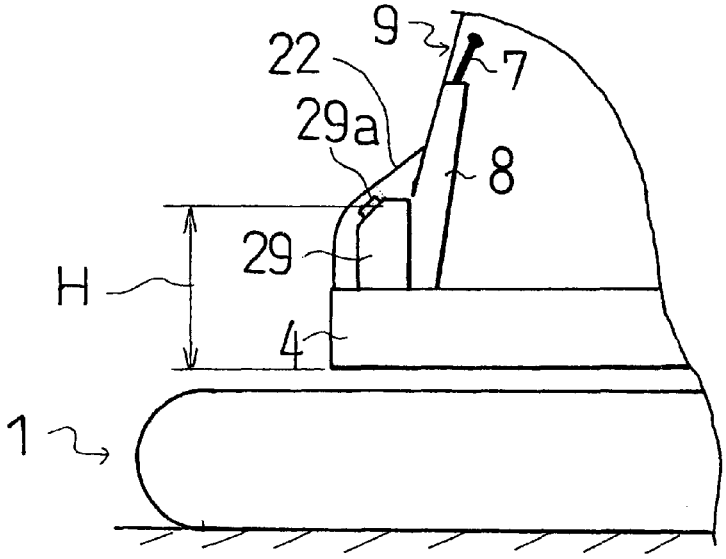
FIG. 12 is a side view showing the height of disposition of the oil feed port of the fuel tank in the first type.

The fuel tank 29 and the front hood 22 covering it and other things are placed at a low position just in front of the operator's cab 9, and in the case of a construction provided with a front column 8, as shown in FIGS. 10 and 12, they are hidden behind the front column 8, as seen from the worker operating by sitting on the operator's seat 6. Even in the case without front column 8 as in FIG. 13, the front hood 22 is sloped upward in the backward direction, and its rear face constitutes a front panel (dashboard), and only the front panel on the rear face is visible to the worker sitting on the operator's seat 6. In any case, the front hood 22 covering the fuel tank 29 gets in the worker's dead angle, and does not interfere with his view.

Such are the constructions common to the respective embodiments of the first type to the third type in the extremely-small-swing working machine according to the present invention. Next, characteristics unique to the respective types will be explained.

In the first place, the first type is characterized in the construction of the second boom section 11A and the third boom section 12A. Namely, this type extends the upper rotating shaft 16, which is the supporting point for turning of the third boom section 12A against the second boom section 11A, over about the entire length of the third boom section 12A, and realizes a light weight and a compact size for the third boom section 12A.

Figure 7:
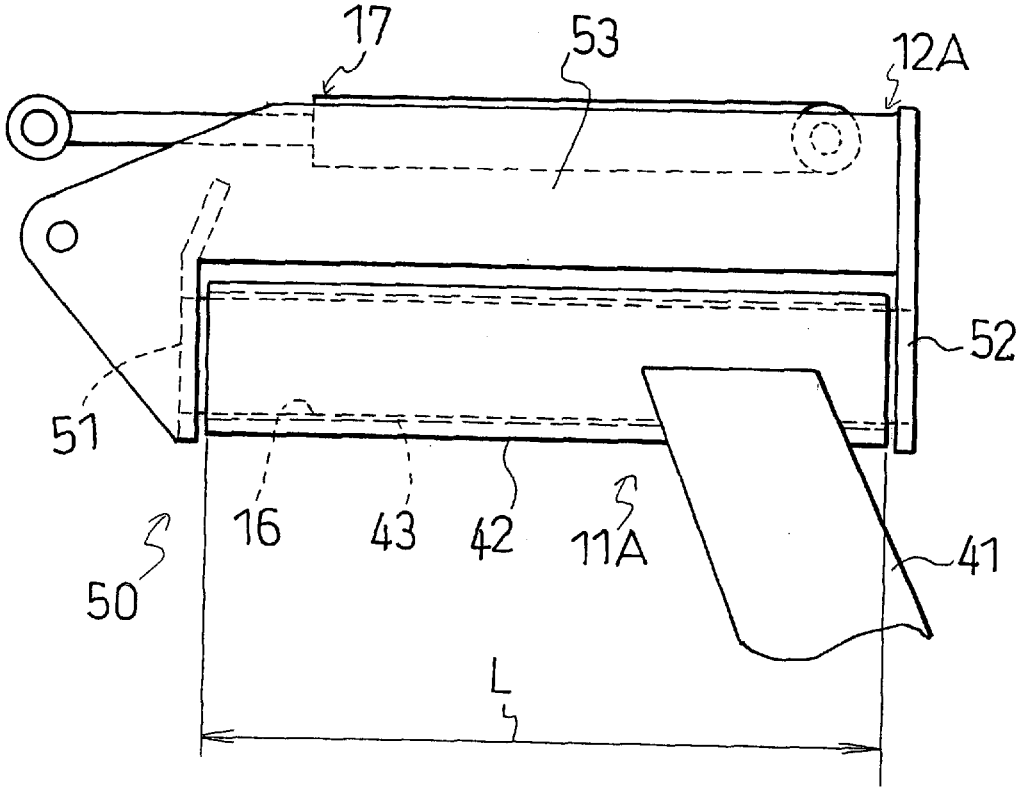
FIG. 7 is a side view of a hinge mechanism constituted by the second boom section and a third boom section through an upper rotating shaft in the first type.
Figure 8:
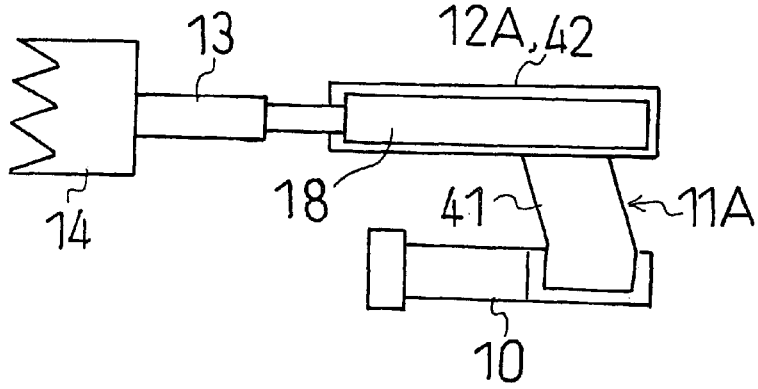
FIG. 8 is a sketch in plan view showing a state in which the bucket is offset by turning the second boom section in transversal direction in the backhoe device of the first type.

As shown in FIG. 7, etc., the second boom section 11A is formed in a substantially L-like shape by a base 41 rising about vertically from the top end part of the first boom section 10 and a support 42 provided in extension from the base 41 about horizontally in the forward direction, in the state where the first boom section 10 is raised to the fullest extent (turning limit position at rear top). At the time when the first boom section 10 is put to the turning limit position at rear top, the top end of the Offset cylinder 20 is connected to the bracket 41*a* formed on the side face of the base 41 of the second boom section 11A.

On the other hand, the third boom section 12A is formed, as shown in FIG. 7, in a substantially U-like shape composed of a body 53 and hinge connecting parts 51 and 52 and the third boom section 12A and the upper rotating shaft 16 are integrally constructed by connecting both ends of the upper rotating shaft 16 to the hinge connecting parts 51 and 52 at both ends of the third boom section 12A.

The connecting rod 21 which constitutes a link parallel to the second boom section 11 at the time of an offset is provided, in the state where the first boom section 10 is raised, between the bracket 10*b* formed near the lower rotating shaft 15 on the side face of the first boom section 10 and the bracket 52*a* formed at the rear end of the third boom section 12, i.e. at the rear end of the hinge connecting part 52 on the rear side.

Between the two hinge connecting parts 51 and 52, the support 42 of the second boom section 11A is freely interposed over about the entire length of the upper rotating shaft 16. Namely, the support 42 of the second boom section 11A is formed in a cylindrical shape and serves as a radial bearing supporting the upper rotating shaft 16 over about the entire length. In the support 42, the upper rotating shaft 16 is inserted rotatably, i.e. in such a way that the outer circumferential face of the upper rotating shaft 16 gets in contact slidably with the inner circumferential face 43 of the support 42.

The arm cylinder 18 interposed between the third boom section 12A and the arm 13 is covered on both sides and in lower part by the body 53 of the third boom section 12 for protection against damage by direct contact with any object, as shown in FIG. 7, etc.

As described above, the third boom section 12A, though lightweight and compact in construction, discharges the function of a protective member for the arm cylinder 18 and that of said supporting member for upper rotating shaft 16 at the same time, by its entire body.

A length L of the support 42 of the second boom section 11A is set for the largest possible length, within the range in which said state stored for extremely-small swing can be secured (namely, in the range in which the entire backhoe device 5 can be housed in the circle R with maximum swing diameter of the swing table 4, in the state where the arm 13 and the bucket 14 are wound up to the maximum at the highest raised position of the first boom section 10).

By thus increasing the length of the support 42, it becomes possible to keep low the face pressure of the upper rotating shaft 16 against the inner circumferential face 43 of the support 42, and control any irregularity of motion produced when the upper rotating shaft 16 turns in the support 42 at a low level. Therefore, the hinge mechanism 50 constituted by the third boom section 12A and the second boom section 11A integrated with the upper rotating shaft 16 is constructed in a way to produce little irregularity of motions during an operation.

Moreover, the arm cylinder 18 is not only protected by the third boom section 12 but also substantially supported, in greater part in the axial direction of the arm cylinder 18, by the support 42 provided to support about the entire length of the third boom section 12A, because the arm cylinder 18 is disposed about in parallel to the upper rotating shaft 16, i.e. in parallel to the support 42 of the second boom section 11A. Since this support 42 plays the role of a radial bearing of the upper rotating shaft 16, the relative positional relation between the support 42 and the third boom 12A does not change even if the second boom section 11A is turned to left and right for offsetting the bucket 14 to left and right. Consequently, to the arm cylinder 18 are attached not only the third boom section 12A but also the support 42 of the second boom section 11A, to maintain a solid supporting and protective structure, and this greatly reduces the risk of damage to the third boom section 12A and the arm cylinder 18, even in case the third boom section 12A gets in contact with some obstacle.

Figure 6:
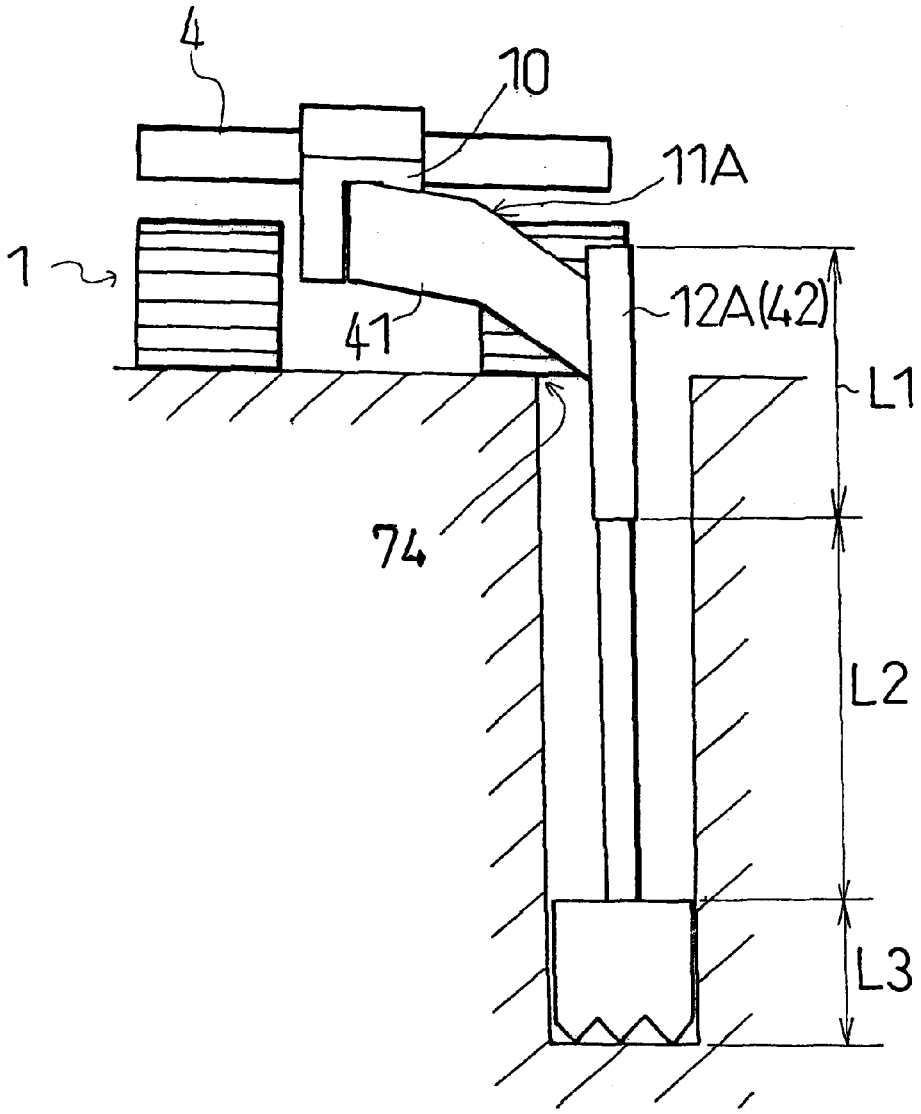
FIG. 6 is a sketch in front elevation showing a positional relation between a second boom section and an inlet of ditch during an excavation of a street drain.

And, although it was stated, in the explanation of said construction common to the first to third types, that the second boom section 11 and the third boom section 12 are connected about in an L-like shape, part of the second boom section 11A, i.e. the support 42 is incorporated in the third boom section 12A over about the entire length of the third boom section 12A, in the first type. For that reason, the second boom section 11A is bent about in an L-like shape between its base 41 and support 42, as described before. As a result, in the case where the bucket 14 is offset to left and right for performing excavation of a street drain, the base 41 is held about in horizontal position even if the support 42 is vertically inserted into the ditch, as shown in FIG. 6, to make the bucket 14 penetrate deep under the ground by turning the first boom section 10 downward in the forward direction. Therefore, it is possible to excavate to a large depth, with no need of worrying about the second boom section 11A getting in contact with the inlet portion 74 of the ditch.

Furthermore, in the explanation of said construction common to the first to third types, it was stated that, in the present invention, there is the third boom section 12 extending about vertically downward into the excavated ditch, in the state of deepest excavation and that the depth of excavation can be increased by an amount equal to its length. In the backhoe device 5 of the first type, the connecting portion with the second boom section 11A (namely, upper rotating shaft 16) is constructed in parallel (to the second boom section 11A) over about the entire length of the third boom section 12A. However, since the second boom section 11A is composed of the base 41 and the support 42 connected about in an L-like shape and that the support 42 about forms a single body with the third boom section 12A, it is possible to position the support 42 and the third boom section 12A as a single body in the excavated ditch in a way to extend downward, in the state in which the base 41 is disposed on the ground, when (the backhoe device 5) is placed in a state of deepest excavation.

And, even during a deepest excavation, the offset cylinder 20 provided between the bracket 10*a* of the first boom 10 and the bracket 41*a* of the base 41 of the second boom section 11A, and the connecting rod 21 provided between the bracket 10*b* of the first boom section 10 and the bracket 52*a* at the rear end of the third boom section 12A do not protrude downward beyond the second boom section 11A disposed very close to the ground surface, and this makes it possible to prevent the offset cylinder 20 and the connecting rod 21 from getting in contact with the ground surface and thus protect them against damage, even if the second boom section 11A touches the ground surface.

Figure 9:
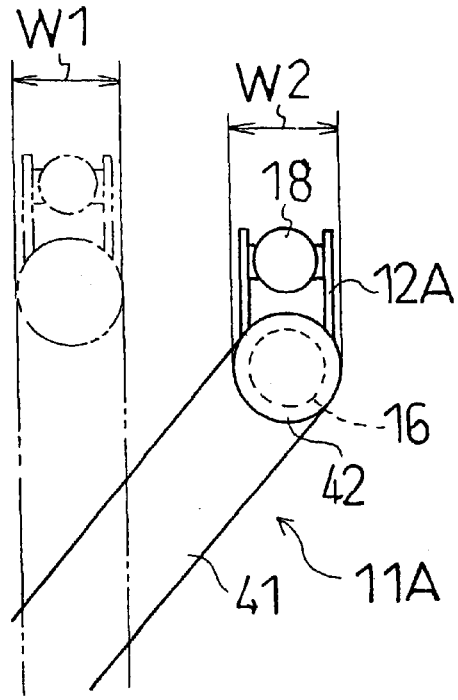
FIG. 9 is a sketch in rear view of above.

Still more, since the support 42 of the second boom section 11A is in a cylindrical shape, even if the second boom section 11A is turned to left and right while keeping the width W1 of the support 42 of a case where the second boom section 11A is not turned to left and right, as shown in FIG. 9, there is no fear that the width W2 of the support 42 become larger or smaller than said W1. Namely, the widths W1, W2 are identical.

Suppose that the support 42 is square in front elevation, for example. The base, which is horizontal when no offsetting is made, inclines if the second boom section 11A is turned to left and right to offset the bucket 14 to left and right, and the width expands by an amount corresponding to it. As a result, when excavation is made with the offset bucket 14, the width of the ditch becomes larger by an amount equal to the expanded width of the support 42 inserted in the ditch. By forming the support 42 in a cylindrical shape as mentioned before, it becomes possible to prevent any increase in the width of ditch due to interference between the support 42 and the ditch, and thus execute a deep street drain with a small width.

Next, explanation will be given on the construction of the front hood 22. Since a large space became available longitudinally and transversally in front of the operator's cab 9 on the swing table 4, by disposing the operator's cab 9 toward the rear part and adopting a construction with a large breadth as mentioned before, the battery 28 and the fuel tank 29 are disposed on the left and the right in this space, and covered by the hood 22, as shown in FIG. 2, etc. In this way, in addition to said fuel tank 29, the battery 28 is provided in a line transversally with the fuel tank 29, and the installation of this battery 28 does not cause any increase in the height of the front hood 22 covering them. Therefore, as explained in the description of said constructions common to all types, the front hood 22 is hidden behind the from column 8 to the eyes of the worker working in the operator's seat 6, as shown in FIG. 5, and gets in the worker's dead angle, without interfering with his view.

As described above, the battery 28 and the fuel tank 29 which require frequent maintenance and lubrication work are disposed together, in proper height, at a point in front of the operator's seat 6, and this facilitates the maintenance work and makes their connection and disconnection less troublesome. Yet more, since the fuel tank 29 is disposed sufficiently low to be positioned in the worker's dead angle, its feed port 29*a* is also at a low position accordingly. Namely, the height H from the bottom end of the swing table 4 to the oil feed part 29*a* is small, as shown in FIG. 12, thus facilitating the lubrication work.

Next, explanation will be made on the constructions of extremely-small-swing working machine, common to the second type indicated in FIG. 13 to FIG. 21 and the third type indicated in FIG. 22 to FIG. 37.

Firstly, the operator's cab 9 is constructed by being covered with a canopy 31, as mentioned before.

As for the backhoe system 5, the construction of the second boom section 11 and the third boom section 12 is different from that in the first type. Namely, the second boom section 11B is linear as a whole, unlike the L-like shaped second boom section 11A composed of the base 41 and the support 42 of the first type, and the third boom section 12B is in a shape similar to that of the arm 13, and, in the state in which the first boom section 10 is raised, the tip of the second boom section 11B (side opposite to first boom section 10) is connected on a shaft, through the upper rotating shaft 16, to the rear bottom end of the third boom section 12B.

Figure 44:
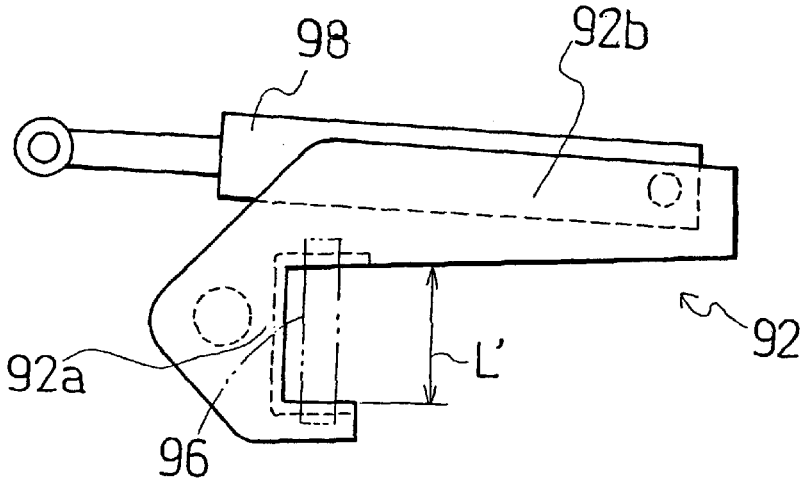
FIG. 44 is a side view of a third boom section in a conventional backhoe device.
Figure 45:
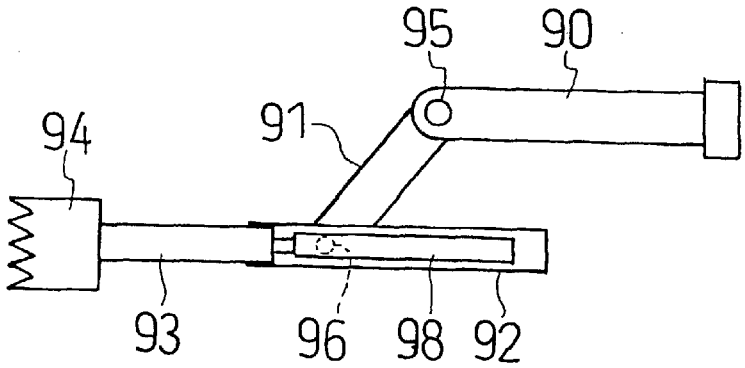
FIG. 45 is a sketch in plan view of a state in which the bucket is offset by turning the second boom section of the conventional backhoe device to left and right.
Figure 46:
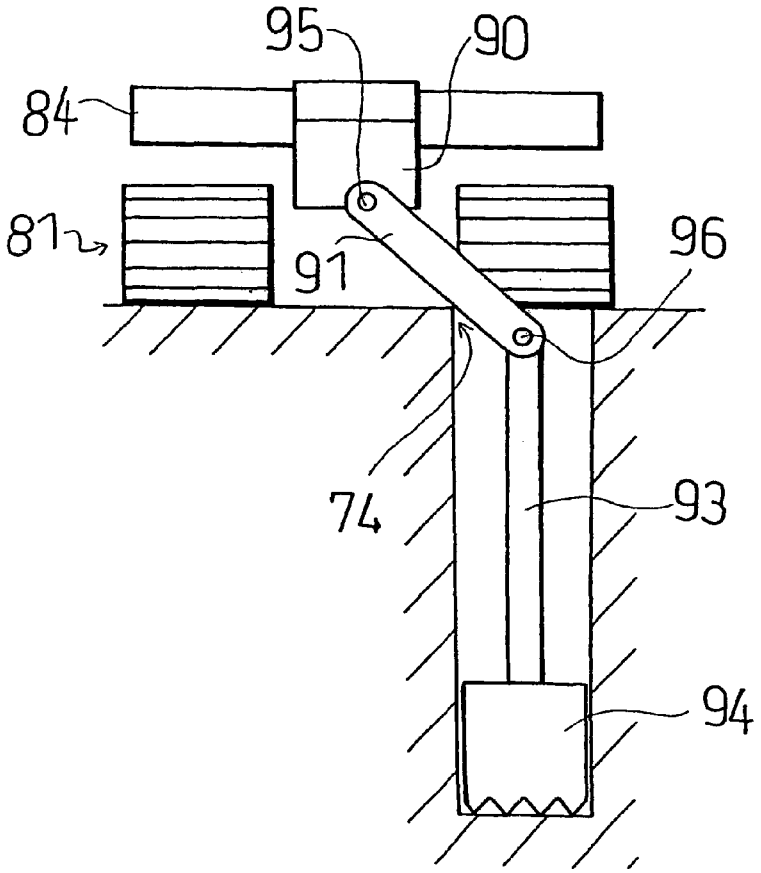
FIG. 46 is a side view showing a deepest excavation work by the conventional backhoe device.

Therefore, compared with the conventional third boom section 92 as seen in FIG. 44, etc., this third boom section 12B is formed with a larger length from the connecting portion with the second boom section 11B (portion where the upper rotating shaft 16 is disposed) to the connecting portion with the arm 13, and can secure a large depth of excavation, as stated in the description of said common construction, thus providing an effect of enabling, in a loading work of earth and sand on a truck, etc., to load earth and sand to the depth of the load-carrying platform from behind the truck.

The first boom section 10 and the second boom section 11B are constructed to take a posture, not completely vertical, but slightly inclined rearward, in the state where the first boom section 10 is raised to its highest position (turning limit position at rear top), as shown in FIG. 13 and FIG. 22, etc., so that the amount of projection in forward direction of the third boom section 12, the arm 13 and the bucket 14, which are connected further to the tip side portion than the second boom section 11, may be kept small.

Moreover, in the state where the first boom section 10 is raised to its highest position, the angle against verticality of the second boom section 11 is smaller than the angle against verticality of the first boom section 10. Namely, the first boom section 10 and the second boom section 11 constitute, through the upper rotating shaft 16, a boom bent in the shape of a "dogleg" in side view (inverted "dogleg" in right side view as shown in FIG. 13), and the second boom section 11 takes a posture closer to verticality than the first boom section 10.

Figure 25:
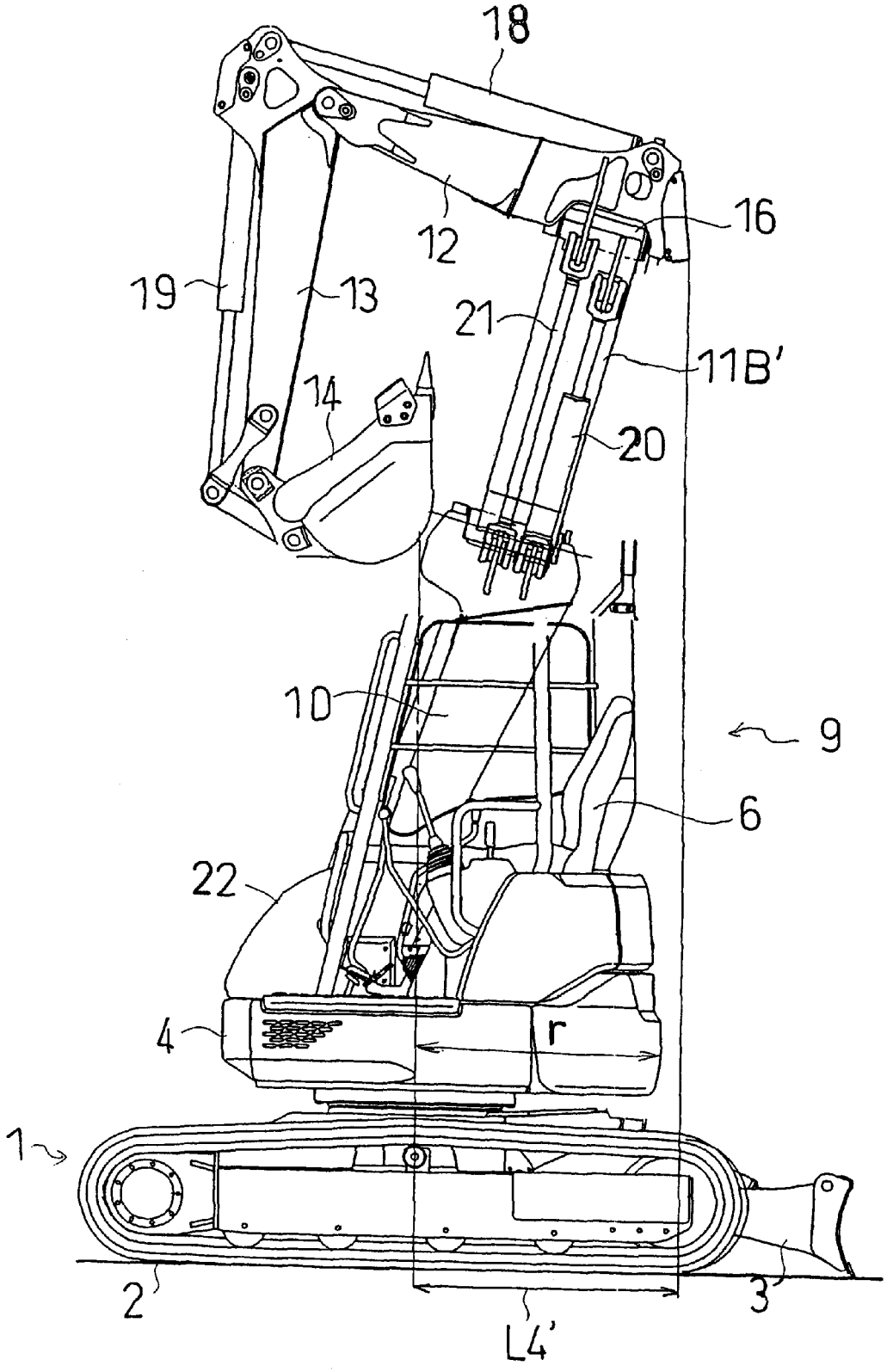
FIG. 25 is a side view of the extremely-small-swing working machine in the case of supposition that the second boom section is extended in the same direction as the first boom.

Supposing that the second boom section 11B is extended in about the same direction from the first boom section 10 in side view (second boom section 11B'), as shown in FIG. 25, the second boom section 11B' is inclined backward at the same angle as the angle of backward inclination of the first boom section 10, when the first boom section 10 is raised to the maximum, and the third boom section 12B moves backward, its rear end protruding in the backward direction from the rear end of the swing table 4, and cannot be stored in the circle R with maximum swing diameter of the swing table 4 in plan view. Namely, the horizontal distance L4' from the swing center S to the rear end of the third boom section 12B is longer than a radius r of the circle R with maximum swing diameter.

In the embodiment, the angle against verticality of the second boom section 11B is kept smaller than the angle against verticality of the first boom section 10, in the state where the first boom section 10 is raised to its highest position, as shown in FIG. 22, and this makes it possible to position the rear end of the third boom section 12B further in the forward direction than the rear end of the swing table 4 (the horizontal distance L4 from the swing center S to the rear end of the third boom section 12B is shorter than the radius r of the circle R with maximum swing diameter), and keep the third boom section 12B in the circle R with maximum swing diameter of the swing table 4 in plan view, namely produce a state stored for extremely-small swing.

This construction is applicable also in the first type. What corresponds to the second boom section 11 in the second and third types is the base 41 of the second boom section 11A in the first type. Namely, in the state where the first boom section 10 is raised to its highest position, both the first boom section 10 and the base 41 are inclined backward, to make the angle against verticality of the base 41 smaller than the angle against verticality of the first boom section 10.

Although the base 41 has an arm structure bent in the shape of a "dogleg" in side view, as shown in FIG. 1, etc., it will be all right if the base 41 is slightly inclined backward as a whole from the bottom end (connecting end to first boom section 10) to the top end (connecting end to support 42) and that its angle against verticality of is kept smaller than that of the first boom section 10.

Furthermore, in a state stored for extremely-small swing as shown in FIG. 13, FIG. 22, etc., the third boom section 12B is constructed with a large length, the arm 13 and the second boom section 11B are disposed about in parallel to each other, and the area surrounded by the second boom section 11B, the third boom section 12B, the arm 13, and the line connecting between the bottom end of the second boom section 11B and the bottom end of the arm 13, is formed about in rectangular shape.

Therefore, said area can be secured wide, especially at the top part of the area, and there is no fear of hitting any excavated material protruding from the bucket 14 with the second boom section 11B, the third boom section 12B, or the arm 13, even when the bucket 14 is wound up in the state having large excavated materials such as excavated asphalt, etc. in the bucket 14, thus protecting the second boom section 11B, the third boom section 12B, and the arm 13 against damage by contact with excavated material.

In the case of the first type, the longitudinal length of the third boom section 12A is taken rather long, in the state stored for extremely-small swing and, for that reason, the distance in longitudinal direction between the base 41 of the second boom section 11A and the arm 13 is taken long.

Furthermore, the base 41 may be either about vertical or slightly inclined upward in the forward direction, or may be about parallel to the arm 13. A sufficient open space is secured behind the bucket 14 and, also in this case, the construction is made in such a way that the excavated material held in the bucket 14 does not get in touch with the base 41 easily.

Figure 38:
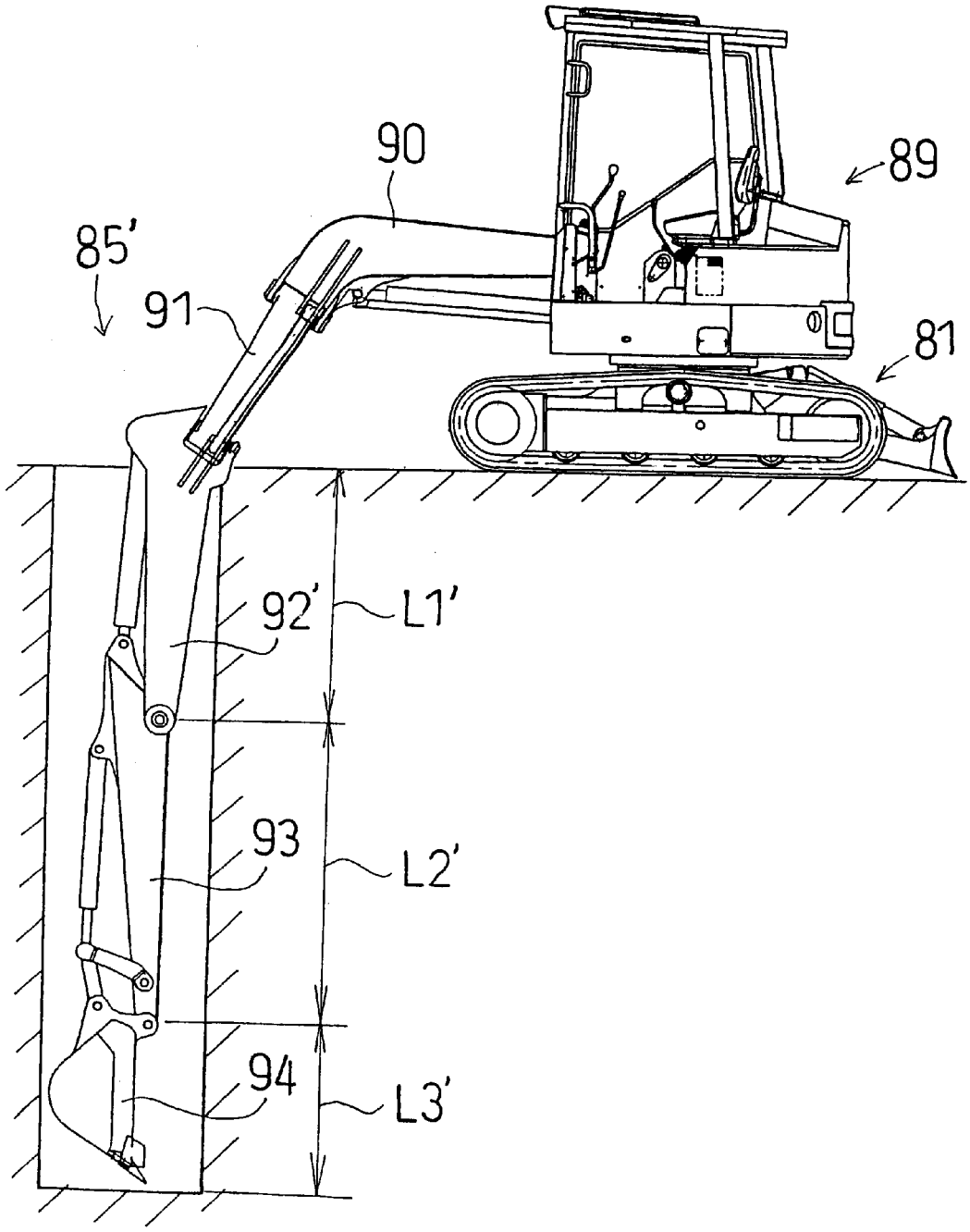
FIG. 38 is a side view showing a deepest excavation work by a conventional type extremely-small-swing working machine with an improved third boom section.
Figure 39:
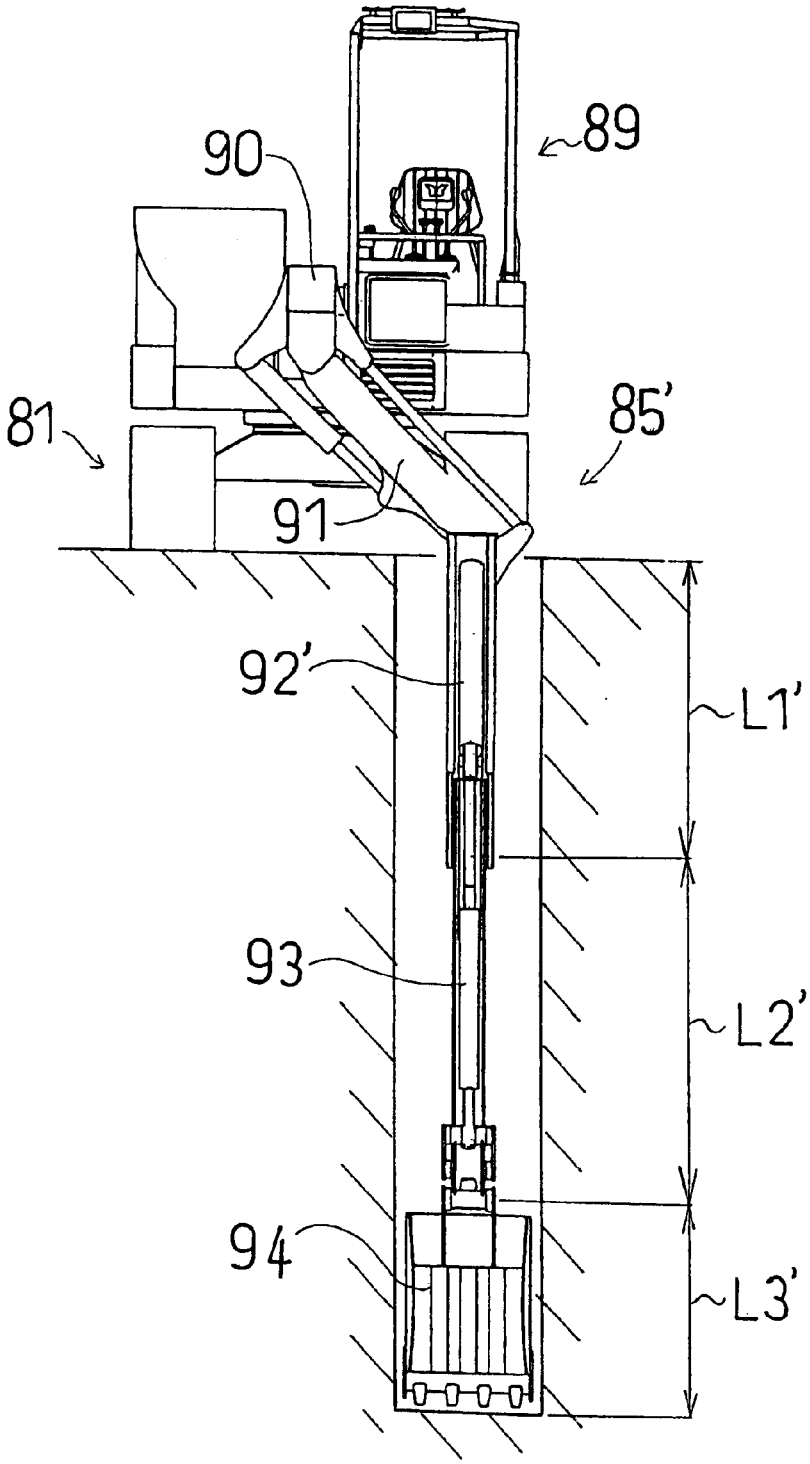
FIG. 39 is a front elevation of above.
Figure 40:
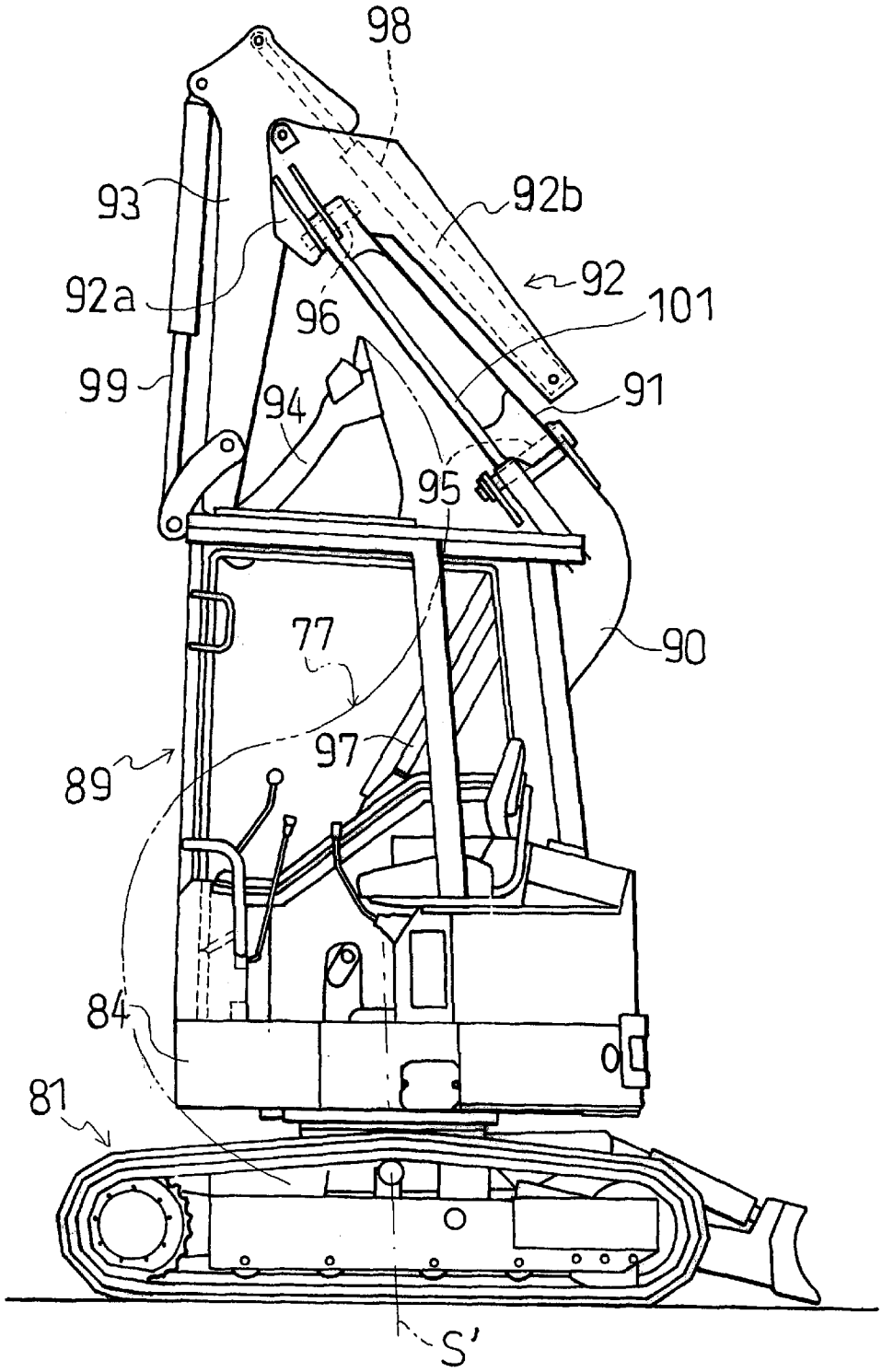
FIG. 40 is a side view of a conventional extremely-small-swing working machine.
Figure 41:
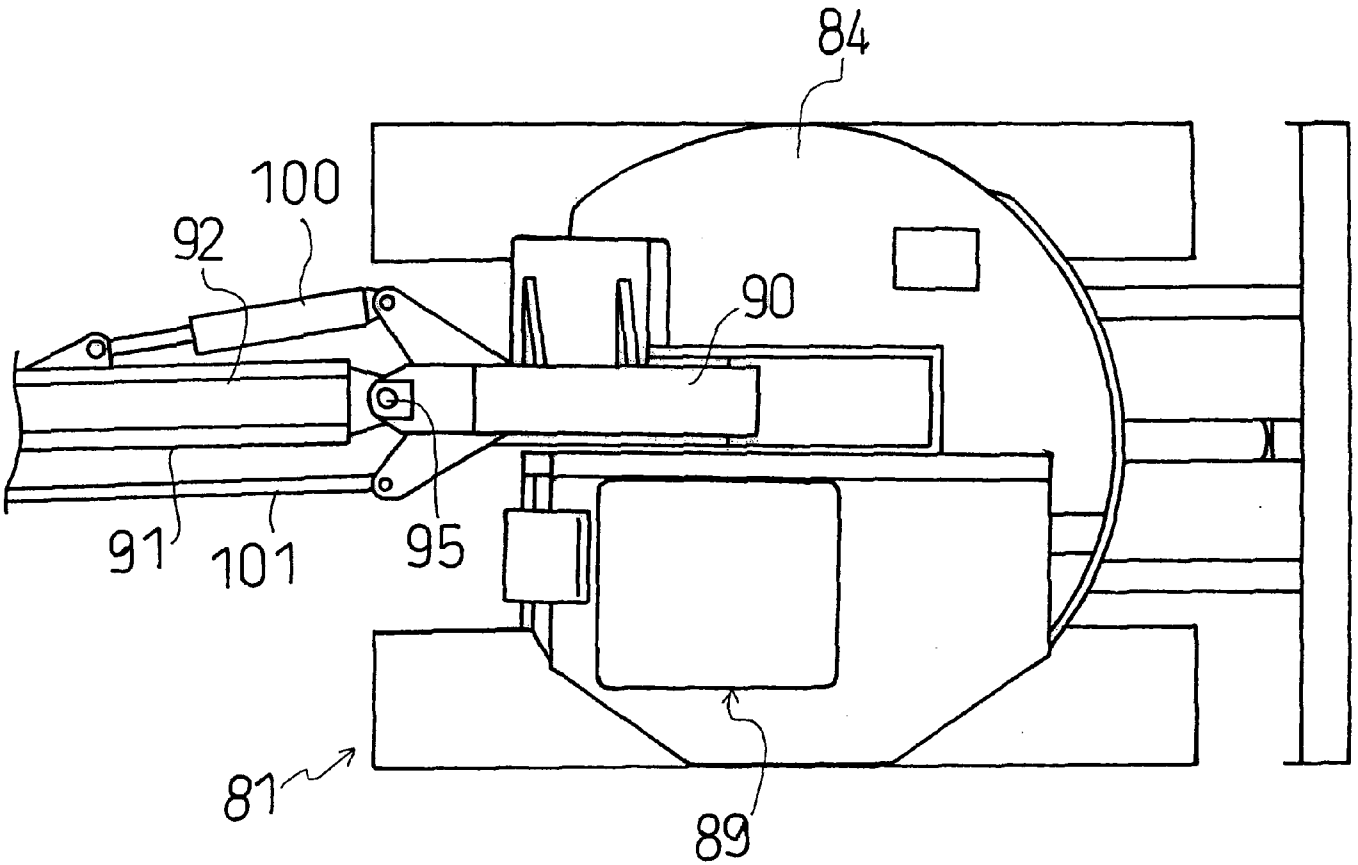
FIG. 41 is a plan view of above.
Figure 42:
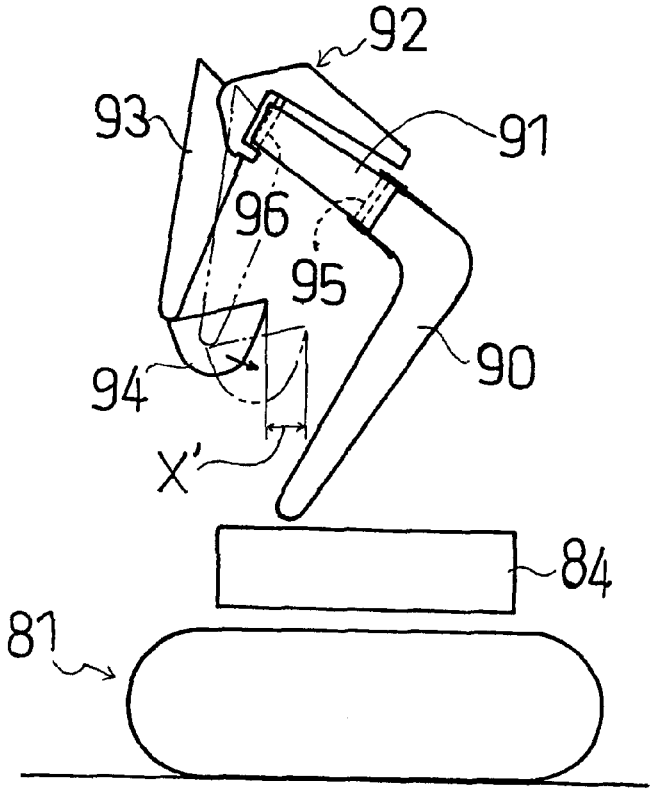
FIG. 42 is a side view showing the way of a bucket moving forward when the bucket is offset in the transversal direction, on the conventional extremely-small-swing working machine.
Figure 43:
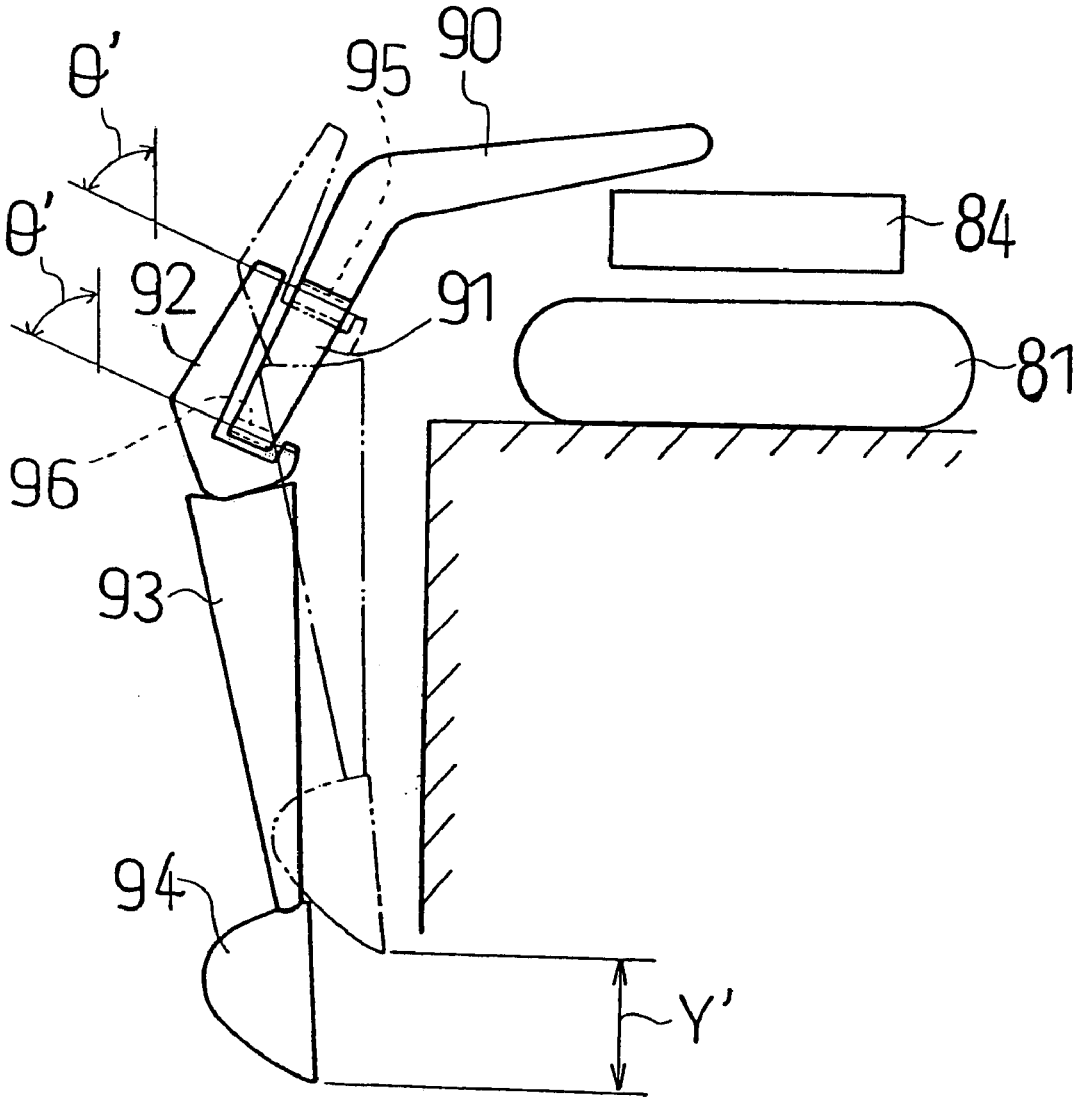
FIG. 43 is a side view showing changes in vertical position of the bucket in the case where the bucket is offset at the time of deepest excavation, on the conventional extremely-small-swing working machine.

On the conventional backhoe device 85 as disclosed in FIG. 40, etc., it is also possible to obtain effects such as expansion of depth of excavation, etc. by a drawing type third boom section 12B (or third boom section 12A) of the present invention, by improving the third boom section 92 in a way to be extended. The backhoe device 85' indicated in FIG. 38 and FIG. 39 is one realized by extending the third boom section 92 in the conventional backhoe device 85 into the third boom section 92'. Namely, the backhoe device 85 may be constructed in such a way that, when it is put in the state of deepest excavation, the third boom section 92' is extended downward in a large length from the tip of the second boom section 91, as shown in FIG. 38 and FIG. 39, and this makes it possible to keep the depth of excavation equal to the sum of the length L1' of the third boom section 92', the length L2' of the arm 93 and the length L3' of the bucket 94. In this case also, the longer the length L1' of the third boom section 92' and the length L2' of the arm 93 are formed, the more the depth of excavation can be increased. And, also in a loading work on the load-carrying platform of a truck, the bucket 94 can be made to reach near the front edge of the load-carrying platform 75 from the rear part of the truck. Moreover, when winding up the bucket 94, a large distance can be taken between the rear end of the bucket 94 and the second boom section 91 behind it, enabling to expect an effect of avoiding interference with the excavated material scooped in the bucket 94. However, since the orientation of the upper and lower rotating shafts 95, 96 is the same as that of a conventional type, the problems produced with offsetting cannot be solved without adoption of the construction according to the present invention.

Next, the characteristics as seen in the second type and the third type respectively will be explained based on FIG. 13 to FIG. 37.

Figure 14:
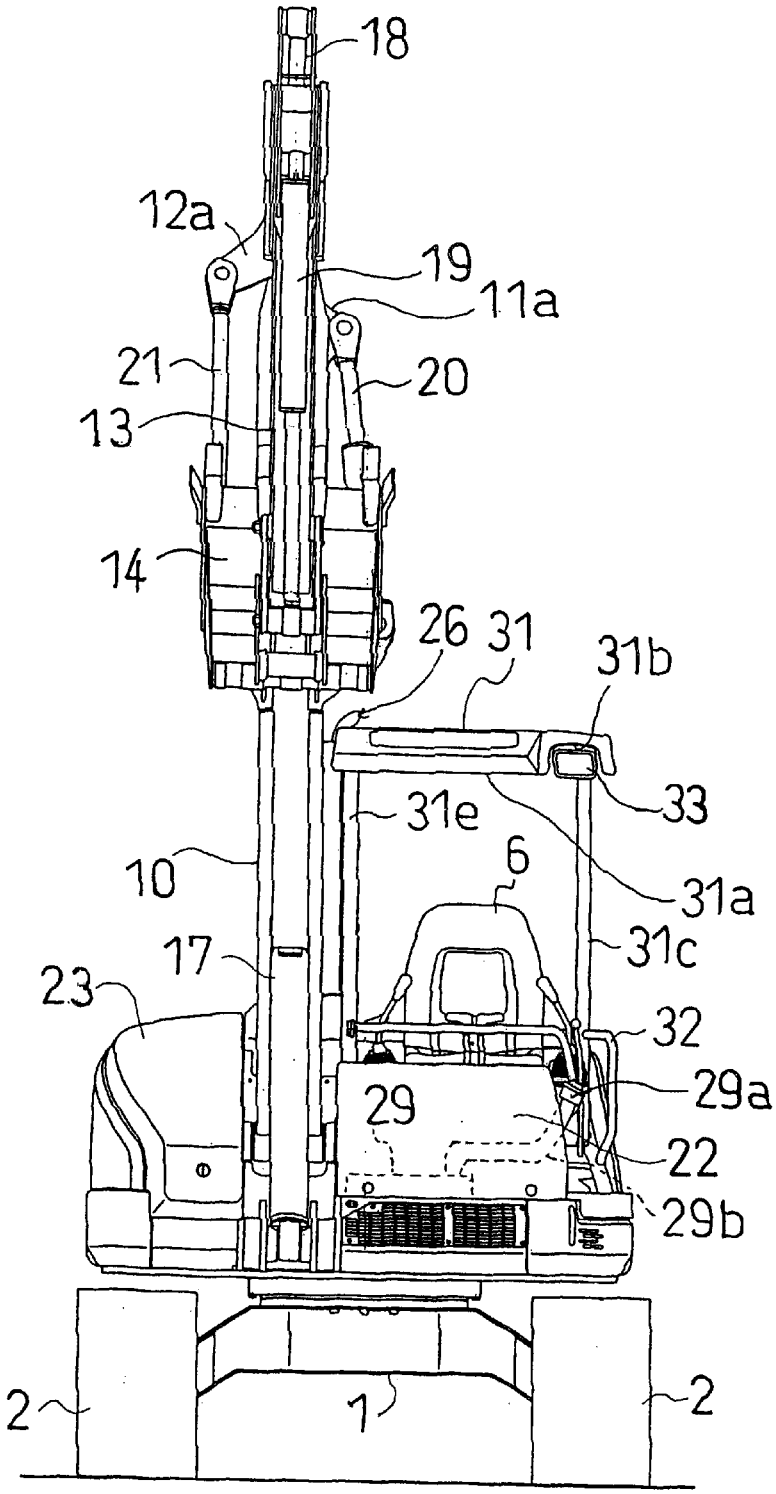
FIG. 14 is a front elevation of above.
Figure 23:
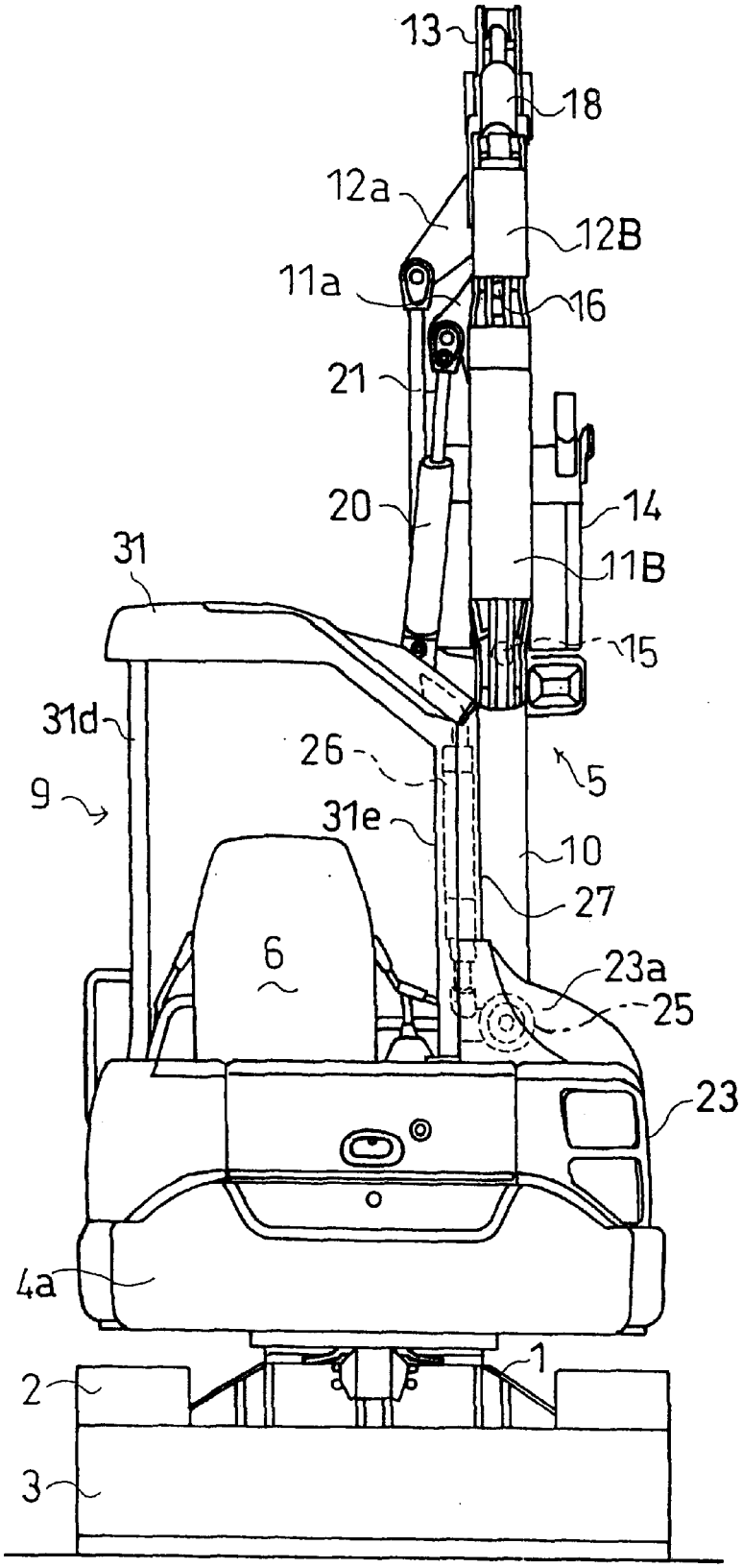
FIG. 23 is a rear view of above.
Figure 24:
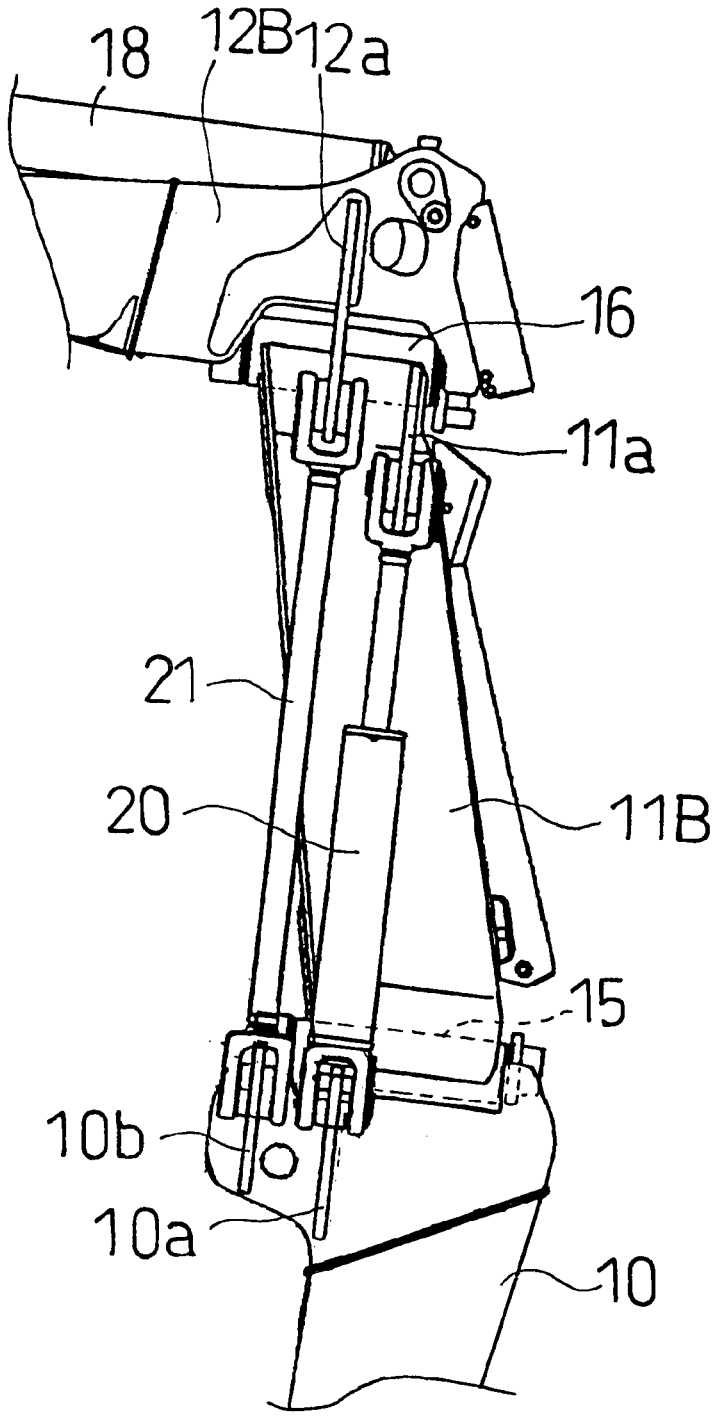
FIG. 24 is a side view showing a second boom section of the third type and its connecting portion to a first boom section and a third boom section.

In the backhoe device 5, a difference between the second type and third type lies in the position where the connecting rod 21 is disposed. Namely, along the second boom 11B, the connecting rod 21 is disposed, on the side opposite to the offset cylinder 20, as shown in FIG. 13 and FIG. 14, etc., in the second type, and on the same side as the offset cylinder 20, as shown in FIG. 22 and FIG. 23, etc., in the third type. Unless otherwise specified, the explanation given hereafter, on the offset cylinder 20 and the connecting rod 21, is based on the assumption that the first boom section 10 is raised.

In either type, the top end of the connecting rod 21 is connected to the bracket 12*a* provided near the rear end of the third boom section 12B and does not protrude in front of the third boom section 12B (nor in the backward direction as a matter of course), at least in the upper half of the third boom section 12B.

Figure 26:
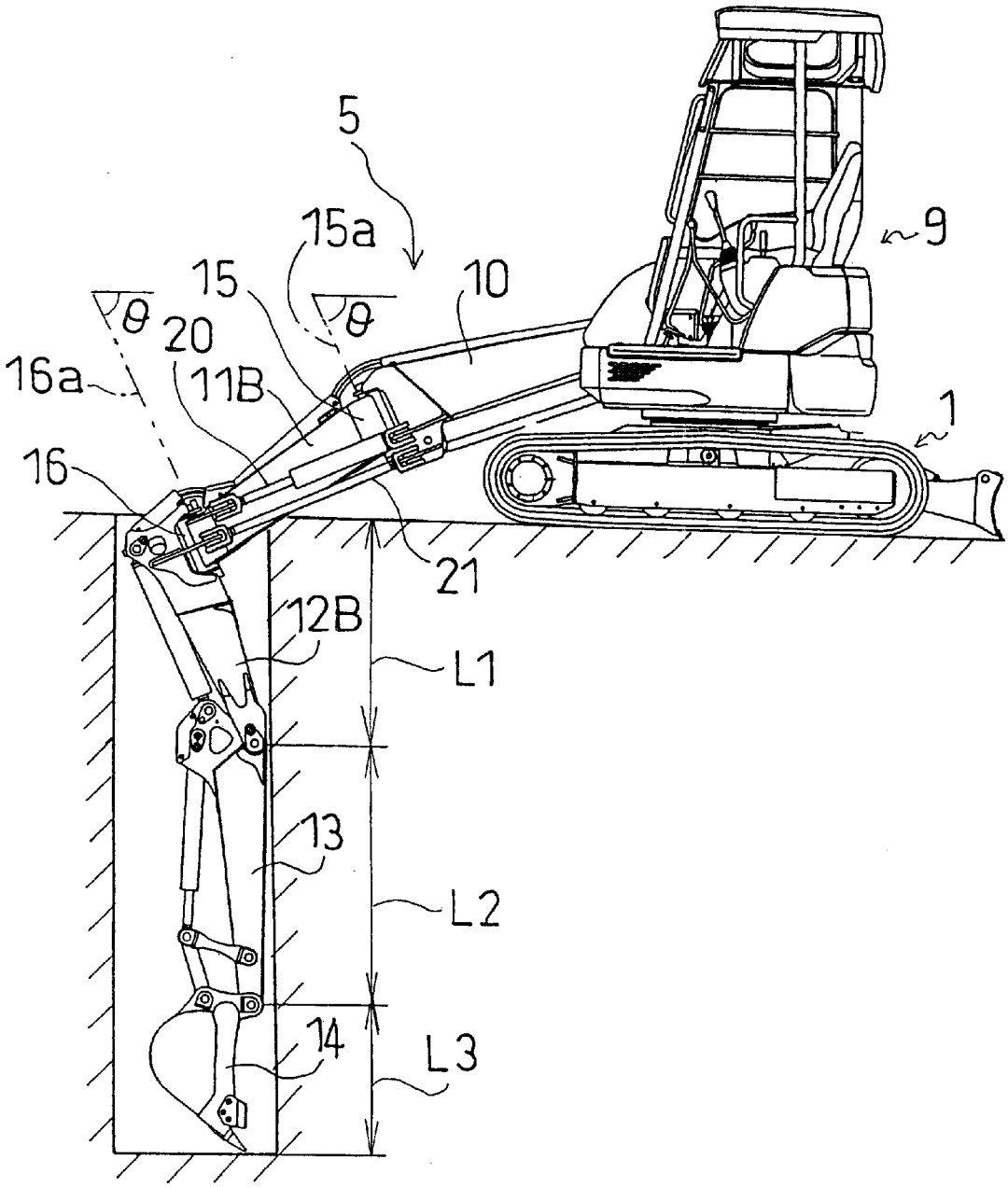
FIG. 26 is a side view showing a deepest excavation work by a backhoe device of the third type.
Figure 27:
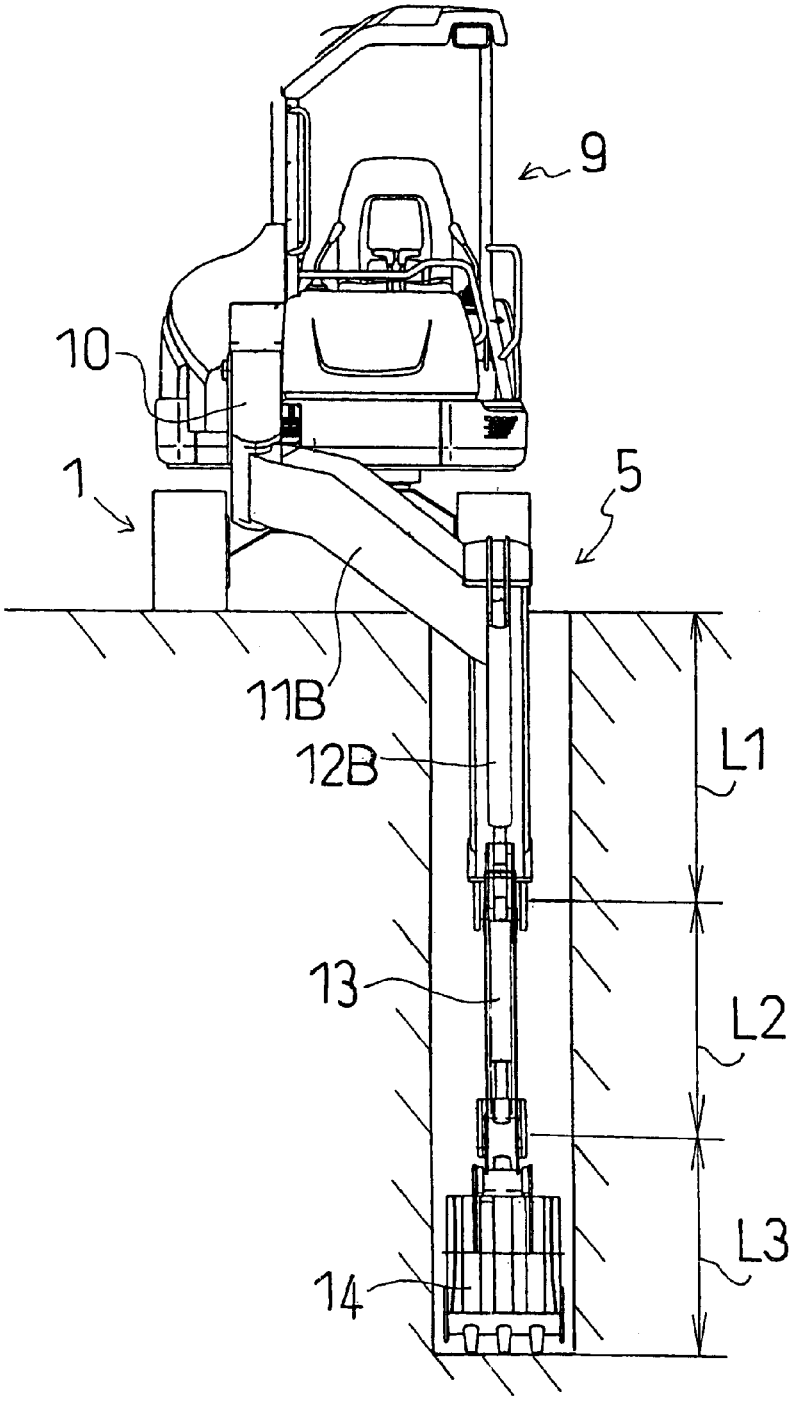
FIG. 27 is a front elevation of above.

In the third type, by an amount with which the connecting rod 21 is placed in parallel just in front of the offset cylinder 20, the connecting rod 21 is positioned slightly toward the forward direction as a whole, and the bracket 10*b* of its connecting portion to the first boom section 10 comes to a position closer to the tip of the first boom section 10, just in front of the bracket 10*a* supporting the base end of the offset cylinder 20 with a shaft, and this makes the connecting rod 13 protrude in the forward direction at the lower half of the second boom section 11B. However, in the state of deepest excavation, the second boom section 11B is inclined downward in the forward direction, as shown in FIG. 26, and, even if the connecting rod 21 protrudes downward at the latter half of the second boom section 11B, the connecting rod 21 protruding that way does not touch the ground surface, because the second boom section 11 gets in contact with the ground surface at its front half part.

In the second type, the connecting portion to first boom 10 at the bottom end of the connecting rod 21 can be displaced backward by an amount with which it is disposed on the side opposite to the offset cylinder 20 and, as shown in FIG. 13, etc., the connecting rod 21 completely overlaps with the second boom section 11B in side view with no portion at all protruding in the forward direction. This makes it possible to completely protect the connecting rod 21 not only when the second boom section 11B is brought very close to the ground surface for excavation at the deepest position but also in the case where there exists some obstacle near the front end (bottom end during an underground excavation) of the second boom section 11B.

Next, an embodiment with improvement in the respective structures of oil feed port of fuel tank, light and exhaust pipe will be explained with the second type indicated in FIG. 13 to FIG. 21. This same structure of exhaust pipe is also adopted in the third type, and it may also be applied to the first type. Moreover, in the first type and the third type, this same structure of light can be adopted, though it is not disclosed there.

In the operator's cab 9, from the lower part of the operator's seat 6 are provided operating levers 7 in extension in the forward direction (not a structure of disposing levers in the front column 8 as in FIG. 5), and on the boarding and alighting side of the operator's seat 6 is disposed an auxiliary arm 32 to be gripped by the worker at the time of boarding and alighting, to assist the boarding and alighting actions. In this embodiment, above the operator's seat 6 is disposed a canopy 31, to form the operator's cab 9, and in the front part of this canopy 31 is provided a light 33 for illuminating the working space during the nighttime or when the work is executed in a dark place, etc., in such a way that the direction of illumination is adjustable up and down and to left and right. The light 33 is mounted on the ceiling face 31*a*, which is the bottom face of the canopy 31. The light mounting fixture 31*b* on the ceiling face 31*a* is formed one step higher than other parts of the ceiling face 31*a*, so that the light 33 may not much protrude downward than the ceiling face 31*a*.

Figure 16:
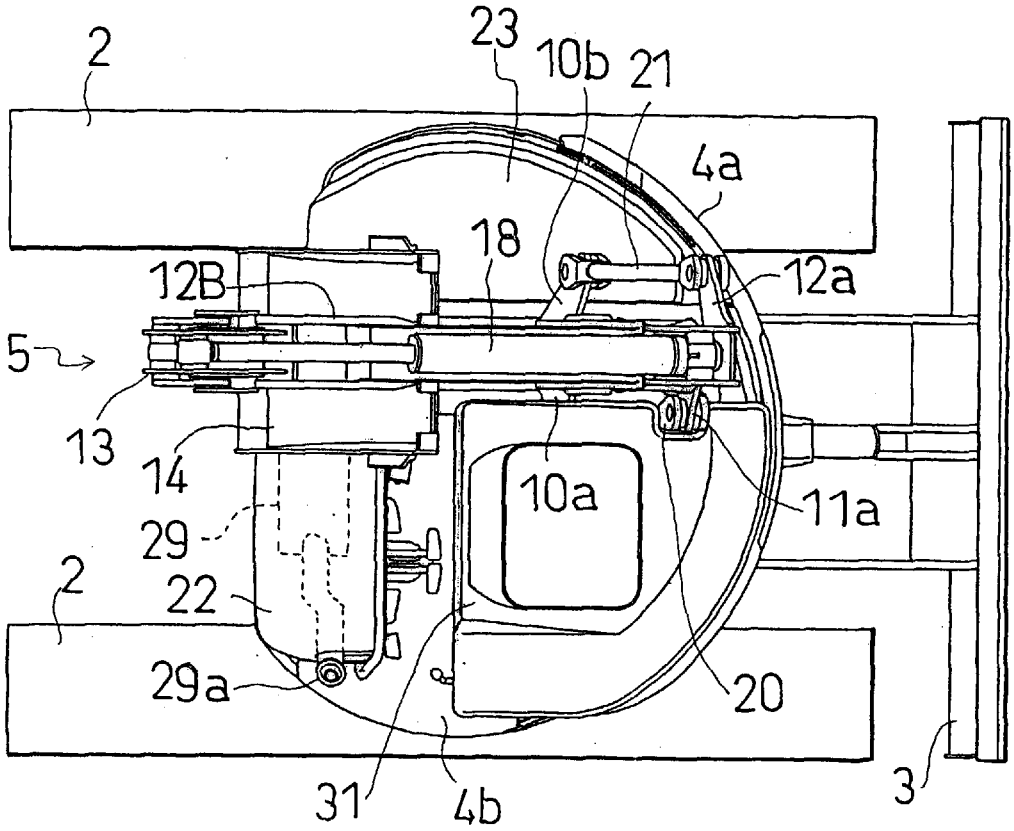
FIG. 16 is a plan view of above.

The fuel tank 29 is installed in the front hood 22 in front of the operator's cab 9. In this embodiment, an oil feed pipe 29*b* is extended upward at a large length from the top face of the fuel tank 29, and the oil feed port 29*a* at its tip is made to protrude to outside about in upward direction from the front hood 22, as shown in FIG. 13 and FIG. 16. And, the vertical height of the oil feed port 29*a* is set at a low position at about the same height with the lower half part of said auxiliary arm 32, to enable the oil feeding worker to stand on the ground surface and feed oil in a stable state. Moreover, the oil feed port 29*a* is positioned near a floor 4*b* (top face of the swing table 4) in front of the operator's seat 6, and helps to improve the working efficiency of oil feed work, because the oil feed tank (for feeding fuel to the fuel tank 29) filled with fuel oil can be placed also on the floor 4*b* before the start of oil feed or during an oil feed work.

Furthermore, since the oil feed port 29*a* is open about in the upward direction, it is possible to feed the fuel oil to be supplied accurately even without use of any special oil feed tool, and thus improve the working efficiency.

Figure 15:
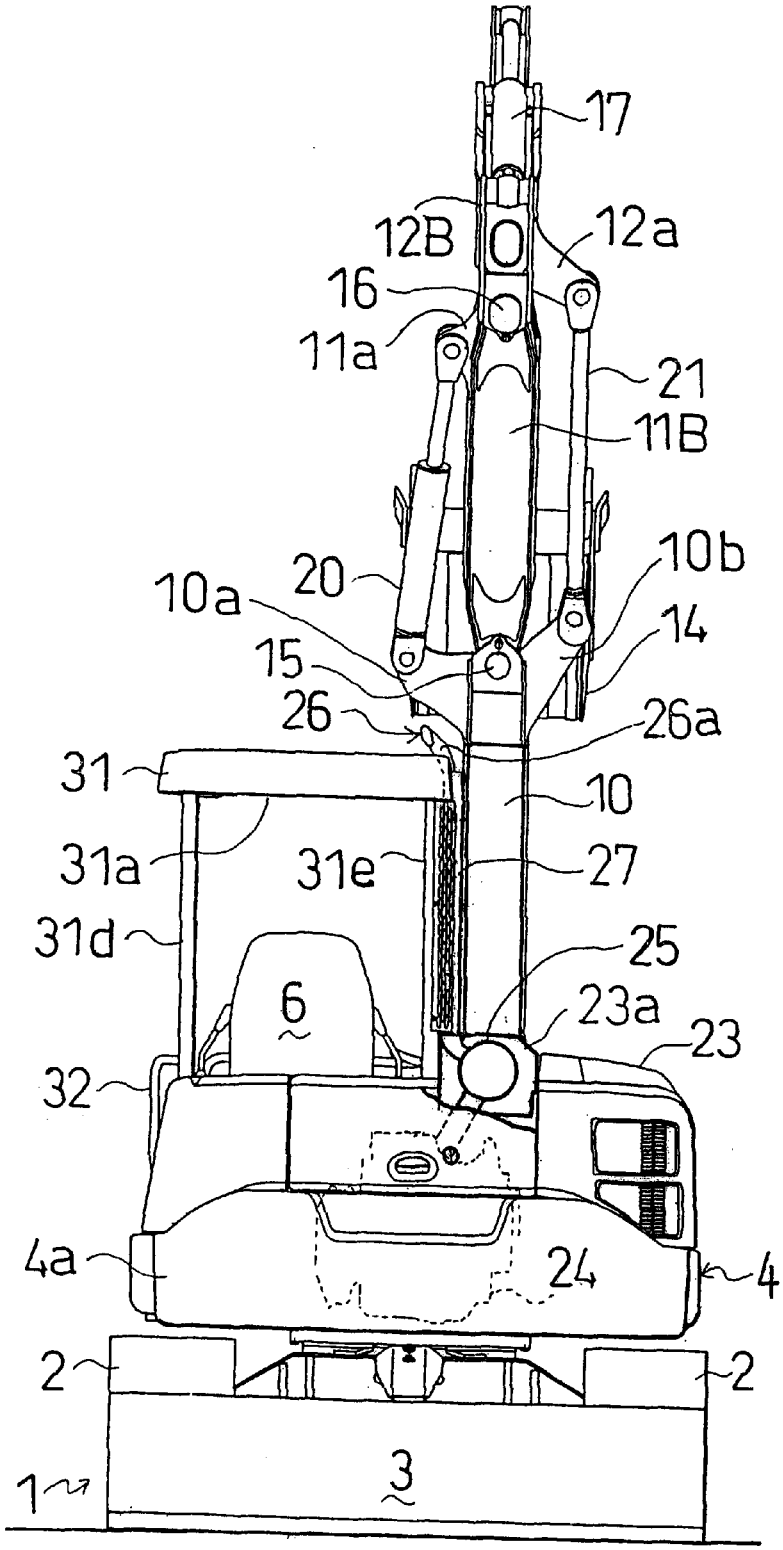
FIG. 15 is a rear view of above.
Figure 31:
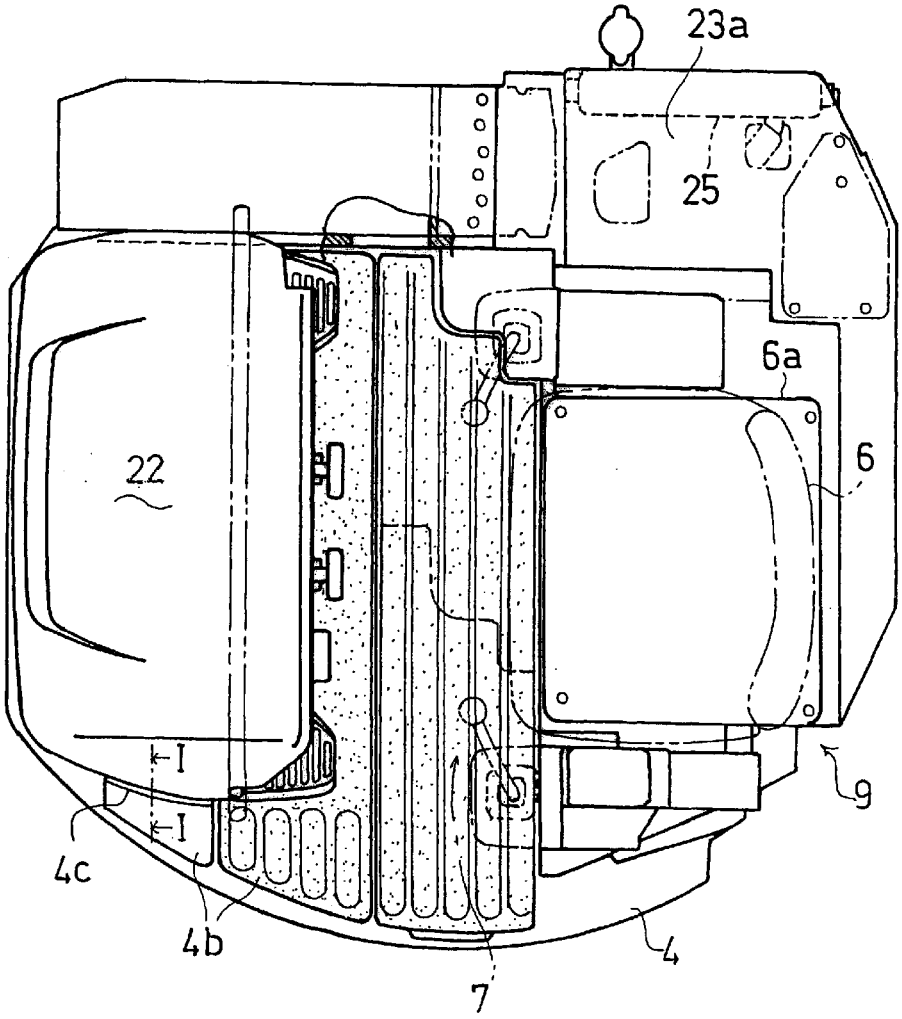
FIG. 31 is a plan view of the inside of an operator's cab 9.

Next, as for the structure of the exhaust pipe, an engine 24 is provided in the bonnet 23 in the rear part of the operator's cab 9, while a muffler 25 is disposed outside the bonnet 23 over the engine 24, as shown in FIG. 15, and the muffler 25 is covered with a muffler cover 23*a* separate from the bonnet 23. (Also in the third type is disposed a muffler 25 in the same way, as shown in FIG. 23 and FIG. 31.) The inside of the muffler cover 23*a* covering the muffler 25 and the inside of the bonnet 23 are isolated from each other, to prevent the inside of the bonnet 23 from getting hot with the radiation of the muffler 25. Namely, this can prevent the cooling air of the radiator and the oil cooler, etc. incorporated in the bonnet 23 from being warmed with the heat of the muffler 25, and improve the cooling effects of the cooling air.

And, an exhaust pipe 26 for discharging exhaust air to outside is in provided upward from the muffler 25, and the tail pipe 26*a* at the tip of the exhaust pipe 26 is extended to a position higher than the top face of the canopy 31.

Still more, the exhaust pipe 26 is disposed along a rear stanchion 31*e* supporting the canopy 31, and the outer circumference of this exhaust pipe 26 is covered by the rear stanchion 31*e* and an exhaust pipe cover 27.

Figure 17:
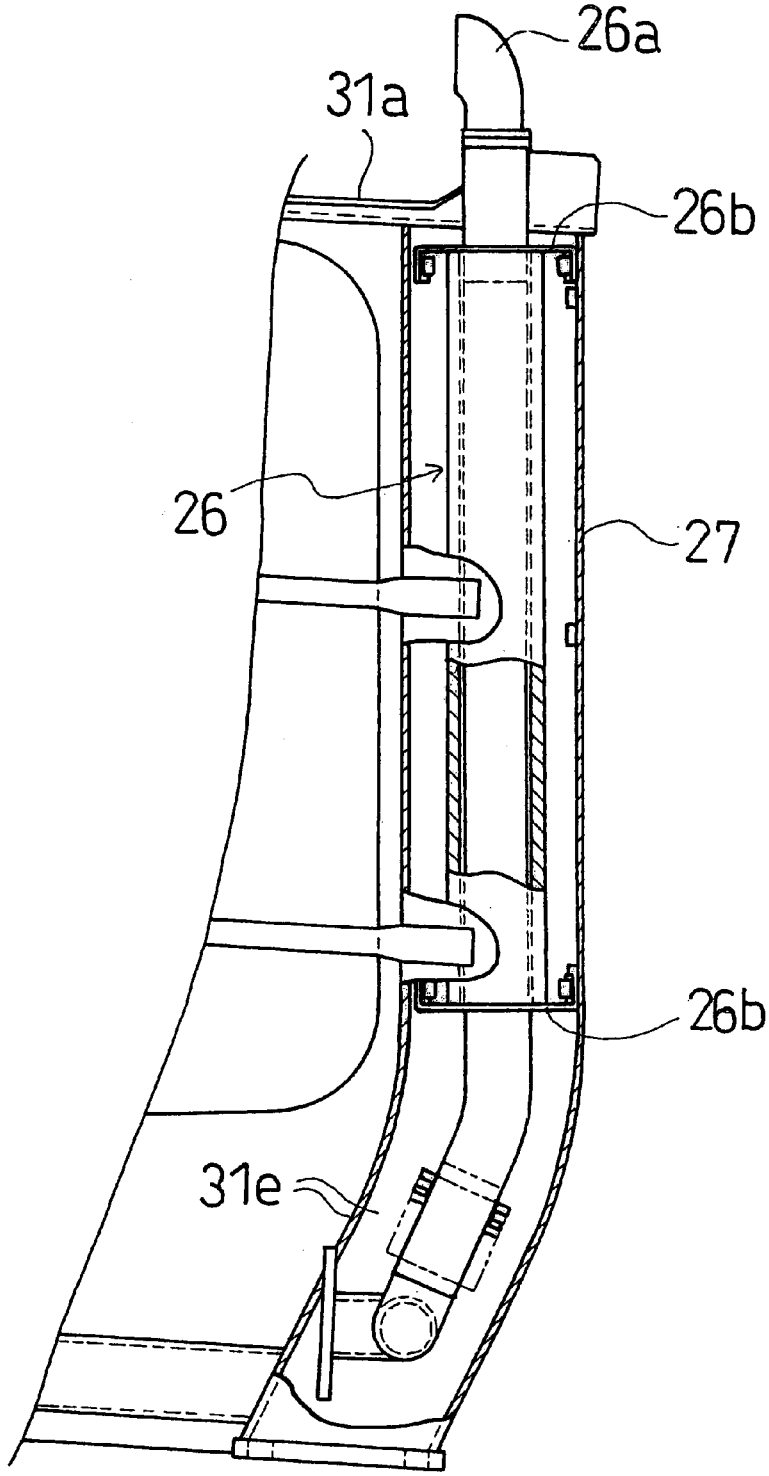
FIG. 17 is a side view showing an exhaust pipe installed along a stanchion of a canopy in this embodiment.
Figure 18:
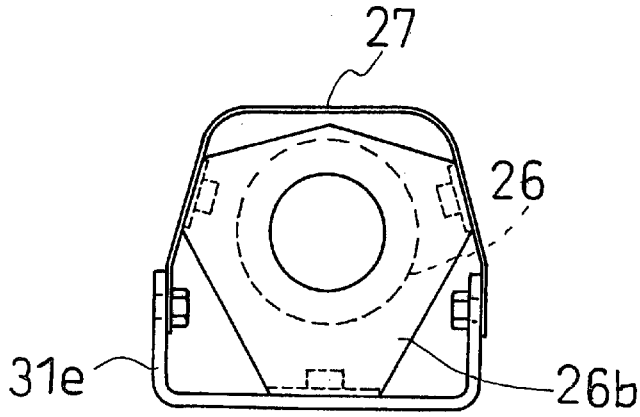
FIG. 18 is a plan view of above.

Namely, as shown in FIG. 17 and FIG. 18, the rear stanchion 31*e* is formed about in a U-like shape open to the side where the exhaust pipe 26 is disposed, in plan view, and the exhaust pipe 26 is stored in the space formed by 3 side faces of the rear stanchion 31*e*. And, an exhaust pipe cover 27 is disposed along the end opposite to the rear stanchion 31*e* (rear end) of the exhaust pipe 26, to cover the exhaust pipe 26.

The exhaust pipe 26 is connected and fixed to the rear stanchion 31*e* and the exhaust pipe cover 27, covering the outer circumference of this exhaust pipe 26, while securing a certain space against them by means of brackets 26*b*, 26*b*, so that the heat of the exhaust pipe 26 may not be directly transmitted to the rear stanchion 31*e* and the exhaust pipe cover 27.

The tail pipe 26*a* mounted at the tip of the exhaust pipe 26 is open about in the sideward or upper sideward direction, and is constructed in such a way that the exhaust air is discharged about sideward or upper sideward. In addition, the tail pipe 26*a* is mounted in a way to turn in horizontal direction, so that the direction of discharge of exhaust air may be changed as required according to the surrounding environments.

Since the tail pipe 26*a* of the exhaust pipe 26 is disposed higher than the top face of the canopy 31, the exhaust air is not discharged toward the worker executing his work by sitting in the operator's seat 6, enabling the worker to perform his duty in comfort, and thus improve his working efficiency. Further, it can also protect the passers.-by or trees and plants, etc. in the surrounding area from the exhaust air, thus avoiding discomfort to the passers-by and damage to trees and plants, etc.

And, as mentioned before, by forming the rear stanchion 31*e* of the canopy 31 about in a U-like shape open backward in plan view, disposing the exhaust pipe 26 along this rear stanchion 31*e*, and storing it in the space formed in the rear stanchion 31*e*, it becomes possible to clear the space occupied with the presence of the exhaust pipe 26, secure a field of view not disrupted by the exhaust pipe 26 for the worker working in the operator's cab 9, and thus improve the working efficiency and safety. Moreover, as the rear stanchion 31*e* can be substituted for part of an exhaust pipe cover 27 covering the outer circumference of the exhaust pipe 26, this enables to achieve reduction of weight and cost reduction of the machine body.

Next, a light 33 indicated in FIG. 13 and FIG. 14 is mounted at the front part of the canopy 31 as mentioned before, illuminating the working space during the nighttime or when the work is executed in a dark place, etc. to facilitate the execution of work.

Figure 19:
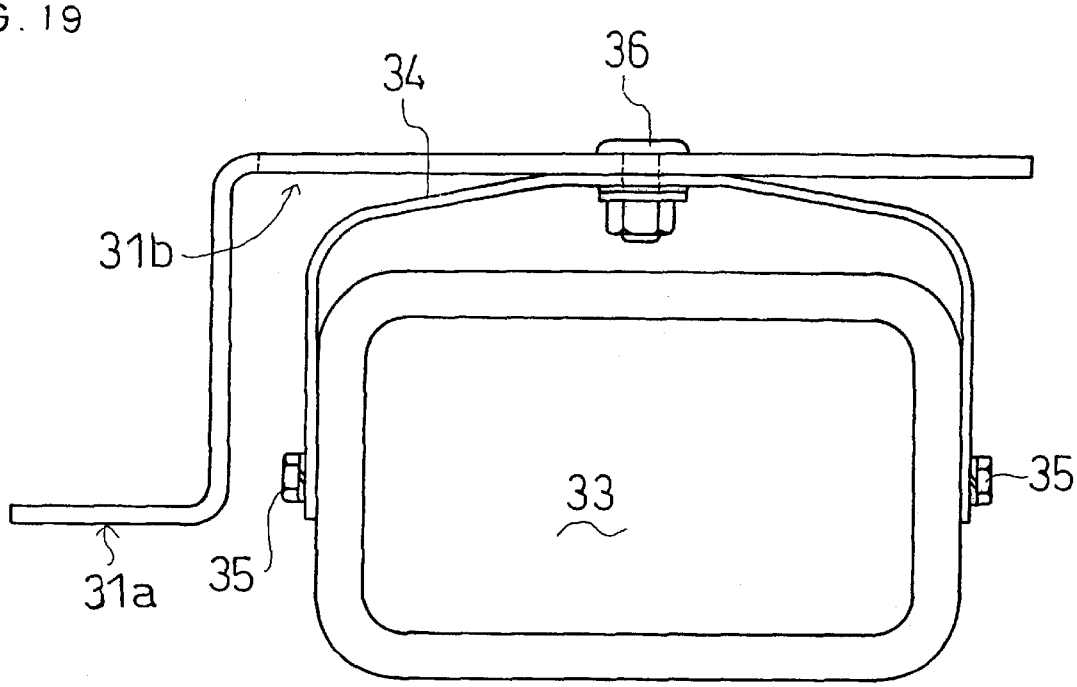
FIG. 19 is a front elevation showing a light mounted on the canopy in this embodiment.
Figure 20:
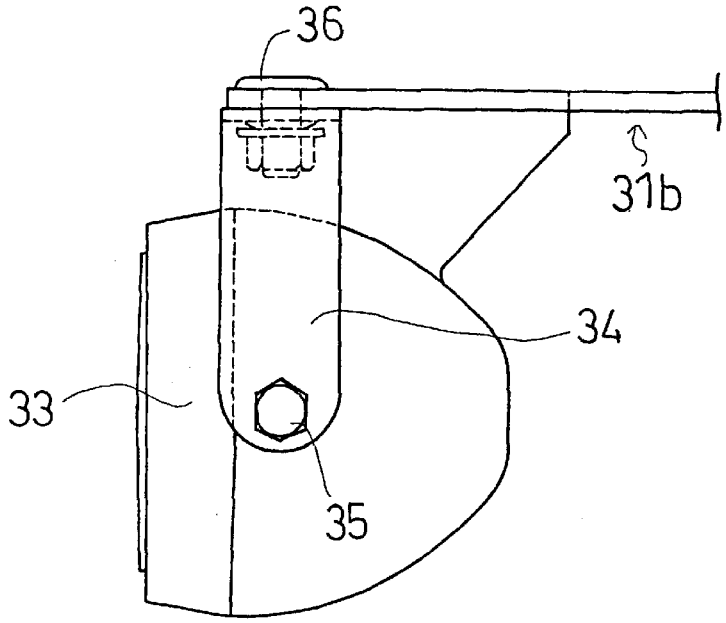
FIG. 20 is a side view of above.

As shown in FIG. 19 and FIG. 20, the light 33 is mounted in a light mounting fixture 31*b* on the ceiling face 31*a* of the canopy 31, and this light mounting fixture 31*b* is formed in a way to be positioned higher than other ceiling face 31*a*.

Yet more, the light 33 is attached to a light bracket 34, by bolts 35, 35, in a way to turn up and down, and the light bracket 34 is attached to the light mounting fixture 31*b* in a way to turn to left and right with bolt 36. As a result, the light 33 comes to be mounted in a way to turn up and down and to left and right against the mounting unit 31*c*, enabling to adjust the direction of illumination up and down and to left and right.

Figure 21:
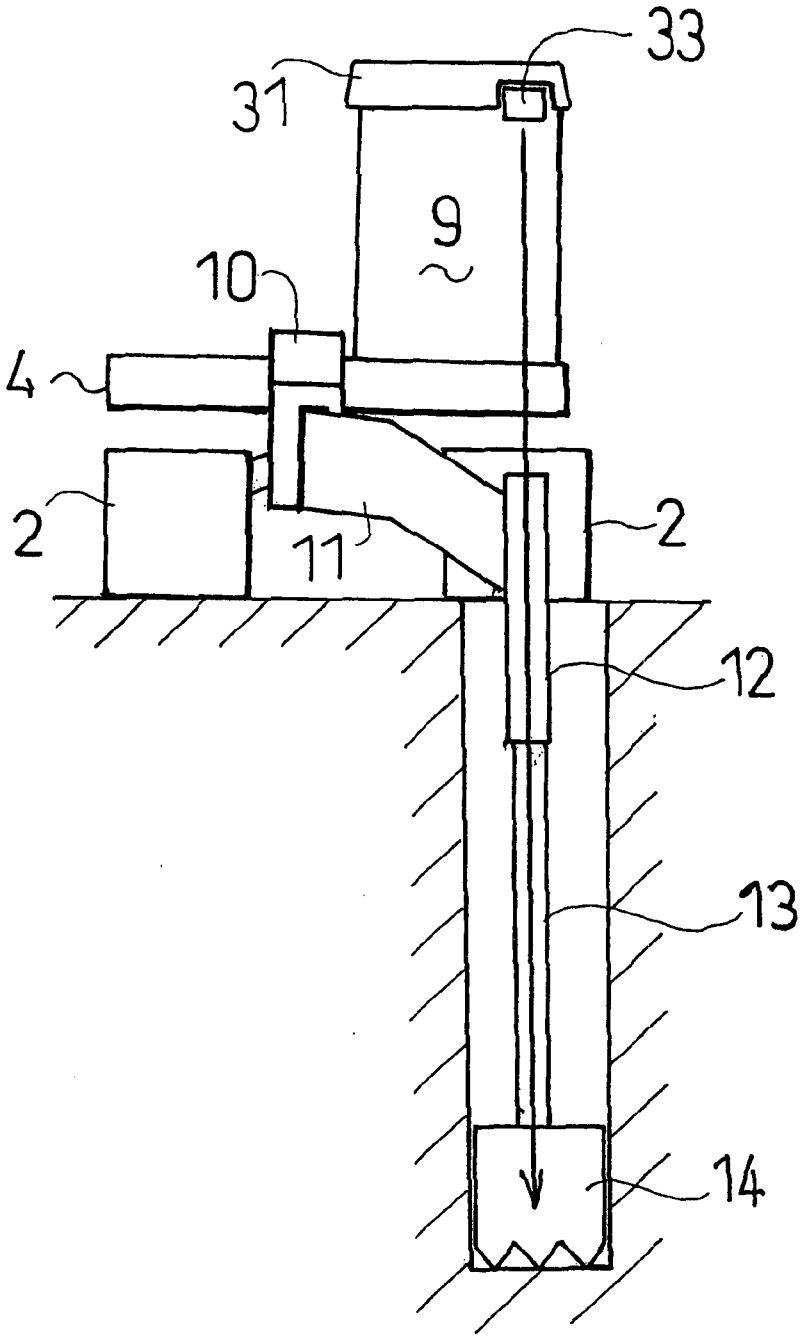
FIG. 21 is a drawing showing a state of illumination of the light during a street drain excavation work in front of a driver's seat.

While the light 33, mounted at the front part of the canopy 31 positioned over the operator's seat 6, can illuminate the working space during the nighttime or when the work is executed in a dark place, etc., it can illuminate the bottom part of the ditch also during execution of an excavation work of street drain in the forward direction of the operator's seat 6, as shown in FIG. 21, and thus improves the working efficiency of street drain excavation work.

Moreover, the light 33, constructed in such a way that the direction of illumination can be adjusted up and down and to left and right, makes it possible to change the direction of illumination as required according to the direction of the working space where the work is executed, to thus cope with all kinds of work.

Furthermore, as for the ceiling face 31*a* of the canopy 31, the light mounting fixture 31*b* in which to mount the light 33 is formed one step higher than other parts of the ceiling face 31*a*, and the light 33 does not much protrude downward than other parts of the ceiling face 31*a*. This makes it possible to secure a wide free space around the head of the worker, prevent contact with the light 33 and the worker's head even at the time of boarding and alighting, and illuminate a wide range of the working space with the light 33 disposed at a high position.

Next, the construction inside the front hood 22 in the third type will be explained with reference to FIG. 31 to FIG. 37.

The front hood 22 is made of resin. The resin material may be of any kind such as polyethylene resin, ABS (acrylnitrile-butadienestyrene) resin, etc., if only it provides the shape and the strength, etc. required of the front hood 22. Its shape is that of a circular are inclined downward in the forward direction in side view, and is partially spherical also as a whole. As mentioned before, since it is highest at the rear end, only the rear end face of the front hood 22 comes in the operator's sight, as seen from the worker sitting in the operator's seat 6, in the case where there is nothing behind the front hood 22.

The front hood 22 does not require any painting because the constituent resin itself is coloured. Moreover, resin improves the degree of freedom of shape and enables reduction of weight. Furthermore, it can reduce the maintenance cost, because it elastically deforms and returns to its original shape even in case of contact with an obstacle. Still more, it can be worked easily, making repair work and/or replacement easy and inexpensive.

In the front hood 22 is disposed a unit body 60 on which to mount various kinds of equipment, constructed by integrally combining a partition wall 62, which is mainly about in the shape of a vertical sheet (slightly inclined upward in the backward direction, actually), and a bottom plate 61 in horizontal state, the inside of the front hood 22 is isolated from the operator's cab 9 by the partition wall 62. On this unit body 60 in the front hood 22 are installed, from left (namely from the side closer to the backhoe device 5) in order, an air conditioner 72, a battery 61 and an oil feed port 62*a*. On the unit body 60 are installed, in upright position, an air conditioner side cover 63 and a battery side plate 64 between the bottom plate 61 and the partition wall 62, covering the front face and the left and right faces of the air conditioner 72 with the air conditioner side cover 63 and further covering the upper part of the air conditioner 72 with a heater top cover 63*a*. The air conditioner 72 is constructed in a way to introduce air through an opening on the side face (not illustrated) of the air conditioner side cover 63, and blow air into the operator's cab 9 through diffusers 62*a*, 62*a* provided in the partition wall 62.

On the outside of the right side face of the air conditioner side cover 63 is loaded a battery 28 on the bottom plate 61 along the bottom end of the partition wall 62, on the side opposite to the air conditioner side cover 63 of the battery 28 is installed upright a battery side plate 64. Namely, the battery 28 is disposed in a way to be pinched between the air conditioner side cover 63 and the battery side plate 64. In addition, an opening 61*a* is formed on the bottom plate 61 on the right side of the battery side plate 64, and from this opening 61*a* protrudes the oil feed port 29*a*, extended from the fuel tank 29 disposed under the bottom plate 61, upward in a state slightly inclined to the right side, i.e. toward the outside.

In this way, the air conditioner 72, the battery 28 and the oil feed port 29*a* of the fuel tank 29, mounted on the unit body 60 composed of the partition wall 62 and the bottom plate 61, are covered by the front hood 22 and protected against earth and sand, etc. falling from the working attachment (bucket 14).

Still more, the front hood 22 does not require any painting because it is made of resin as mentioned before and, therefore, does not present any such problem of peeling of coating with fallen earth and sand, etc., and it also improves corrosion resistance as it returns to its original shape immediately even after a deformation due to shocks.

Next, explanation will be given on the opening/closing mechanism of this front hood 22.

Figure 32:
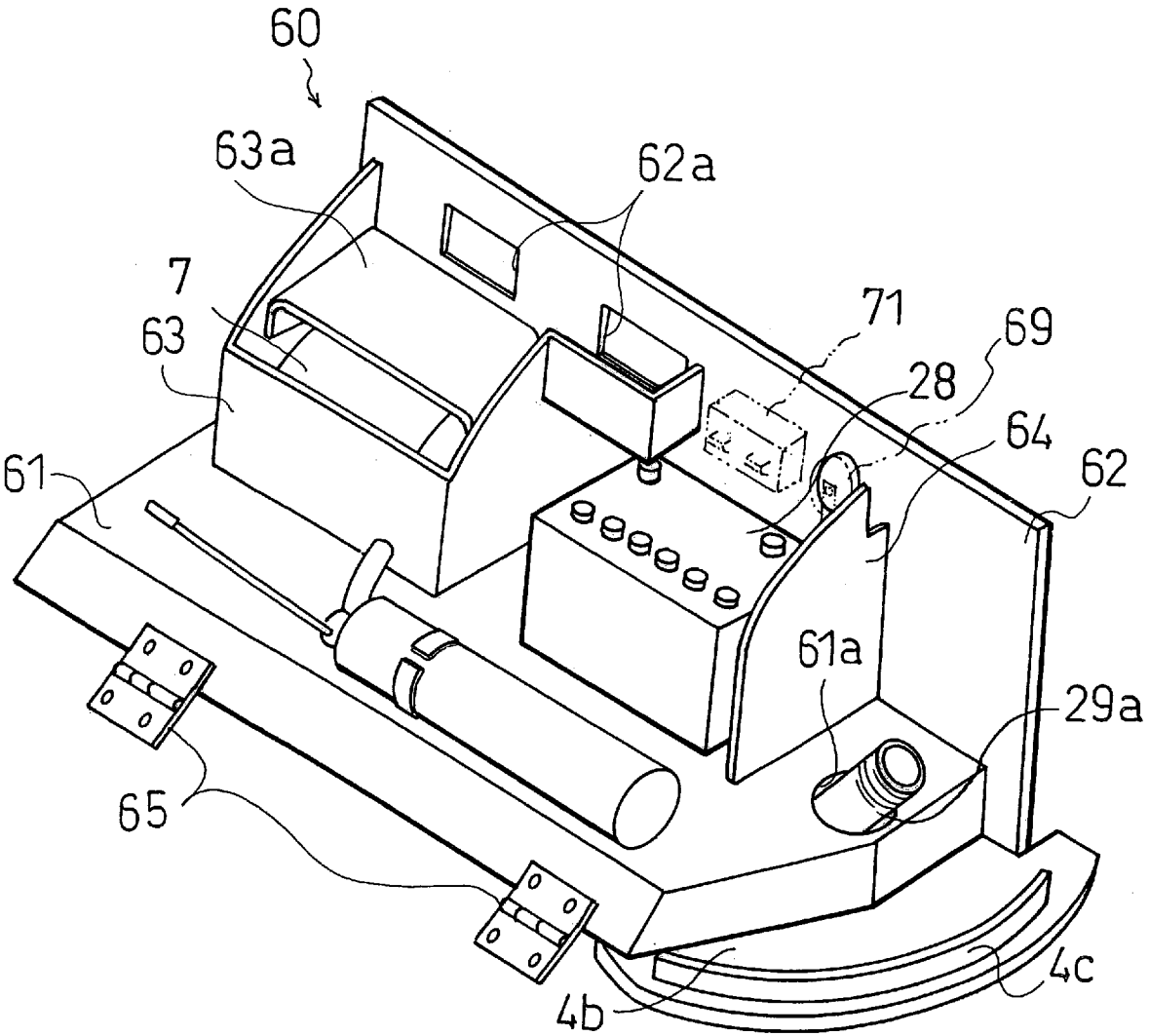
FIG. 32 is a perspective view of a system unit body installed in a front cover in the front part of the operator's cab.
Figure 33:
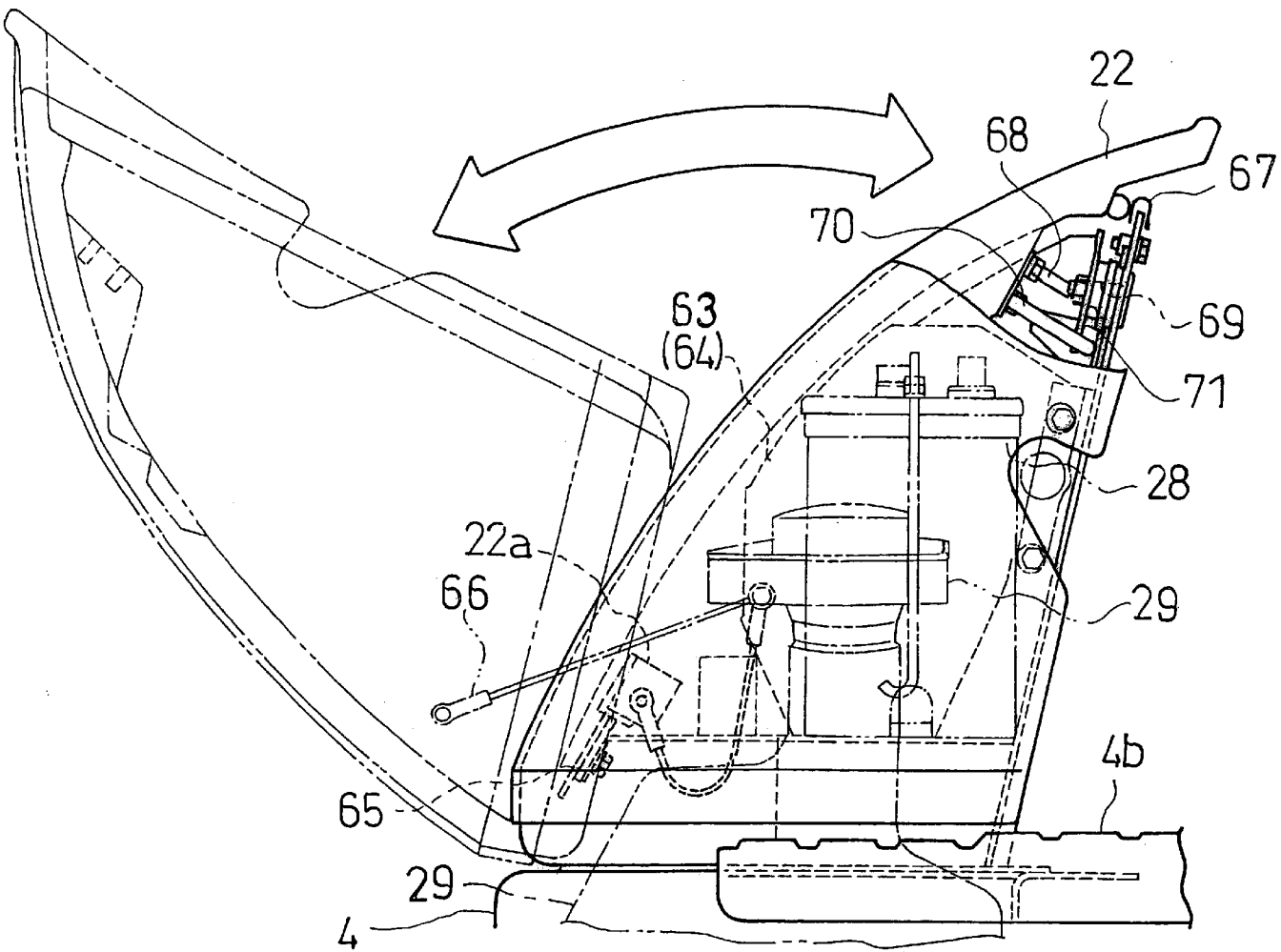
FIG. 33 is a side view showing the opening/closing state of the front cover.

The front hood 22 is constructed in a way to open and close by turning with its bottom end in the front part as fulcrum, as shown in FIG. 33. As indicated in FIG. 32, to the front part of the bottom plate 61 is fixed one end each of the hinges 65, 65, while the other end of the two hinges 65 is fixed to the bottom part of the front hood 22. This enables the front hood 22 to open and close with the hinge shaft of the hinges 65 as turning shaft.

The amount of opening of the front hood 22 is controlled by a wire 66. One end of this wire 66 is connected to a stay 22*a* fixed to the front hood 22, and the other end is connected to part of said air conditioner side cover 63 (or battery side plate 64). In the state where the front hood 22 is closed, it is bent as indicated by broken line and, when the front hood 22 is opened and the wire 66 gets in a state stretched linearly as shown by two-dot chain line, the opening motion of the front hood 22 stops. In this way, the amount of opening of the front hood 22 is determined by the length of the wire 66.

The front hood 22 is so constructed as to be restricted and held to the partition wall 62 in closed state, as a fastening member 68 provided in projection from the top part on the inside of the front hood 22 is engaged with the fastening member 69 fixed to the partition wall 62 just above the battery 28. By its side, the front hood 22 is locked to the partition wall 62, as a locking member 70 provided in projection from the top part on the inside of the front hood 22 is engaged with a locking member 71 fixed to the partition wall 62 just above the battery 28. The members 68 to 71 of those fastening mechanisms and locking mechanisms do not interfere with the air conditioner 72 or the battery 28 mounted on the unit body 60, with opening/closing of the front hood 22.

The locking by the locking mechanisms composed of the locking members 70 and 71 can be cancelled easily, to enable to open the front hood 22 without difficulty, making it possible to feed oil to the fuel tank 29 at the lower part of the bottom plate 61, through the oil feed port 29*a*, by opening the front hood 22 easily, even in the case of highly frequent oil feed work.

Yet more, also in the servicing of the battery 28, the front hood 22 does not put any obstacle either above or by the side of the battery 28 when it is opened, thus enabling easy servicing of the battery 28. In the same way, it enables easy assembling, connection and disconnection and servicing of the air conditioner 72.

Thanks to its shape as described above, the front hood 22 easily lets slide down earth and sand falling on it even in closed state. In case some earth and sand adhered to the surface of the front hood 22 and remained there in spite of such construction, it is possible to slide down the earth and sand on the front hood 22 easily by opening the front hood 22 and increasing the downward slope angle on the top face of the front hood 22.

Next, a detailed explanation will be given on the air conditioner side cover 63 and the battery side plate 64 disposed in the front hood 22. The top part of the air conditioner side cover 63 and the battery side plate 64 is constructed in circular arc in side view along the inner face of the front hood 22, and a certain clearance is provided between the top part of air conditioner side cover 63 and battery side plate 64 and the inner side of the front hood 22.

Figure 34:
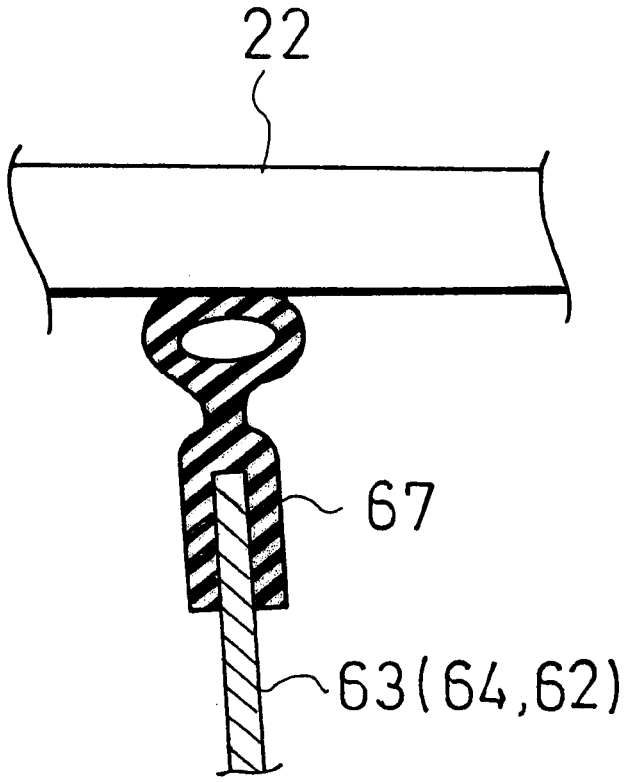
FIG. 34 is a side sectional view of a sealing member provided between a side cover and a front cover of an air conditioner.

And, a sealing member 67 is mounted at the top edge of the air conditioner side cover 63 and the battery side plate 64 as well as at the top edge and the side edge of the partition wall 62. By closing the front hood 22, it is possible to press the front hood 22 against the sealing member 67, and put the front hood 22 and the sealing member 67 in close contact with each other, as shown in FIG. 34.

In this way, in the state where the front hood 22 is closed, the space surrounded by the air conditioner side cover 63 is isolated from other open spaces of the front hood 22, and the air supplied by the air conditioner 72 does not leak to other spaces in the front hood 22. Moreover, since the air conditioner side cover 63 discharges the function of baffle plate guiding the air from the air conditioner 72 to the diffuser 62*a*, this helps to raise the air conditioning efficiency. Furthermore, it also prevents the gases produced from the battery 28 and the smell of fuel from the oil feed port 29*a* from flowing into the operator's cab 9 together with the air from the air conditioner 72.

Still more, the air conditioner side cover 63 and the battery side plate 64 play the role of reinforcing ribs of the front hood 22, providing the front hood 22 with a structure resistant to shocks. And, such protection by the air conditioner side cover 63, the battery side plate 64 and the front hood 22 ensures accurate protection for the air conditioner 72 and the battery 28.

Moreover, since the air conditioner 72 is disposed in the front hood 22 in the front part of the swing table 4 (conventionally, it used to be disposed under the operator's seat, etc.), other members in the swing table 4 such as engine, hydraulic pump, etc. have a higher degree of freedom in their disposition.

Next, explanation will be given on the construction of the diffuser 62*a* used for guiding the air from the air conditioner 72 into the operator's cab 9.

Figure 35:
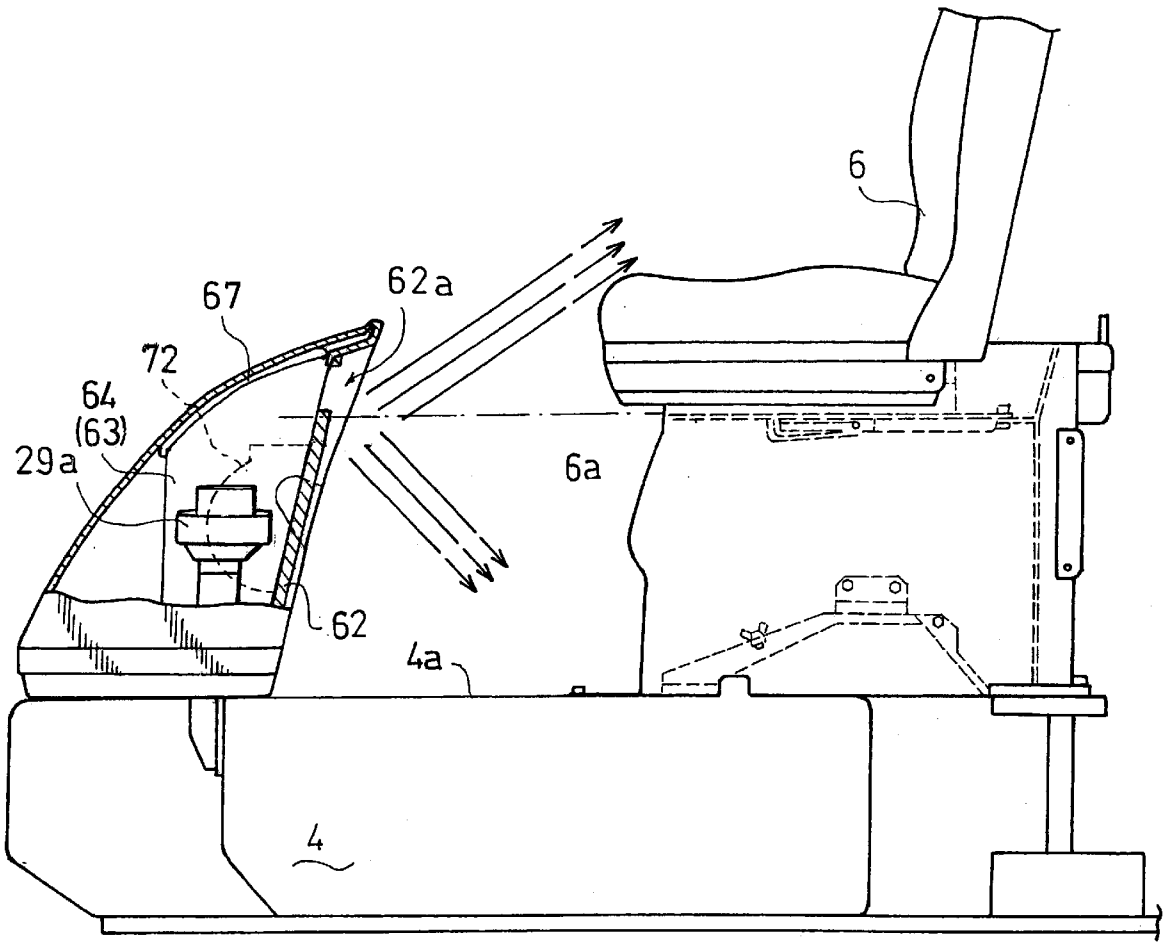
FIG. 35 is a side view showing a position of an air diffuser into the operator's cab.
Figure 36:
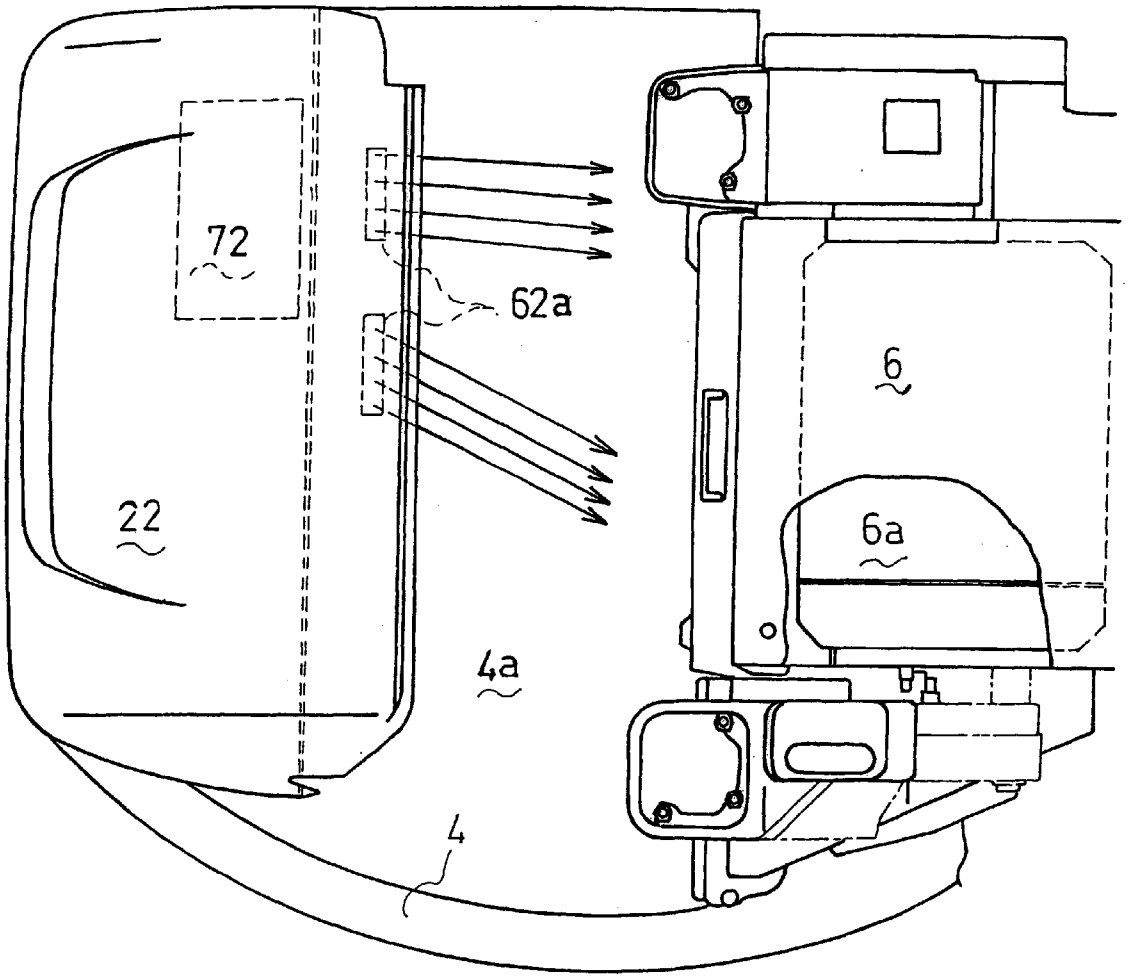
FIG. 36 is a plan view of above.

As shown in FIG. 35 and FIG. 36, the operator's seat 6 is disposed on the operator's stand 6*a* erected on the swing table 4, and the diffuser 62*a* is open to the partition wall 62 at a position higher than the operator's stand 6*a*.

The diffuser 62*a* is provided with a wind direction adjusting means, and this makes it possible to adjust the direction of the air discharged from the diffuser 62*a* into the operator's cab 9 up and down (or to left and right), in the open space in front of the operator's seat 6. Since the diffuser 62*a* is disposed at a position higher than the operator's stand 6*a*, as mentioned before, the degree of freedom in changing the direction of the air discharged from the diffuser 62*a* increases and the air can be blown to the entire body of the worker, sitting in the operator's seat 6, through the diffuser 62*a*, making it possible to smoothly cool or warm the entire body of the worker with the air discharged from the diffuser 62*a*, and improve the working environments for the worker.

Figure 37:
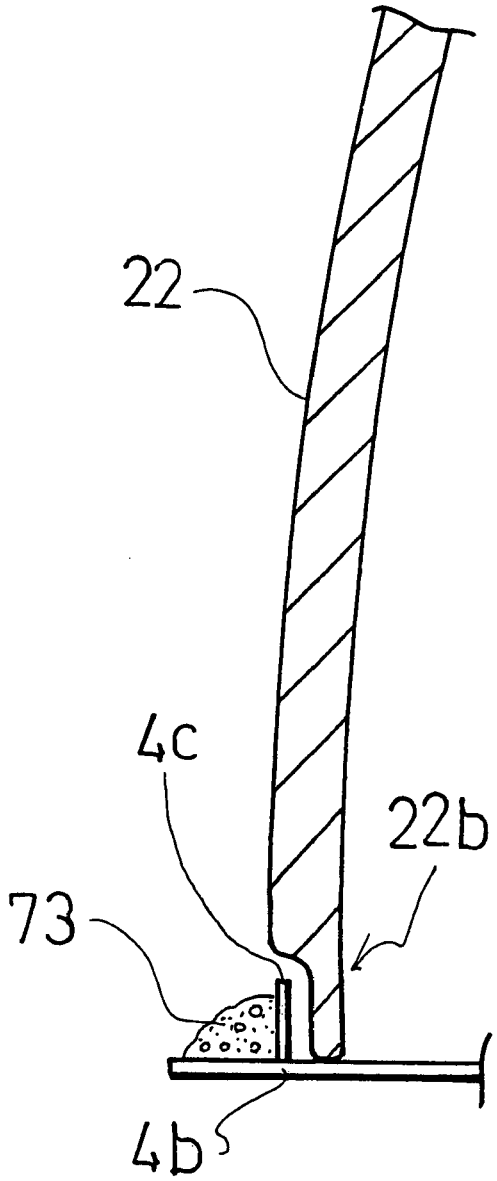
FIG. 37 is an arrow sectional view of the line I—I in FIG. 31.

Next, explanation will be given on the construction of a rib 4*c* provided on the floor 4*b* of the swing table 4 which is in contact with the bottom end of the front hood 22. As shown in FIG. 31 and FIG. 32, on the floor 4*b*, the rib 4*c* is provided in a way to protrude upward, along the portion to be in contact with the bottom edge 22*b* of the portion an the side opposite to the backhoe device 5 when the front hood 22 is closed. The rib 4*c* is provided upright in circular arc in plan view along the outer surface of the bottom edge 22*b* of the closed front hood 22, to prevent earth and sand, etc. from penetrating to the inside through the gap between the bottom edge 22*b* and the floor 4*b*. Namely, as shown in FIG. 37, the bottom edge 22*b* gets inside at the outer surface and is thinner than the thickness in other parts of the front hood 22. Therefore, when the front hood 22 is closed, the outer surface of the rib 4*c* along the outer surface of the bottom edge 22*b* almost forms a single stretch with the outer surface of the portion other than the bottom edge 22*b* of the front hood 22, and the earth and sand 73, etc. sliding down from the front hood 22 on the floor 4*b* remains on the outside of the rib 4*c*. Since the bottom part of this front hood 22 is disposed near the boarding & alighting side, the rib 4*c* helps to prevent penetration into front hood 22 of the earth and sand carried by the worker at the time of boarding and alighting. As described above, the rib 4*c* can prevent penetration into front hood 22 of earth and sand, etc. with a simple construction, and ensure smooth opening/closing of the front hood 22, without any problem of biting earth and sand, etc. between the bottom end of the front hood 22 and the floor 4*b*.

Possibility of Industrial Application

As described above, the present invention is a working machine with extremely-small swing, capable of extremely-small swinging and having high working efficiency in moving a working attachment by turning to left and right the intermediate part of a working arm device to left and right, in spite of its low-cost and compact construction not requiring any control or regulating means. It can be utilized for application in a variety of works, by being equipped with various elements such as rock crusher, chopper, etc. in addition to a bucket used for excavation work, as working attachment.

What is claimed is:

1. An extremely-small-swing working machine, comprising:

a swing table;

an operator's cab disposed on the swing table;

a working arm device disposed on one side of the operator's cab, the working arm including, a first boom section mounted on the swing table in a way to move freely in a forward and backward direction, a lower rotating shaft, a second boom section connected to a turning tip of the first boom section in a way to move freely to the left and right through the lower rotating shaft, an upper rotating shaft disposed about parallel to the lower rotating shaft, a third boom section connected at a first end to the second boom section in a way to move left or right, synchronizing with the left-right movement of the second boom section, through the upper rotating shaft, an actuator having a first end, wherein said first end of said actuator is connected to said first end of said third boom section, an arm connected to the third boom section in a way to move freely up and down in the longitudinal direction, and a working attachment connected to a tip of the arm, in such a way as to make the working attachment move to the left and right with left-right movement of the second boom section, wherein any contact between the working attachment and the operator's cab is avoided over the entire working range of the working attachment, without restricting or controlling the motions of the working attachment.

2. The extremely-small-swing working machine as set forth in claim 1, wherein the lower rotating shaft has a first end and a second end, wherein the first end on the side closer to the arm is positioned higher than the second end when the first boom section is positioned at a turning limit at an uppermost backward position.

3. The extremely-small-swing working machine as set forth in claim 1 wherein, when the first boom section is positioned at the turning limit at rear top, an angle formed by an axis of the lower rotating shaft and a front end face of the operator's cab becomes about right angle in side view.

4. The extremely-small-swing working machine as set forth in claim 1, wherein an operator's seat in the operator's cab is disposed in the backward direction from the center of swinging rotation of the swing table, and wherein the operator's cab is disposed at a position closer to the rear part on the swing table.

5. The extremely-small-swing working machine as set forth in claim 1, further comprising:

an oil feed port and a battery disposed at a position not interfering with the working attachment in front of the operator's cab on the swing table, and a resin hood covering the oil feed port and the battery.

6. An extremely-small-swing working machine, comprising:

a swing table;

an operator's cab disposed on the swing table;

a working arm device disposed on one side of the operator's cab, the working arm including, a first boom section mounted on the swing table in a way to move freely in a forward and backward direction, a lower rotating shaft, a second boom section connected to a turning tip of the first boom section in a way to move freely to the left and right through the lower rotating shaft, wherein, when the first boom section is positioned at a turning limit at an uppermost backward position, both the first boom section and the second boom section are inclined rearward in the shape of a slope, and an angle against verticality of the second boom section is smaller than an angle against verticality of the first boom section, an upper rotating shaft disposed about parallel to the lower rotating shaft, a third boom section connected at a first end to the second boom section in a way to move left or right, synchronizing with the left-right movement of the second boom section, through the upper rotating shaft, an actuator having a first end, wherein said first end of said actuator is connected to said first end of said third boom section, an arm connected to the third boom section in a way to move freely up and down in the longitudinal direction, and a working attachment connected to a tip of the arm, in such a way as to make the working attachment move to the left and right with left-right movements of the second boom section.

7. The extremely-small-swing working machine as set forth in claim 6, further comprising:

a rod interposed between the first boom section and the third boom section, wherein the rod forms a link parallel to the second boom section during a left-right movement of the second boom section, and wherein, when the first boom section is positioned at the turning limit at the uppermost backward position, at least one end of the rod is connected to an area near the back end of the third boom section.

8. An extremely-small-swing working machine, comprising:

a swing table;

an operator's cab disposed on the swing table;

a working arm device disposed on one side of the operator's cab, the working arm including, a first boom section mounted on the swing table in a way to move freely in a forward and backward direction, a lower rotating shaft, a second boom section connected to a turning tip of the first boom section in a way to move freely to the left and right through the lower rotating shaft, an upper rotating shaft disposed about parallel to the lower rotating shaft, wherein, when the first boom section is positioned at a turning limit at an uppermost backward position, an orientation of axes of the lower rotating shaft and the upper rotating shaft is about vertical, a third boom section connected at a first end to the second boom section in a way to move left or right, synchronizing with the left-right movement of the second boom section, through the upper rotating shaft, an actuator having a first end, wherein said first end of said actuator is connected to said first end of said third boom section, an arm connected to the third boom section in a way to move freely up and down in the longitudinal direction, and a working attachment connected to a tip of the arm, in such a way as to make the working attachment move to the left and right with left-right movement of the second boom section.

9. An extremely-small-swing working machine, comprising:

a swing table;

an operator's cab disposed on the swing table;

a working arm device disposed on one side of the operator's cab, the working arm including, a first boom section mounted on the swing table in a way to move freely in a forward and rearward direction, a lower rotating shaft, a second boom section connected to a turning tip of the first boom section in a way to move freely to the left and right through the lower rotating shaft, an upper rotating shaft disposed about parallel to the lower rotating shaft, a third boom section connected at a first end to the second boom section in a way to move left or right, synchronizing with the left-right movement of the second boom section, through the upper rotating shaft, wherein, when the first boom section is positioned at a turning limit at a lowermost forward position, the third boom section is formed in a way to extend downward, an actuator having a first end, wherein said first end of said actuator is connected to said first end of said third boom section, an arm connected to the third boom section in a way to move freely up and down in the longitudinal direction, and a working attachment connected to a tip of the arm, in such a way as to make the working attachment move to the left and right with left-right movements of the second boom section, wherein a breadth of the third boom section is formed smaller than a breadth of the working attachment.

10. An extremely-small-swing working machine, comprising:

a swing table;

an operator's cab disposed on the swing table;

a working arm device disposed on one side of the operator's cab, the working arm including, a first boom section mounted on the swing table in a way to move freely in a forward and backward direction, a lower rotating shaft having a first end and a second end, a second boom section connected to a turning tip of the first boom section in a way to move freely to the left and right through the lower rotating shaft, an upper rotating shaft disposed about parallel to the lower rotating shaft, a third boom section connected at a first end to the second boom section in a way to move left or right, synchronizing with the left-right movement of the second boom section, through the upper rotating shaft, an actuator having a first end, wherein said first end of said actuator is connected to said first end of said third boom section, an arm connected to the third boom section in a way to move freely up and down in the longitudinal direction, wherein, when the first boom section is positioned at a turning limit at an uppermost backward position, the first end of the lower rotating shaft on the side closer to the arm is positioned higher than the second end, and simultaneously, a turning fulcrum of the arm on the third boom section is positioned above an axial extension line of the upper rotating shaft, and a working attachment connected to a tip of the arm, in such a way as to make the working attachment move to the left and right with left-right movements of the second boom section.

11. An extremely-small-swing working machine, comprising:

a swing table;

an operator's cab disposed on the swing table;

a working arm device disposed on one side of the operator's cab, the working arm including, a first boom section mounted on the swing table in a way to move freely in a forward and backward direction, a lower rotating shaft, a second boom section connected to a turning tip of the first boom section in a way to move freely to the left and right through the lower rotating shaft, an upper rotating shaft disposed about parallel to the lower rotating shaft, a third boom section connected at a first end to the second boom section in a way to move left or right, synchronizing with the left-right movement of the second boom section, through the upper rotating shaft, an actuator having a first end, wherein said first end of said actuator is connected to said first end of said third boom section, an arm connected to the third boom section in a way to move freely up and down in the longitudinal direction, wherein, when the first boom section is positioned at a turning limit at an uppermost backward position and the arm is wound up to the maximum, the arm and the second boom section are disposed about parallel to each other, and a working attachment connected to a tip of the arm, in such a way as to make the working attachment move to the left and right with left-right movements of the second boom section.

12. An extremely-small-swing working machine, comprising:

a swing table;

an operator's cab disposed on the swing table;

a working arm device disposed on one side of the operator's cab, the working arm including, a first boom section mounted on the swing table in a way to move freely in a forward and backward direction, a lower rotating shaft, a second boom section connected to a turning tip of the first boom section in a way to move freely to the left and right through the lower rotating shaft, an upper rotating shaft disposed about parallel to the lower rotating shaft, a third boom section connected at a first end to the second boom section in a way to move left or right, synchronizing with the left-right movement of the second boom section, through the upper rotating shaft, an actuator having a first end, wherein said first end of said actuator is connected to said first end of said third boom section, an arm connected to the third boom section in a way to move freely up and down in the longitudinal direction, an arm-operating actuator interposed between the third boom section and the arm, wherein, in the axial direction of the arm-operating actuator, the arm-operating actuator is mostly arranged in parallel to the upper rotating shaft, and wherein a part of the second boom section is arranged along the arm-operating actuator so as to serve as a radial bearing of the upper rotating shaft over about the entire length of the upper rotating shaft, and a working attachment connected to a tip of the arm, in such a way as to make the working attachment move to the left and right with left-right movements of the second boom section.

13. An extremely-small-swing working machine, comprising:

a swing table;

an operator's cab disposed on the swing table;

an engine loaded on the swing table;

a bonnet covering the engine;

an exhaust muffler of the engine disposed outside the bonnet;

an exhaust pipe of the engine provided in extension from the exhaust muffler, wherein the exhaust pipe is further extended along a stanchion of the operator's cab with the exhaust pipe being covered by a member constituting the operator's cab, and a terminal end of the exhaust pipe is made to protrude above the operator's cab;

a working arm device disposed on one side of the operator's cab, the working arm device including, a first boom section mounted on the swing table in a way to move freely in a forward and backward direction, a lower rotating shaft, a second boom section connected to a turning tip of the first boom section in a way to move freely to the left and right through the lower rotating shaft, an upper rotating shaft disposed about parallel to the lower rotating shaft, a third boom section connected to the second boom section in a way to move left or right, synchronizing with the left-right movement of the second boom section, through the upper rotating shaft, an arm connected to the third boom section in a way to move freely up and down in the longitudinal direction, and a working attachment connected to a tip of the arm, in such a way as to make the working attachment move to the left and right with left-right movements of the second boom section.

* * * * *